US008580103B2

(12) United States Patent
Clasquin et al.

(10) Patent No.: US 8,580,103 B2
(45) Date of Patent: Nov. 12, 2013

(54) ELECTROLYTE SOLUTION AND ELECTROCHEMICAL SURFACE MODIFICATION METHODS

(75) Inventors: James L. Clasquin, Colorado Springs, CO (US); Thomas J. Christensen, Colorado Springs, CO (US)

(73) Assignee: MetCon, LLC, Monaca, PA (US)

( * ) Notice: Subject to any disclaimer, the term of this patent is extended or adjusted under 35 U.S.C. 154(b) by 185 days.

(21) Appl. No.: 12/952,163

(22) Filed: Nov. 22, 2010

(65) Prior Publication Data

US 2012/0125786 A1 May 24, 2012

(51) Int. Cl.
*C25F 3/00* (2006.01)
*C25F 1/00* (2006.01)

(52) U.S. Cl.
USPC ..... 205/684; 205/674

(58) Field of Classification Search
USPC ..... 205/674, 684
See application file for complete search history.

(56) References Cited

U.S. PATENT DOCUMENTS

| | | | | |
|---|---|---|---|---|
| 2,160,321 | A * | 5/1939 | Howard et al. | 205/238 |
| 3,054,737 | A | 9/1962 | Salt | |
| 3,087,874 | A | 4/1963 | Greisl | |
| 3,239,440 | A | 3/1966 | Covington | |
| 3,242,062 | A | 3/1966 | Covington | |
| 3,409,522 | A | 11/1968 | Grenier | |
| 3,817,844 | A | 6/1974 | Kendall | |
| 3,841,978 | A | 10/1974 | Lai | |
| 3,975,245 | A | 8/1976 | Bergquist | |
| 4,189,357 | A | 2/1980 | Riggs, Jr. | |
| 4,220,509 | A | 9/1980 | Shtanko | |
| 4,220,706 | A | 9/1980 | Spak | |
| 4,372,831 | A | 2/1983 | Rosswag | |
| 4,416,739 | A | 11/1983 | Turner | |
| 4,563,257 | A | 1/1986 | Sova | |
| 6,080,709 | A | 6/2000 | Ishikawa | |
| 6,147,002 | A | 11/2000 | Kneer | |
| 6,479,443 | B1 | 11/2002 | Zhang | |
| 6,610,194 | B1 | 8/2003 | Guerin | |
| 6,673,757 | B1 | 1/2004 | Kneer | |
| 6,835,300 | B2 | 12/2004 | Zhu | |
| 6,927,198 | B2 | 8/2005 | Zhang | |

(Continued)

FOREIGN PATENT DOCUMENTS

| | | | |
|---|---|---|---|
| WO | 200407088 | A1 | 8/2004 |
| WO | 2006037584 | A1 | 4/2006 |

OTHER PUBLICATIONS

"Citric Acid & Pollution Prevention in Passivation & Electropolishing," David M. Muchnick on behalf of Control Electropolishing Corp., Brooklyn, NY, Sep. 2002.

(Continued)

*Primary Examiner* — Nicholas A Smith
(74) *Attorney, Agent, or Firm* — Drinker Biddle & Reath LLP

(57) ABSTRACT

An aqueous electrolyte solution including a concentration of citric acid in the range of about 1.6 g/L to about 982 g/L and an effective concentration of ammonium bifluoride (ABF), and being substantially free of a strong acid. Methods of treating the surface of a non-ferrous metal workpiece include exposing the surface to a bath of an aqueous electrolyte solution including a concentration of citric acid less than or equal to about 300 g/L and a concentration of ammonium bifluoride greater than or equal to about 10 g/L, and having no more than about 3.35 g/L of a strong acid, controlling the temperature of the bath to be greater than or equal to about 54° C., connecting the workpiece to the anode of a DC power supply and immersing a cathode of the DC power supply in the bath, and applying a current across the bath.

9 Claims, 35 Drawing Sheets

(56) References Cited

U.S. PATENT DOCUMENTS

| | | | | |
|---|---|---|---|---|
| 7,087,562 | B2 | 8/2006 | Abe | |
| 7,128,825 | B2 | 10/2006 | Liu | |
| 7,501,051 | B2 | 3/2009 | Shieh | |
| 7,569,133 | B2 | 8/2009 | Kortvelyessy et al. | |
| 7,807,039 | B2 | 10/2010 | Piesslinger-Schweiger | |
| 8,357,287 | B2 * | 1/2013 | Clasquin et al. | 205/684 |
| 2003/0221974 | A1 | 12/2003 | Shieh | |
| 2004/0035354 | A1 | 2/2004 | Kneer | |
| 2004/0050715 | A1 | 3/2004 | Zhu | |
| 2004/0074783 | A1 | 4/2004 | MacDonald et al. | |
| 2006/0070888 | A1 | 4/2006 | Shieh | |
| 2006/0268657 | A1 | 11/2006 | Schertenleib | |
| 2006/0278535 | A1 | 12/2006 | Fairbourn | |
| 2007/0029209 | A1 | 2/2007 | Piesslinger-Schweiger | |
| 2007/0295611 | A1 | 12/2007 | Liu | |
| 2008/0167209 | A1 | 7/2008 | Kneer | |
| 2008/0217186 | A1 | 9/2008 | Bohme | |
| 2009/0107851 | A1 | 4/2009 | Kodera et al. | |
| 2009/0139875 | A1 | 6/2009 | Kim et al. | |
| 2010/0089768 | A1 | 4/2010 | Jensen et al. | |

OTHER PUBLICATIONS

"Electropolishing of CP Titanium and Its Alloys in an Alcoholic Solution-based Electrolyte," Kiyoshi Tajima et al., Dental Materials Journal 27(2): 258-265, 2008.

"Electropolishing of Tianium," B. Chou et al., Department of Materials and Engineering, Case Western Reserve University, Cleveland, Ohio, undated, retrieved from Internet Oct. 2010.

"Electropolishing," http://www.russamer.com/Electropolishing.html, accessed Dec. 11, 2008.

"Clean Manufacturing and Pollution Prevention Technical Assistance Report," Indiana Department of Environmental Management, Oct. 25, 2004.

"Standard Specification for Passivation Treatments for Stainless Steel Parts," ASTM A 967-05, Sep. 11, 2006.

"Clean, Economical Electropolishing," Jim Destefani, Products Finishing Online, http://www.pfonline.com/articles/clean-economical-electropolishing, posted May 1, 2007.

"Citric Acid Passivation of Stainless Steel," Lee V. Kremer, Products Finishing Online, http://www.pfonline.com/citric-acid-passivation-of-stainless-steel, posted May 1, 1999.

"What is Passivation?," Stellar Solutions, http://www.citricsurf.com/whatis.htm, accessed Nov. 2, 2009.

Stellar Solutions Product Information, http://www.citrisurf.com/products.htm, accessed Nov. 2, 2009.

"What is Electropolishing?", http://www.controlelectropolishing.com/info.html, accessed Dec. 11, 2008.

Pollution Prevention Success Stories—Control Electropolishing, undated.

New York State Environmental Investment Program (EIP) Capital Project Summary, East Williamsburg Valley Industrial Development Corp. on behalf of Control Electropolishing, Inc., undated.

* cited by examiner

| | 0 | 60 | 119.9 | 179.9 | 299.9 | 599.7 | 779.7 |
|---|---|---|---|---|---|---|---|
| 0 g/L ABF | -31.7% | 11.8% | 11.8% | 15.6% | -6.5% | 4.3% | 2.0% |
| 10 g/L ABF | -36.7% | 13.5% | 0.0% | -52.0% | -22.9% | -29.4% | -13.8% |
| 20 g/L ABF | -2.0% | 6.8% | 10.6% | 4.2% | 10.4% | 6.7% | 30.9% |
| 60 g/L ABF | -8.0% | 4.2% | 11.3% | -13.6% | 21.3% | 46.9% | 34.6% |
| 120 g/L ABF | -166.0% | -128.6% | -30.2% | -152.2% | 2.3% | 44.7% | 16.3% |

| | | | | | | | |
|---|---|---|---|---|---|---|---|
| 0 g/L ABF | 0.000 | 0.000 | 0.000 | 0.020 | 0.000 | 0.000 | 0.008 |
| 10 g/L ABF | 0.000 | 0.404 | 0.444 | 0.520 | 0.512 | 0.216 | 0.136 |
| 20 g/L ABF | 0.512 | 1.012 | 1.080 | 0.816 | 0.808 | 0.420 | 0.244 |
| 60 g/L ABF | 2.064 | 2.200 | 2.420 | 2.360 | 2.424 | 1.240 | 0.008 |
| 120 g/L ABF | 3.792 | 3.244 | 3.472 | 3.896 | 3.748 | 0.044 | 0.004 |

| | | | | | | | |
|---|---|---|---|---|---|---|---|
| 0 g/L ABF | 20.6% | -4.0% | -4.1% | 8.7% | 8.2% | 2.3% | -12.8% |
| 10 g/L ABF | -196.2% | -42.6% | -35.4% | -64.4% | -37.7% | -16.3% | 9.8% |
| 20 g/L ABF | -357.1% | -44.0% | -90.7% | -84.1% | -39.6% | 0.0% | -6.3% |
| 60 g/L ABF | -163.8% | -82.6% | -71.7% | -63.0% | -61.2% | -68.4% | -873.9% |
| 120 g/L ABF | -135.7% | -66.7% | -71.7% | -58.3% | -21.0% | -265.3% | -566.0% |

FIG. 11
(PRIOR ART)
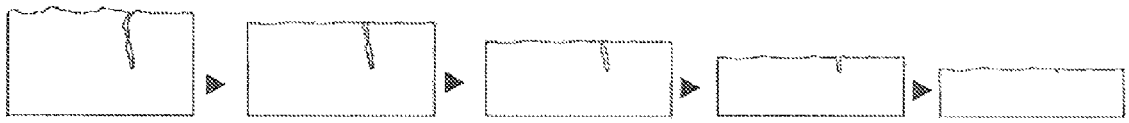
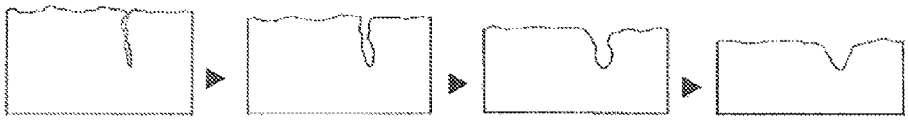
FIG. 12

ELECTROLYTE SOLUTION AND ELECTROCHEMICAL SURFACE MODIFICATION METHODS

CROSS REFERENCE TO RELATED APPLICATIONS

This application is related to a commonly owned application entitled "Electrolyte Solution and Electropolishing Methods" that is being filed concurrently with this application.

FIELD

The solutions and methods relate to the general field of electropolishing non-ferrous metal parts and surfaces, and more specifically to surface treatment by electropolishing, including crack modulation and oxide removal, for non-ferrous and reactive metals, particularly titanium and titanium alloys.

BACKGROUND

In working reactive metals from metal ingot to finished mill product and after finished part hot working, it is necessary to remove certain surface layer material of metal oxide or, in the case of titanium and titanium alloys, what is commonly referred to as alpha case. These oxygen-enriched phases occur when reactive metals are heated in air or oxygen-containing atmospheres. The oxide layer can affect material strength, fatigue strength, and corrosion resistance of the metal. Titanium and titanium alloys are among the reactive metals, meaning that they react with oxygen and form a brittle tenacious oxide layer ($TiO_2$ for Ti, $ZrO_2$ for Zr, etc.) whenever heated in air or an oxidizing atmosphere above about 480° C. (900° F.), depending on the specific alloy and oxidizing atmosphere. The oxide layer is created by heating of the metal to necessary temperatures for typical mill forging or mill rolling, as a result of welding, or by heating for finished part forging or hot part forming. Reactive metal oxides and alpha case are brittle, and upon forming are routinely accompanied by a series of surface microcracks which penetrate into the bulk metal, potentially causing premature tensile or fatigue failures, and making the surface more susceptible to chemical attack. Therefore, the oxide or alpha case layer must be removed before any subsequent hot or cold working, or final component service.

It is also important when working reactive metals such as titanium and titanium alloys from ingot to finished part, that the cracks formed by thermal and mechanical processing be removed. As described above, these cracks may go deeper than the alpha case and penetrate the bulk metal. Reactive metals are typically heated, hot processed (e.g., forged, rolled, drawn, extruded), cooled, and reheated for additional hot processing between 4 and 8 times to turn an ingot into a finished mill product. The mill product is often again heated for finished part fabrication using techniques including, but not limited to, hot spin forming, ring rolling, superplastic forming, and closed die forming. Each time the metal is cooled after hot processing, cracks form at the surface and extend into the workpiece. In conventional processing, these cracks, are removed by grinding, which involves mechanically removing, or chemical milling in a strong acid, typically HF—$HNO_3$, a uniform thickness layer or amount of material from the workpiece until the bottom of the deepest crack is exposed and removed. Grinding or chemical milling to this depth ensures that all of the cracks are removed, but takes a significant amount of time and labor and also results in a significant and costly loss of material. This is because the cracks sometimes extend into the workpiece to a depth of 5% or more of the thickness or diameter of the workpiece or finished part. But removal of the cracks is necessary, because if the cracks are not removed prior to a subsequent hot working step, or use of a finished part in service, the cracks can propagate and ruin the workpiece or finished part.

In chemistry and manufacturing, electrolysis is a method of using direct electrical current (DC) to drive an otherwise non-spontaneous chemical reaction. Electropolishing is a well known application of electrolysis for deburring metal parts and for producing a bright smooth surface finish. The workpiece to be electropolished is immersed in a bath of electrolyte solution and subjected to a direct electrical current. The workpiece is maintained anodic, with the cathode connection being made to one or more metal conductors surrounding the workpiece in the bath. Electropolishing relies on two opposing reactions which control the process. The first of the reactions is a dissolution reaction during which the metal from the surface of the workpiece passes into solution in the form of ions. Metal is thus removed ion by ion from the surface of the workpiece. The other reaction is an oxidation reaction during which an oxide layer forms on the surface of the workpiece. Buildup of the oxide film limits the progress of the ion removal reaction. This film is thickest over micro depressions and thinnest over micro projections, and because electrical resistance is proportional to the thickness of the oxide film, the fastest rate of metallic dissolution occurs at the micro projections and the slowest rate of metallic dissolution occurs at the micro depressions. Hence, electropolishing selectively removes microscopic high points or "peaks" faster than the rate of attack on the corresponding micro depressions or "valleys."

Another application of electrolysis is in electrochemical machining processes (ECM). In ECM, a high current (often greater than 40,000 amperes, and applied at current densities often greater than 1.5 million amperes per square meter) is passed between an electrode and a metal workpiece to cause material removal. Electricity is passed through a conductive fluid (electrolyte) from a negatively charged electrode "tool" (cathode) to a conductive workpiece (anode). The cathodic tool is shaped to conform with a desired machining operation and is advanced into the anodic workpiece. A pressurized electrolyte is injected at a set temperature into the area being machined. Material of the workpiece is removed, essentially liquefied, at a rate determined by the tool feed rate into the workpiece. The distance of the gap between the tool and the workpiece varies in the range of 80 to 800 microns (0.003 to 0.030 inches). As electrons cross the gap, material on the workpiece is dissolved and the tool forms the desired shape into the workpiece. The electrolyte fluid carries away metal hydroxide formed in the process from the reaction between the electrolyte and the workpiece. Flushing is necessary because the electrochemical machining process has a low tolerance for metal complexes accumulating in the electrolyte solution. In contrast, processes using electrolyte solutions as disclosed herein remain stable and effective even with high concentrations of titanium in the electrolyte solution.

Electrolyte solutions for metal electropolishing are usually mixtures containing concentrated strong acids (completely dissociated in water) such as mineral acids. Strong acids, as described herein, are generally categorized as those that are stronger in aqueous solution than the hydronium ion ($H_3O^+$). Examples of strong acids commonly used in electropolishing are sulfuric acid, hydrochloric acid, perchloric acid, and nitric acid, while examples of weak acids include those in the carboxylic acid group such as formic acid, acetic acid, butyric acid, and citric acid. Organic compounds, such as alcohols, amines, or carboxylic acids are sometimes used in mixtures with strong acids for the purpose of moderating the dissolution etching reaction to avoid excess etching of the workpiece surface. See, for example, U.S. Pat. No. 6,610,194 describing the use of acetic acid as a reaction moderator.

There is an incentive to reduce the use of these strong acids in metal finishing baths, due primarily to the health hazard and cost of waste disposal of the used solution. Citric acid has previously become accepted as a passivation agent for stainless steel pieces by both Department of Defense and ASTM standards. However, while prior studies have shown and quantified the savings from using a commercial citric acid passivation bath solution for passivating stainless steel, they have been unable to find a suitable electrolyte solution in which a significant concentration of citric acid was able to reduce the concentration of strong acids. For example, a publication titled "Citric Acid & Pollution Prevention in Passivation & Electropolishing," dated 2002, describes several advantages of decreasing the amount of strong mineral acids by the substitution of some amount of a weaker organic acid, and in particular citric acid, due to its low cost, availability, and relatively hazard free disposal, but ultimately evaluated an alternative electrolyte comprising a mixture of mostly phosphoric and sulfuric acid, with a small amount of an organic acid (not citric acid).

SUMMARY

Alpha case removal and crack modulation have not typically been remedied by electropolishing processes. The strong acid components found in typical electrolyte solutions used in the prior art of electropolishing result in hydrogen migration into the metal surfaces, and aggressive uncontrolled etching that may deepen the cracks. In their development of new electropolishing bath chemistries using solutions of weak acids and ABF, in the absence of strong acid components, the inventors have discovered that both alpha case removal and crack modulation can be effectively remedied through electropolishing. Consequently, methods of oxide removal and crack modulation by electropolishing processes are disclosed herein using the novel bath chemistries suited for those methods.

In one embodiment, an aqueous electrolyte solution is disclosed including about 0.1% by weight to about 59% by weight of a carboxylic acid, and about 0.1% by weight to about 25% by weight of a fluoride salt, and being substantially free of a strong acid.

In another embodiment, an aqueous electrolyte solution is disclosed including about 1.665 g/L citric acid to about 982 g/L citric acid, and about 2 g/L ammonium bifluoride to about 360 g/L ammonium bifluoride of a fluoride salt, and being substantially free of a strong acid.

In one embodiment, a method of treating the surface of a non-ferrous metal workpiece is disclosed, the method including exposing the surface to a bath of an aqueous electrolyte solution including a concentration of citric acid less than or equal to about 300 g/L and a concentration of ammonium bifluoride greater than or equal to about 10 g/L, and having no more than about 3.35 g/L of a strong acid, controlling the temperature of the bath to be greater than or equal to about 54° C., connecting the workpiece to the anode of a DC power supply and immersing a cathode of the DC power supply in the bath, and applying a current across the bath.

In one embodiment, a method of modulating cracks in the surface of a non-ferrous metal workpiece is disclosed, the method including exposing the surface to a bath of an aqueous electrolyte solution including a concentration of citric acid less than or equal to about 300 g/L and a concentration of ammonium bifluoride greater than or equal to about 60 g/L, and having no more than about 3.35 g/L of a strong acid, controlling the temperature of the bath to be greater than or equal to about 54° C., connecting the workpiece to the anode of a DC power supply and immersing a cathode of the DC power supply in the bath, and applying a current across the bath of less than about 53.8 amperes per square meter.

In one embodiment, a method of metal oxide removal from the surface of a non-ferrous metal workpiece is disclosed, the method including exposing the surface to a bath of an aqueous electrolyte solution including a concentration of citric acid less than or equal to about 60 g/L and a concentration of ammonium bifluoride greater than or equal to about 60 g/L, and having no more than about 3.35 g/L of a strong acid, controlling the temperature of the bath to be greater than or equal to about 54° C., connecting the workpiece to the anode of a DC power supply and immersing a cathode of the DC power supply in the bath, and applying a current across the bath of less than about 53.8 amperes per square meter.

In one embodiment, a method of alpha case removal from the surface of a titanium or titanium alloy workpiece is disclosed, the method including exposing the surface to a bath of an aqueous electrolyte solution including a concentration of citric acid less than or equal to about 60 g/L and a concentration of ammonium bifluoride greater than or equal to about 60 g/L, and having no more than about 3.35 g/L of a strong acid, controlling the temperature of the bath to be greater than or equal to about 54° C., connecting the workpiece to the anode of a DC power supply and immersing a cathode of the DC power supply in the bath, and applying a current across the bath of less than about 53.8 amperes per square meter.

BRIEF DESCRIPTION OF FIGURES

FIG. 11 is schematic representation of a sequence that occurs in prior art process for removing a crack extending into a workpiece from a surface of the material.

FIG. 12 is a schematic representation of a sequence that occurs in a process using an electrolyte as disclosed herein for modulating a crack extending into a workpiece form a surface of the material.

DETAILED DESCRIPTION

Figure 1A:
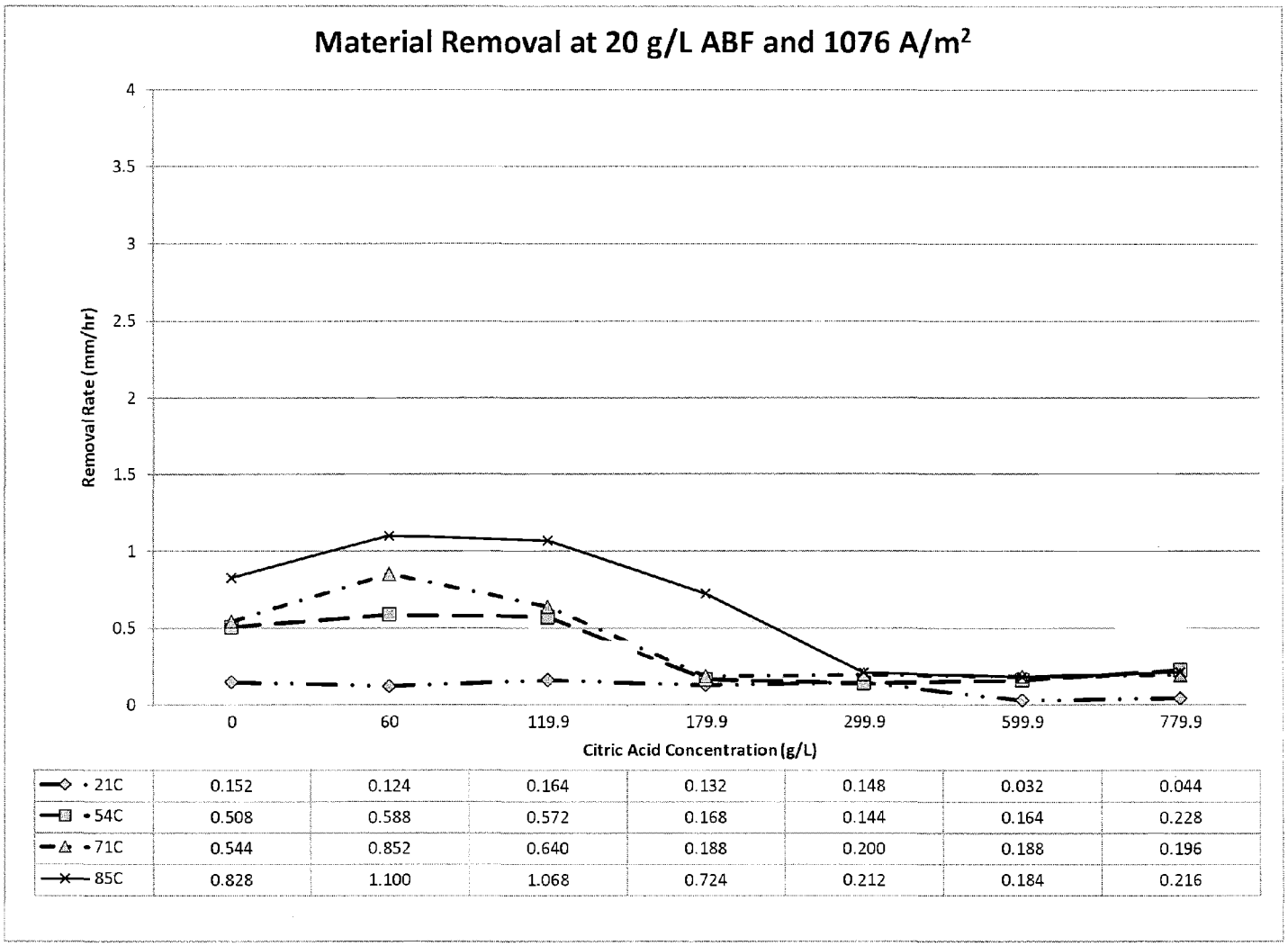
FIGS. 1A-1B are graphs of data showing the rate of material removal and the change in surface finish as a function citric acid concentration in an aqueous electrolyte solution having a moderately low concentration of 20 g/L ammonium bifluoride a high current density of 1076 A/m$^2$ over a range of temperatures.

Aqueous electrolyte solutions that are particularly useful for surface treatment of reactive metals including, but not limited to, titanium and titanium alloys are disclosed herein. Relatively small amounts of a fluoride salt and a carboxylic acid are dissolved in water, substantially in the absence of a strong acid such as a mineral acid, such that the solution is substantially free of a strong acid. This electrolyte solution is a notable departure from earlier attempts at electrolyte baths for surface treatment of reactive metals, including but not limited to titanium and titanium alloys, which typically use strong acids and require that the amount of water in the electrolyte solution be kept to an absolute minimum.

The fluoride salt provides a source of fluoride ions to the solution and may be, but is not limited to, ammonium bifluoride, $NH_4HF_2$ (sometimes abbreviated herein as "ABF"). Without being bound by theory, it is believed that the carboxylic acid moderates the fluoride ion attack on the reactive metal surface to be treated and may be, but is not limited to, citric acid. No amount of strong acid or mineral acid is deliberately added to the solution, although a trace amount of strong acid may be present. As used herein, the terms "substantially in the absence of" and "substantially free of" are used to designate concentrations of strong acid less than or equal to about 3.35 g/L, preferably less than or equal to about 1 g/L, and more preferably less than about 0.35 g/L.

Test coupons of commercially pure (CP) titanium were immersed in a bath of aqueous solution including 60 g/L of citric acid and 10 g/L ABF at 54° C., and a current was applied at 583 $A/m^2$. A coupon cut from mill-surface titanium strip (0.52 μm surface roughness) exposed to this solution for 15 minutes was uniformly smooth (0.45 μm surface roughness) and cosmetically reflective. Then, small quantities of 42° Be $HNO_3$ (nitric acid) were incrementally added, and the prepared test coupon was processed repeatedly until surface changes were detected. The coupons were not affected by the processing after each nitric acid addition until the nitric acid concentration reached 3.35 g/L, at which point the test panel showed a non-uniform cosmetic appearance, including pitting and spalling, with irregular attack around the perimeter of the coupon with surface roughness ranging from 0.65 to 2.9 μm and higher. Nitric acid is considered to be a borderline strong acid with a dissociation constant not much greater than that of the hydronium ion. Therefore, it is expected that for other stronger acids having the same or greater dissociation constants than nitric acid, a similar electrolyte solution would be similarly effective at controlled material removal and micropolishing at concentrations of strong acid less than approximately 3.35 g/L. However, it is expected that other electrolyte solutions disclosed herein having different concentrations of citric acid and ABF, and different ratios of citric acid and ABF concentrations, may have a lower tolerance for the presence of a strong acid, depending on the particular strong acid as well as operating parameters such as temperature and current density. Therefore, no more than about 1 g/L of strong acid, and preferably no more than about 0.35 g/L of strong acid, should be present to enable aqueous electrolyte solutions to be effectively used for material removal and surface finish refinement over a wide range of citric acid and ABF concentrations in and at a wide range of temperatures and current densities.

Extensive electropolishing testing has been conducted on titanium and titanium alloy samples using a range of chemistry concentrations, current densities, and temperatures. In particular, testing has been performed on "clean" mill products (representative of typical mill producer "as delivered" condition metal meeting American Society for Testing and Materials (ASTM) or Aerospace Material Specification (AMS) standards) in order to measure the ability of various solutions and methods to remove bulk metal, to improve or refine the surface finish on sheet metal products with low material removal rates, and/or to micropolish metal surfaces to very fine surface finishes with very low material removal rates. In addition, while most of the testing has focused on titanium and titanium alloys, testing has also shown that the same solutions and methods are more generally applicable to treat many non-ferrous metals. For example, good results have been obtained on metals in addition to titanium and titanium alloys including, but not limited to, gold, silver, chromium, zirconium, aluminum, vanadium, niobium, copper, molybdenum, zinc, and nickel. Additionally, alloys such as titanium-molybdenum, titanium-aluminum-vanadium, titanium-aluminum-niobium, titanium-nickel (Nitinol®), titanium-chromium (Ti 17®), Waspaloy, and Inconel® (nickel base alloy) have also been positively processed.

An electrolyte solution containing citric acid and ammonium bifluoride has proven to be effective at etching nonferrous metals and metal alloys in surprisingly dilute concentration of both components. In this context, etching is understood to encompass substantially uniform surface removal. In addition, improvements in surface finish have been shown over a wide range of both citric acid and ammonium bifluoride concentrations. While any concentration of citric acid up to saturation point with water (59% by weight, or about 982 g/L of aqueous solution at standard temperature and pressure) could be used, there appears to be a correlation between citric acid concentration and ammonium bifluoride concentration at which the citric acid sufficiently mitigates the etching effects of the fluoride ion generated by dissociation of the ammonium bifluoride that the rate of material removal is dramatically curtailed while micropolishing of the material surface is enhanced. For both etching and micropolishing, several mixtures having amounts of citric acid concentration as low as 3.6 wt. %, or about 60 g/L, of solution have demonstrated etch rates and surface micropolishing results on titanium comparable to concentrations of citric acid well above that amount, including up to about 36 wt. % or about 600 g/L of solution. Thus, in these solutions the etch rate is apparently more directly influenced by the concentration of ABF than by the concentration of citric acid. Effective etching and micropolishing has even been shown at extremely low citric acid concentrations of less than about 1 wt. %, or about 15 g/L of solution. The presence of even the smallest amount of fluoride ion, however, appears to be sufficient for some metal removal to occur.

The etch rate falls substantially at concentrations of citric acid above about 600 g/L. However, at this high concentration of citric acid, at least in cases of moderate to high current density, the surface finish results improve while the etch rate falls. Thus, when direct current is applied, the more dilute mixtures of citric acid enable greater rates of surface material removal, while the more concentrated mixtures of citric acid, up to mixtures as high as about 42% by weight, or about 780 g/L of solution, provide a smoother and more lustrous finish, with uniform fine grain and no corona effect as compared to pieces finished with less concentrated citric acid mixtures.

Highly controlled metal removal can be achieved using the bath solutions and methods described herein. In particular, the level of control is so fine that bulk metal can be removed in thicknesses as small as 0.0001 inches and as large and precise as 0.5000 inches. Such fine control can be achieved by regulating a combination of citric acid and ABF concentrations, temperature, and current density, as well as by varying the duration and cyclical application of direct current. Removal can be performed generally uniformly on all surfaces of a workpiece, or can be selectively applied only on certain selected surfaces of a mill product or manufactured component. Control of removal is a achieved by fine tuning several parameters, including but not limited to temperature, power density, power cycle, ABF concentration, and citric acid concentration.

Removal rates vary directly with temperature, and thus, when all other parameters are held constant, removal is slower at cooler temperatures and faster at higher temperatures. Nevertheless, by maintaining the concentrations of citric acid and ABF within certain preferred ranges, high levels of micropolishing can also be achieved at high temperatures, which is contrary to what might be expected.

Removal rate depends on the manner in which DC power is applied. Contrary to what might be expected, removal rate appears to be inversely related to continuously applied DC power, and when continuously applied, increasing the DC power density decreases the removal rate. However, by cycling the DC power, removal rates can be hastened. Consequently, when significant material removal rates are desired, DC power is cycled from OFF to ON repeatedly throughout a treatment operation. Conversely, when fine control of removal rates is desired, DC power is continually applied.

Without being bound by theory, it is believed removal is slowed in proportion to the thickness of an oxide layer that is formed at the surface of the metal, and higher applied DC power results in more oxidation at the metal surface, which may act as a barrier to fluoride ion attack of the metal. Accordingly, cycling the DC power on and off at a prescribed rate can overcome this oxygen barrier, or creates a mechanism that encourages a thick oxide to periodically spall off the surface. As described herein, varying the operating parameters of bath temperature, applied voltage, citric acid concentration and ammonium bifluoride concentration, the electrolyte provides the ability to tailor the beneficial results, namely, highly controlled bulk metal removal and micropolishing, to the specific application. In addition varying operating conditions within a given process set of operating parameters can alter and enhance the ability to fine-tune control of metal removal and surface finish.

Figure 8A:
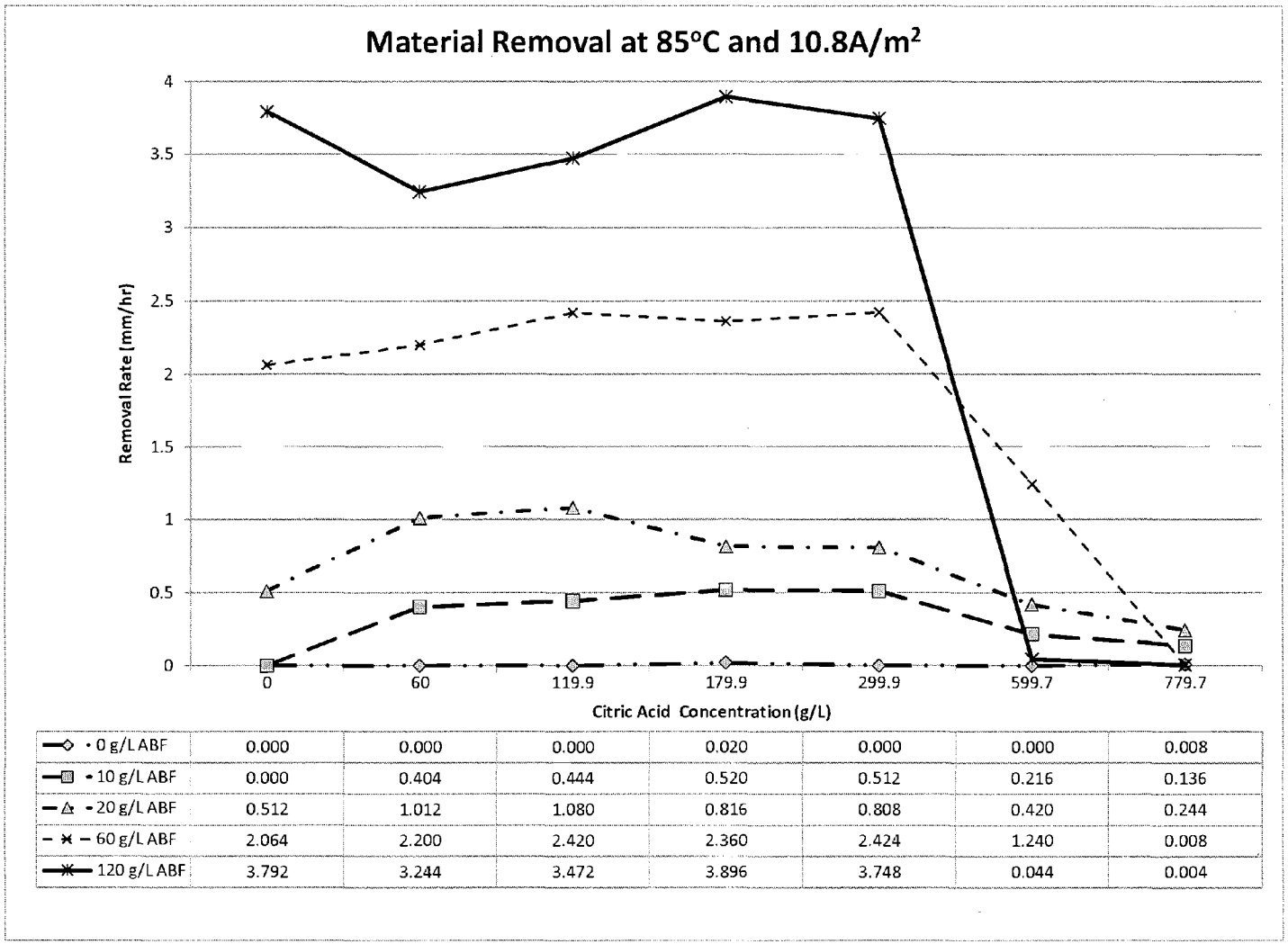
FIGS. 8A-8B are graphs of data showing the amount of material removed and the change in surface finish, respectively, at various combinations of citric acid and ammonium bifluoride concentrations at a representative high temperature (85° C.) and low current density (10.8 $A/m^2$).
Figure 8B:
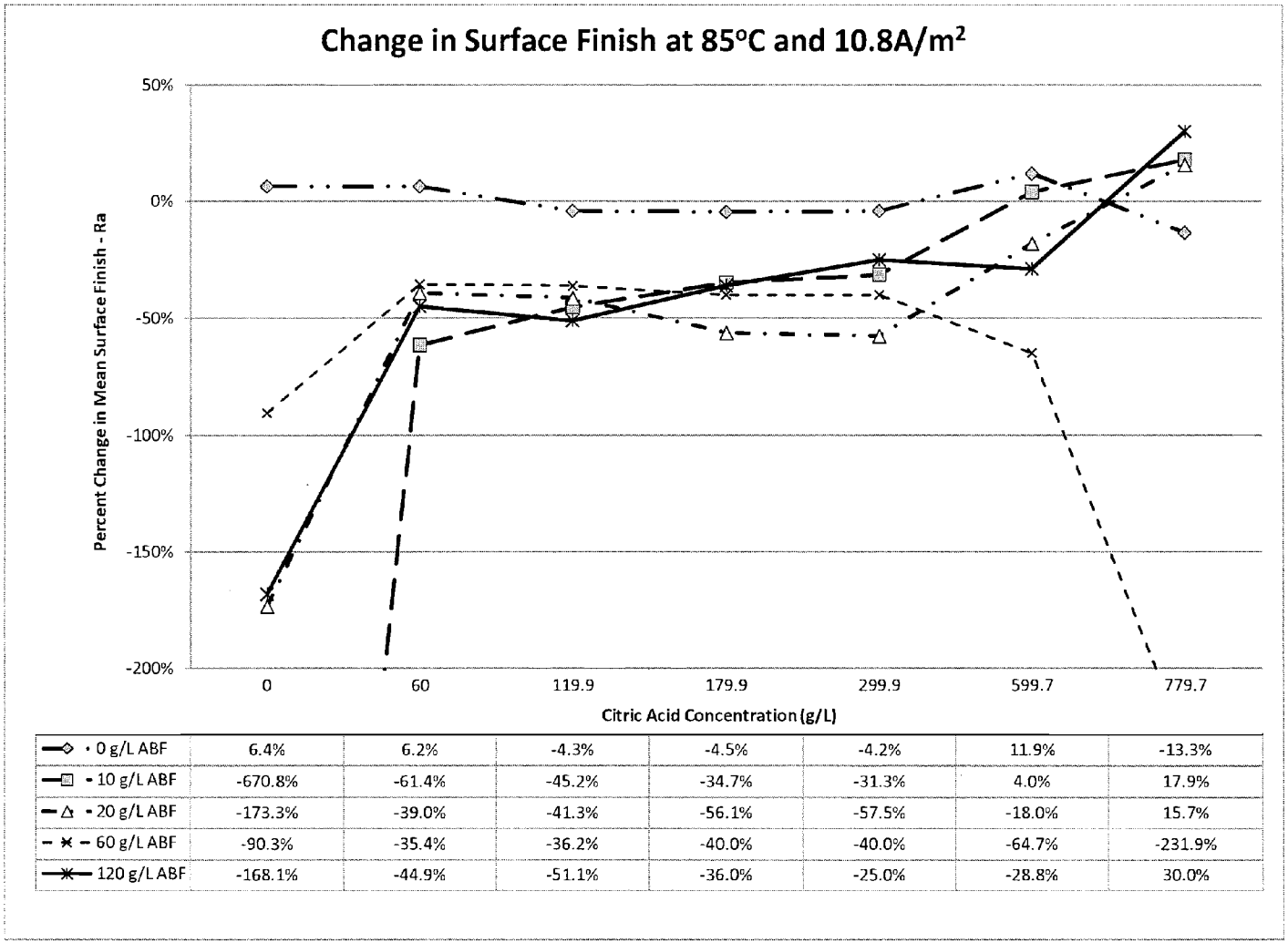
Figure 9A:
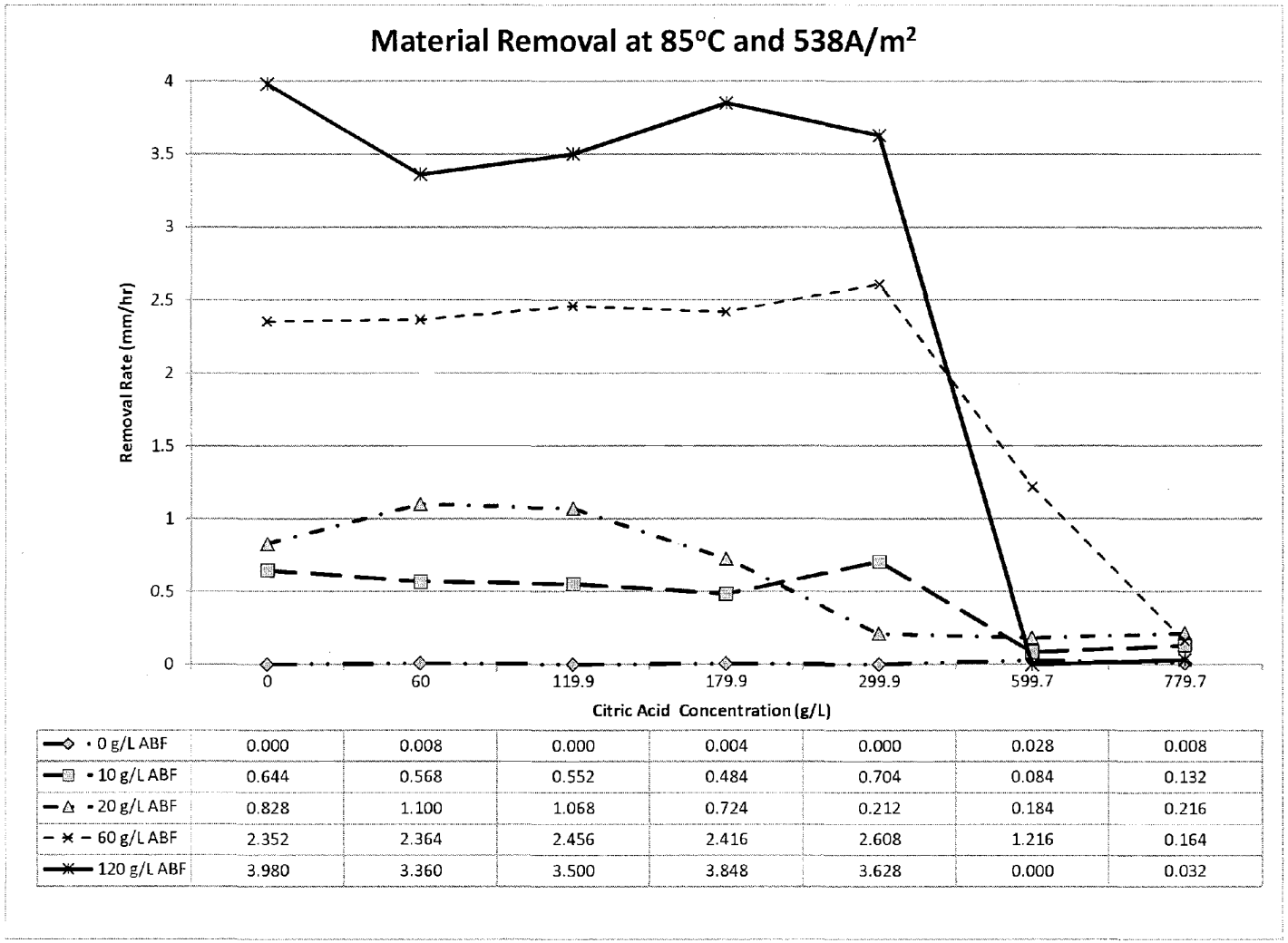
FIGS. 9A-9B are graphs of data showing the amount of material removed and the change in surface finish, respectively, at various combinations of citric acid and ammonium bifluoride concentrations at a representative high temperature (85° C.) and high current density (538 $A/m^2$).

For example, FIGS. 8A and 9A demonstrate that at 85° C., 300 g/L citric acid, 10 g/L ammonium bifluoride, material removal rates increase as current density increases from 10.8 $A/m^2$ to 538 $A/m^2$. Concurrently, FIGS. 8B and 9B demonstrate that at the same conditions, surface finishes degrade when current density increases from 10.8 $A/m^2$ to 538 $A/m^2$. By cycling the DC power supply between these two current densities, a net result can be achieved that is better than operating solely at either one of the current densities for the entire process. In particular, the process time to remove a specific amount of material can be reduced as compared to operating solely at 10.8 $A/m^2$. Additionally, because of the smoothing effect of the lower current density, overall surface finish of the final product is superior to that obtained by processing solely at 538 $A/m^2$. Therefore, cycling between two or more power settings (as manifested in the current density) enables complimentary results of both improved surface and precise bulk metal removal, with the process requiring less total time than the individual processes for either surface enhancement or bulk metal removal alone.

In addition to varying the duty cycle, electricity may be applied across the electrolyte solution and through the workpiece may in various wave forms that are available from DC power supplies, including but not limited to half wave, full-wave rectified, square wave, and other intermediate rectifications to produce additional beneficial results and/or enhancements to process speed without sacrificing the ultimate surface finish. DC switching rates as fast as 50 kHz to 1 MHz, or as slowly 15 to 90 minutes cycles, may be beneficial depending on the surface area to be processed, the mass of the workpiece, and the particular surface condition of the workpiece. Additionally, the DC switching cycle itself may optimally require its own cycle. For example, a large mass workpiece with a very rough initial surface finish may benefit the greatest from a slow switching cycle initially, followed by a switching cycle of increased frequency as material is removed and the surface finish improves.

Testing electrolytic baths of the type described herein also revealed that electropolishing takes place in certain embodiments without increasing hydrogen concentration in the surface of the metal, and in some instances decreases the hydrogen concentration. The oxygen barrier at the material surface may be responsible for the absence of hydrogen migration into the matrix of the metal. Data suggests that this oxygen barrier may also be removing hydrogen from the metal surface. Higher fluoride ion concentrations result in faster removal rates, but have an unknown impact on hydrogen adsorption to the metal matrix. Higher citric acid concentrations tends to slow removal rates and demand higher power densities during electropolishing, but also act to add 'smoothing' or 'luster' to the surface.

Several advantages result from using an aqueous electrolyte solution of ABF and citric acid as compared with prior art solutions for finishing and/or pickling metal products. The disclosed electrolyte solutions enable a precisely controlled finish gauge to be achieved. Finishing of conventional producer alloy flat products (sheet and plate) involves multi-step grinding to finished gauge using increasingly fine grinding media, typically followed by "rinse pickling" in an acid bath including hydrofluoric acid (HF) and nitric acid ($HNO_3$) to remove residual grinding materials, ground-in smeared metal, and surface anomalies. HF—$HNO_3$ acid pickling is exothermic and is therefore difficult to control, and often results in the metal going under gauge, resulting in a higher scrap rate or lower-value repurposing of the metal. By using the disclosed electrolyte solutions, the typical secondary and tertiary grinds can be eliminated, as can the need for the rinse pickle. A precise predetermined finished gauge can be reached that cannot be achieved with current state of the art grinding and pickling. Further, the disclosed electrolyte solutions do not introduce stresses into the part being treated. By comparison, any mechanical grinding process imparts significant surface stresses, which can cause material warping and results in some percentage of material being unable to meet typical or customer stipulated flatness specifications.

A typical process using HF—$HNO_3$ acid pickling will charge hydrogen into the target material which often must be removed by costly vacuum degassing to prevent embrittlement of the material. Testing conducted using an aqueous electrolyte bath containing citric acid and ABF on typical mill production full-size sheets of Ti-6Al-4V and on coupons of CP titanium, 6Al-4V titanium, and nickel base alloy 718 has shown reduced hydrogen impregnation results as compared with samples exposed to conventional strong acid pickling solutions. In particular, when treating Ti-6Al-4V and CP titanium to achieve the same alpha-case free, clean surface end result as is typically achieved by strong acid pickling, using an aqueous electrolyte solution compositions including ammonium bifluoride and citric acid, a range of temperature and current densities conditions were identified at which no hydrogen was charged into the material of the workpiece, and in many of those operating conditions, hydrogen was actually pulled out of the material. For all of the metals and alloys, while testing is ongoing to refine preferable operating ranges, results so far consistently indicate that even under conditions that may not be optimal, less hydrogen was charged into the material than would have been charged under the same operating conditions using a strong acid pickling bath. In general, lower concentrations of ammonium bifluoride result in greater hydrogen removal from, or less hydrogen impregnation into, the material exposed to the electrolyte solution.

Highly Controlled Metal Removal, Surface Finishing, and Micropolishing.

Micropolishing or microsmoothing of components, and in particular micro-smoothing of already relatively smooth surfaces, can be achieved using solutions and methods described herein with a superior precision as compared with manual or machine polishing. Micropolishing occurs without generating detrimental residual stresses in the target workpiece or material, and without smearing of metal in the workpiece, both of which are problems inherent in current mechanical methods. Additionally, by eliminating human variability, the resulting levels of polish are specific and reproducible. Cost savings can also be achieved using the disclosed electrolyte solution versus existing methods.

In testing, good results for micropolishing have been obtained at high concentrations of citric acid, low to moderate concentrations of ABF, high temperature, and high DC current density, which can be applied continuously or cyclically. However, DC power density should be adjusted based on the alloy being treated. Aluminum-containing alloys of titanium (typically alloys of alpha-beta metallurgy, including the common Ti-6Al-4V alloy) tend to lose luster at applied DC voltages in excess of 40 volts. However, for these metals, capping the voltage at about 40 volts and applying a higher current (i.e., to achieve a higher power density) enables the material luster to again be realized. Without being bound by theory, this may be a result of the alpha stabilizing element, which in the case of most alpha-beta alloys (including Ti-6Al-4V) is aluminum anodizing to $Al_2O_3$ rather than being polished. In addition, titanium-molybdenum (all beta phase metallurgy) and commercially pure (CP) titanium (all alpha phase), however, get brighter with increasing DC power densities without apparently being bound by a similar upper voltage limit. In particular, for other metals, it has been found that higher voltages up to at least 150 volts can be used, for example with the nickel base alloy 718 to produce beneficial results in electropolishing, micropolishing, and surface treatment using electrolyte solutions as disclosed herein.

The solutions and method disclosed herein can be used to deburr machined parts by preferentially processing the burrs on machined metal components, especially when the parts are made from difficult to machine metals such as titanium and nickel base alloys. In the current state of the art, deburring of machined components is typically performed as a manual operation, and thus suffers from many problems associated with human error and human inconsistency. Testing with the disclosed solutions has shown that deburring is most effective when citric acid concentration is low, due to the resistive nature of citric acid in the electrochemical cell, and best when fluoride ion from ABF, is high. Similar solutions can also be used to remove surface impurities or to clean a workpiece after machining, such as might otherwise be done using a strong acid pickling with an HF—$HNO_3$ bath.

Non-ferrous and especially reactive metals demonstrate an effective rate of chemical etch in a wide range of dilute citric mixtures, as described above. This allows customization of a finishing process for a particular non-ferrous metal workpiece that may include a selected dwell time in the bath before applying electric current to remove and react some of the surface metal before electropolishing begins to selectively reduce peak areas.

The citric acid based electrolyte has a much lower viscosity than traditional electropolishing mixtures, in part due to the much lower dissociation constant of citric acid as compared with the strong acids normally used in electropolishing electrolytes. The lower viscosity aids in material transport and lowers electrical resistance, so that lower voltages can be used than in conventional electropolishing. The electropolishing finish ultimately obtained is substantially influenced by the viscosity and resistivity of the electrolyte employed. It has been found that the finest surface finishes (highly micropolished) can be achieved using a highly resistive electrolyte solution in combination with a high electropolishing voltage (and thus a moderate to high current density). In addition, when a somewhat more conductive (less highly resistive)

electrolyte solution is employed, fine micropolishing can still be achieved at high voltages and high current densities.

It should follow that corresponding benefits will apply to electrochemical machining. In particular, it is expected that electrolyte baths having compositions as described herein can be used effectively in place of conventional electrochemical machining and/or pickling solutions, with substantial environmental and cost benefits. Because the electrolyte solutions disclosed herein are essentially free of strong acid, the problems of hazardous waste disposal and handling are minimized. Moreover, the required current densities are far less than required for conventional electrochemical machining.

In general, increasing the concentration of ammonium bifluoride tends to decrease the electrical resistance of the electrolyte solution (i.e., ammonium bifluoride increases the electrical conductivity of the electrolyte solution), while the presence of citric acid, or increasing the concentration of citric acid relative to the concentration of ammonium bifluoride, tends to mitigate the effects of the ammonium bifluoride on electrical resistance. In other words, to maintain the electrical resistance of the electrolyte solution at a high level to promote micropolishing, it is desirable to keep ammonium bifluoride concentrations low, or to use a higher concentration of ammonium bifluoride in conjunction with a higher concentration of citric acid. Thus, by varying the concentration of ammonium bifluoride and the relative concentrations of ammonium bifluoride and citric acid, the electrical resistance of the electrolyte solution can be beneficially controlled to achieve desired levels of micropolishing of the surface of a workpiece.

In the processes disclosed herein, the proximity of the workpiece (anode) to the cathode need not be precise, in contrast to conventional electropolishing or electrochemical machining. Successful processing has taken place with the cathode in the range of about 0.1 cm to about 15 cm from the workpiece. Practical limitations on the maximum distance between the cathode and the anodic workpiece are mostly commercially derived, including bath size, workpiece size, and electrical resistance of the electrolyte solution. Because the overall current densities are lower, and often far lower, than those required by electrochemical machining, it is possible to use greater workpiece-to-cathode distances and then simply increase the capacity of the power supply accordingly. Moreover, because the lower viscosity electrolyte solutions disclosed herein enable highly controlled bulk metal removal, surface finishing, and micropolishing, the same solutions are expected to also be effective in electrochemical machining.

Electropolishing of a metallic workpiece is performed by exposing the workpiece and at least one cathodic electrode to a bath of an electrolyte solution, and connecting the workpiece to an anodic electrode. The electrolyte solution includes an amount of carboxylic acid in the range of about 0.1% by weight to about 59% by weight. The electrolyte solution may also include about 0.1% by weight to about 25% by weight of a fluoride salt selected from alkali metal fluorides, alkali earth metal fluorides, silicate etching compounds and/or combinations thereof. Current is applied from a power source between the at least one anodic electrode connected to the workpiece and the cathodic electrode immersed in the bath to remove metal from the surface of the workpiece. The current is applied at a voltage in the range from about 0.6 millivolts direct current (mVDC) to about 100 volts direct current (VDC). Citric acid is a preferred carboxylic acid, although other carboxylic acids may be used, including but not limited to formic acid, acetic acid, propionic acid, butyric acid, valeric acid, caproic acid, enanthic acid, caprylic acid, pelargonic acid, capric acid, lauric acid, palmitic acid, and stearic acid. ABF is a preferred fluoride salt.

In another aspect of the electropolishing method, the current is applied at a voltage of about 0.6 VDC to about 150 VDC. The current may be applied at a current density of less than or equal to about 255,000 amperes per square meter ((A/m$^2$) (roughly 24,000 amperes per square foot), where the denominator represents the total effective surface area of the work piece. For some non-ferrous metals such as nickel base alloys, current densities up to and including about 5,000 A/m$^2$ (roughly 450 A/ft$^2$) may be used, and for titanium and titanium alloys, current densities of about 1 to about 1100 A/m$^2$ (roughly 0.1 to 100 A/ft$^2$) are preferred, The electropolishing processes using the electrolyte solution may be operated between the freezing and boiling points of the solution, for example at a temperature of about 2° C. to about 98° C., and preferably in the range of about 21° C. to about 85° C.

In practice, material may removed from the metallic substrate at a rate of about 0.0001 inches (0.00254 mm) to about 0.01 inches (0.254 mm) per minute. The following examples show the effectiveness of the electrolyte at varying concentrations and operating conditions.

EXAMPLE1

Etching Commercially Pure Titanium

In an electrolyte consisting essentially of approximately, by weight, 56% water, 43% citric acid (716 g/L), and 1% ammonium bifluoride (15.1 g/L), operated at 185° F. (85° C.), a commercially pure titanium plate sample was processed to improve the surface finish of the material (i.e., to make the mill-standard finish smoother). The material started at a surface finish of approximately 160 microinches and after processing, the surface finish was reduced by 90 microinches to a final reading of 50 microinches, or an improvement of about 69%. The process operated for a period of 30 minutes, resulting in a reduction in material thickness of 0.0178 inches.

Cold formability, a key characteristic of titanium plate product for many end use applications, is highly dependent on the surface finish of the product. Using embodiments of the electrochemical process disclosed herein, material surface finish improvements can be achieved at lower cost than conventional grinding and pickling methods. Finishes obtained using embodiments of the disclosed solutions and methods have been demonstrated to improve the cold forming characteristics of plate product to a higher degree than the conventional methods.

EXAMPLE 2

Etching 6Al-4V Coupon

The following examples were processed on 6Al-4V titanium alloy sheet stock coupons measuring 52 mm×76 mm. The electrolyte consisted of water ($H_2O$), citric acid (CA), and ammonium bifluoride (ABF) in varying concentrations and temperatures. The resulting observations and readings are recorded below in Table 1.

TABLE 1

| H2O (wt %) | CA (wt %) | ABF (wt %) | Temp (° F.) | Time (min) | Mat'l Loss (in.) |
|---|---|---|---|---|---|
| 77.90 | 21.45 | 0.65 | 178 | 1.0 | 0.00065 |
| 77.25 | 21.45 | 1.30 | 185 | 1.0 | 0.00085 |
| 75.95 | 21.45 | 2.60 | 189 | 1.0 | 0.00120 |
| 74.65 | 21.45 | 3.90 | 188 | 1.0 | 0.00120 |
| 56.45 | 42.90 | 0.65 | 184 | 1.0 | 0.00005 |
| 55.80 | 42.90 | 1.30 | 195 | 1.0 | 0.00030 |
| 54.50 | 42.90 | 2.60 | 193 | 1.0 | 0.00005 |
| 53.20 | 42.90 | 3.90 | 188 | 1.0 | 0.00035 |
| 53.20 | 42.90 | 3.90 | 191 | 5.0 | 0.00140 |

TABLE 1-continued

| H2O (wt %) | CA (wt %) | ABF (wt %) | Temp (° F.) | Time (min) | Mat'l Loss (in.) |
|---|---|---|---|---|---|
| 75.95 | 21.45 | 2.60 | 190 | 3.0 | 0.00205 |
| 88.95 | 10.725 | 0.325 | 180 | 1.0 | 0.00020 |
| 88.625 | 10.725 | 0.650 | 180 | 1.0 | 0.00020 |
| 87.975 | 10.725 | 1.30 | 182 | 1.0 | 0.00060 |
| 99.25 | 0.100 | 0.65 | 188 | 1.0 | 0.00010 |
| 98.60 | 0.100 | 1.30 | 182 | 1.0 | 0.00065 |
| 97.30 | 0.100 | 2.60 | 195 | 1.0 | 0.00095 |

EXAMPLE 3

Electropolishing 6Al-4V Coupon

The following examples were processed on 6Al-4V titanium alloy sheet stock coupons measuring 52 mm×76 mm. The electrolyte consisted of water ($H_2O$), citric acid (CA), and ammonium bifluoride (ABF) in varying concentrations and temperatures. The resulting observations and readings are recorded below in Table 2.

TABLE 2

| H2O (wt %) | CA (wt %) | ABF (wt %) | Temp (° F.) | Time (min) | Power (V/Amp) | Mat'l Loss (in.) |
|---|---|---|---|---|---|---|
| 77.90 | 21.45 | 0.65 | 190 | 1.0 | (50/7) | 0.00025 |
| 77.25 | 21.45 | 1.30 | 195 | 1.0 | (50/8) | 0.00070 |
| 75.95 | 21.45 | 2.60 | 191 | 1.0 | (50/10) | 0.00130 |
| 74.65 | 21.45 | 3.90 | 190 | 1.0 | (50/12) | 0.00130 |
| 74.65 | 21.45 | 3.90 | 188 | 1.0 | (20/6) | Not recorded |
| 74.65 | 21.45 | 3.90 | 184 | 1.0 | (6/2) | Not recorded |
| 74.65 | 21.45 | 3.90 | 180 | 1.0 | (12/3) | Not recorded |
| 56.45 | 42.90 | 0.65 | 182 | 1.0 | (50/3) | 0.00010 |
| 55.80 | 42.90 | 1.30 | 200 | 1.0 | (50/5) | 0.00045 |
| 54.50 | 42.90 | 2.60 | 189 | 1.0 | (50/8) | 0.00055 |
| 53.20 | 42.90 | 3.90 | 190 | 1.0 | (50/12) | 0.00045 |
| 53.20 | 42.90 | 3.90 | 203 | 5.0 | (50/5) | 0.00115 |
| 75.95 | 21.45 | 2.60 | 172 | 3.0 | (12/3) | 0.00015 |
| 88.95 | 10.725 | 0.325 | 180 | 1.0 | 50 V | 0.00000 |
| 88.625 | 10.725 | 0.650 | 180 | 1.0 | 50 V | 0.00010 |
| 87.975 | 10.725 | 1.30 | 184 | 1.0 | 50 V | 0.00060 |
| 99.25 | 0.100 | 0.65 | 190 | 1.0 | 50 V | 0.00060 |
| 98.60 | 0.100 | 1.30 | 184 | 1.0 | (50/19) | 0.00145 |
| 97.30 | 0.100 | 2.60 | 190 | 1.0 | (50/38) | 0.00360 |

Further extensive testing has been conducted using aqueous electrolyte solutions containing citric acid in the range of about 0 g/L to about 780 g/L (about 0% to about 47% by weight) and ammonium bifluoride in the range of about 0 g/L to about 120 g/L (about 0% to about 8% by weight), and being substantially free of a strong acid (i.e., having less than about 1 g/L or less than 0.1% by weight), at bath temperatures in the range of about 21° C. to about 85° C., and with applied current densities in the range of about 0 A/m$^2$ to about 1076 A/m$^2$ of workpiece surface area. (Note that 780 g/L of citric acid in water is a saturation concentration at 21° C.) Current densities as high as at least 225,000 A/m$^2$ can be used at applied voltages of 150 volts or more. Metals tested included commercially pure titanium as well as some spot testing on 6Al-4V titanium and nickel base alloy 718. Based on these results, it is expected that similar electropolishing, micropolishing, and surface treatment results can be obtained across the class of non-ferrous metals and alloys. The results are summarized in the following tables and description, and with reference to the figures. Unless otherwise specified, tests were conducted at temperatures of about 21° C., about 54° C., about 71° C., and about 85° C., and at current densities of about 0 A/m$^2$, about 10.8 A/m$^2$, about 52.8 A/m$^2$, about 215 A/m$^2$, about 538 A/m$^2$, and about 1076 A/m$^2$. No amount of a strong acid was intentionally added to any of the tested solutions, although trace amounts would likely not impact the results significantly.

Figure 1B:
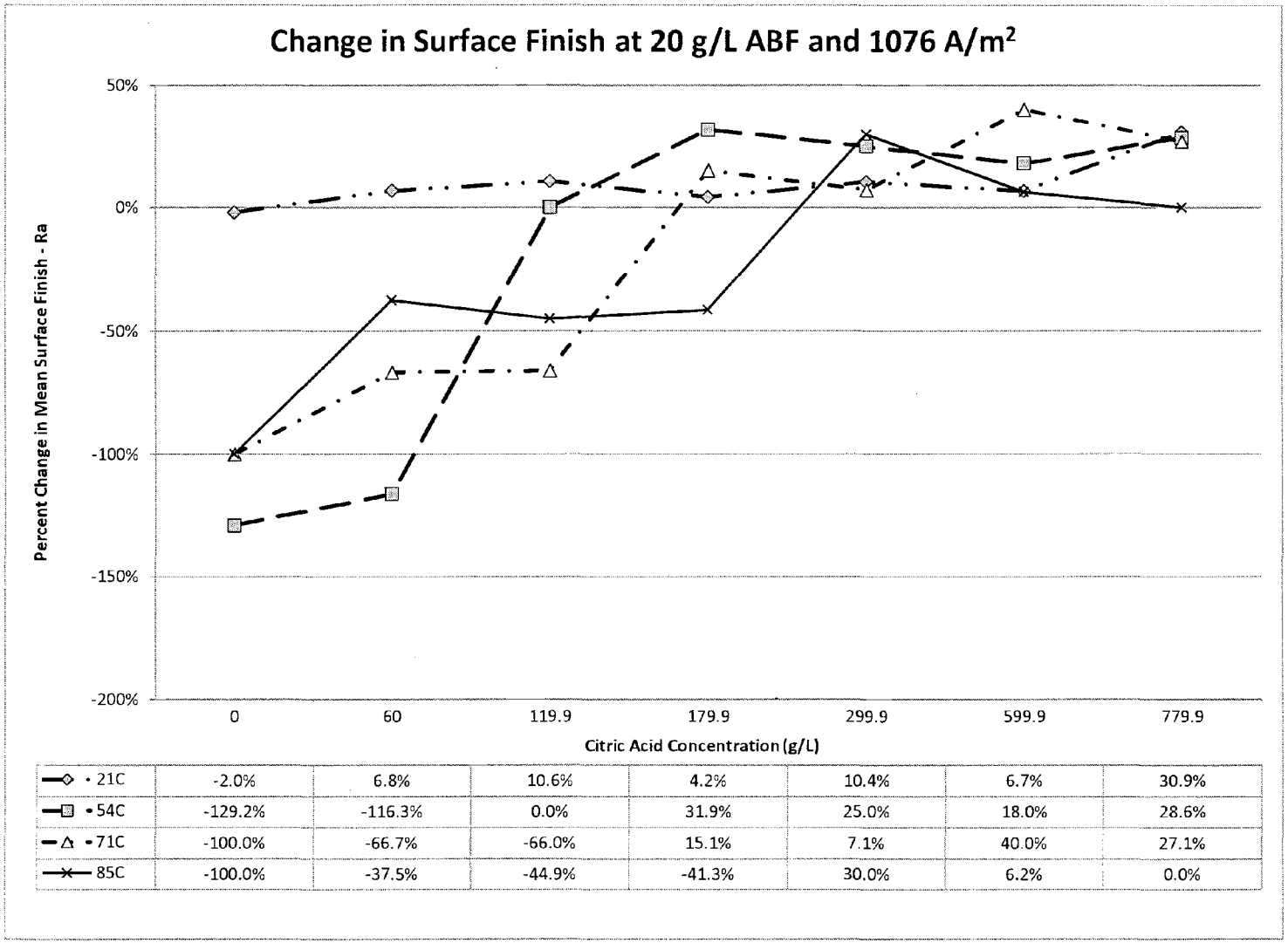

FIGS. 1A-1B show the material removal rate and change in surface finish, respectively, at four different temperatures using an aqueous electrolyte solution including a moderately low concentration of ammonium bifluoride of 20 g/L and concentrations of citric acid from about 0 g/L to about 780 g/L and a current density of 1076 A/m$^2$. FIG. 1A shows that material removal rate varies directly with temperature, particularly at lower concentrations of citric acid. As the bath temperature increases, so does the removal rate. At lower temperatures of 21° C., 54° C., and 71° C., 180 g/L of citric acid is sufficient to begin to moderate the material removal effectiveness of the ammonium bifluoride, while at a higher temperature of 85° C., relatively rapid material removal continues up to about 300 g/L of citric acid. At higher citric acid concentrations of 300 g/L and greater, removal rates at all temperatures are curtailed. Conversely, FIG. 1B shows that at lower citric acid concentrations, particularly at or below 120 g/L to 180 g/L, the surface finish is degraded at all but the lowest temperature. In other words, the fluoride ion that is responsible for significant material removal at lower citric acid concentrations also creates surface damage, but the presence of citric acid in sufficient concentrations appears to act as a beneficial barrier to fluoride ion attack. However, as the citric, acid concentration is increased to and above 180 g/L, the surface finish actually improves, particularly at citric acid levels of 600 g/L and greater where the rate of material removal is significantly reduced. Moreover, even at citric acid levels between about 120 g/L and 600 g/L where material removal still occurs, improvements in surface finish can be achieved simultaneously.

Testing revealed that to achieve the desired material removal and surface finish improvements, a source of fluoride ions, such as ammonium bifluoride, is necessary. In electrolyte solutions consisting essentially of citric acid alone in water, substantially in the absence of ammonium bifluoride, practically no material removal is obtained, regardless the temperature of the bath or the current density, and changes in surface finish are also minimal. It is believed that when titanium or another reactive metal is processed in an aqueous electrolyte including only citric acid, the surface of the material is essentially being anodize with an oxide layer that is very thin (i.e., about 200 nm to about 600 nm thick) and forms quickly. After the anodic oxide layer forms, because the applied DC power can no longer attack the material surface, it hydrolyzes the water. The resulting nascent oxygen that is formed quickly finds another mono-atomic oxygen and is given off at the anode as $O_2$ gas.

Figure 2A:
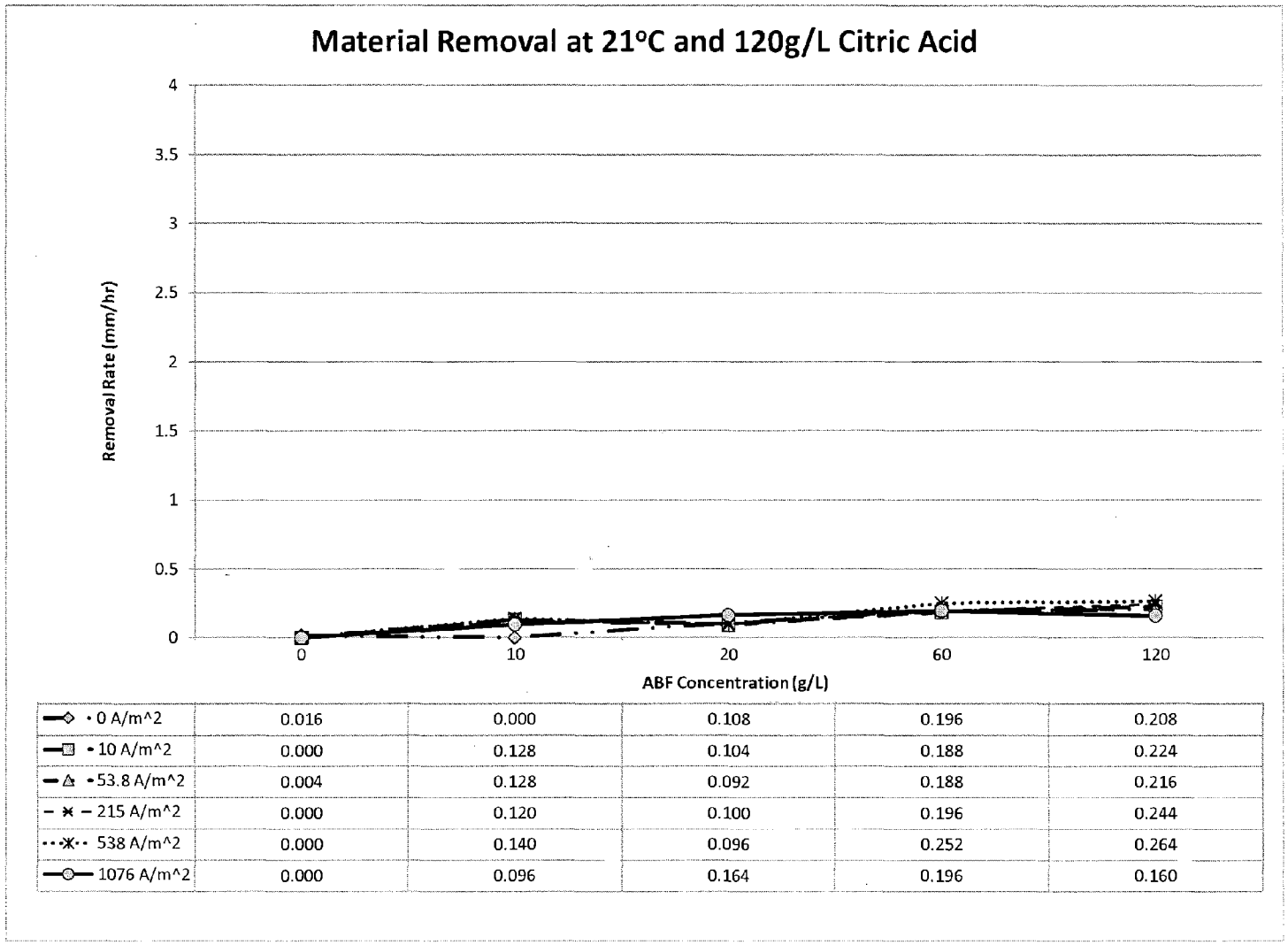
FIGS. 2A-2B are graphs of data showing the rate of material removal as a function of ammonium bifluoride concentration in an aqueous electrolyte solution including 120 g/L citric acid at representative low and high temperatures, respectively, over a range of current densities.
Figure 2B:
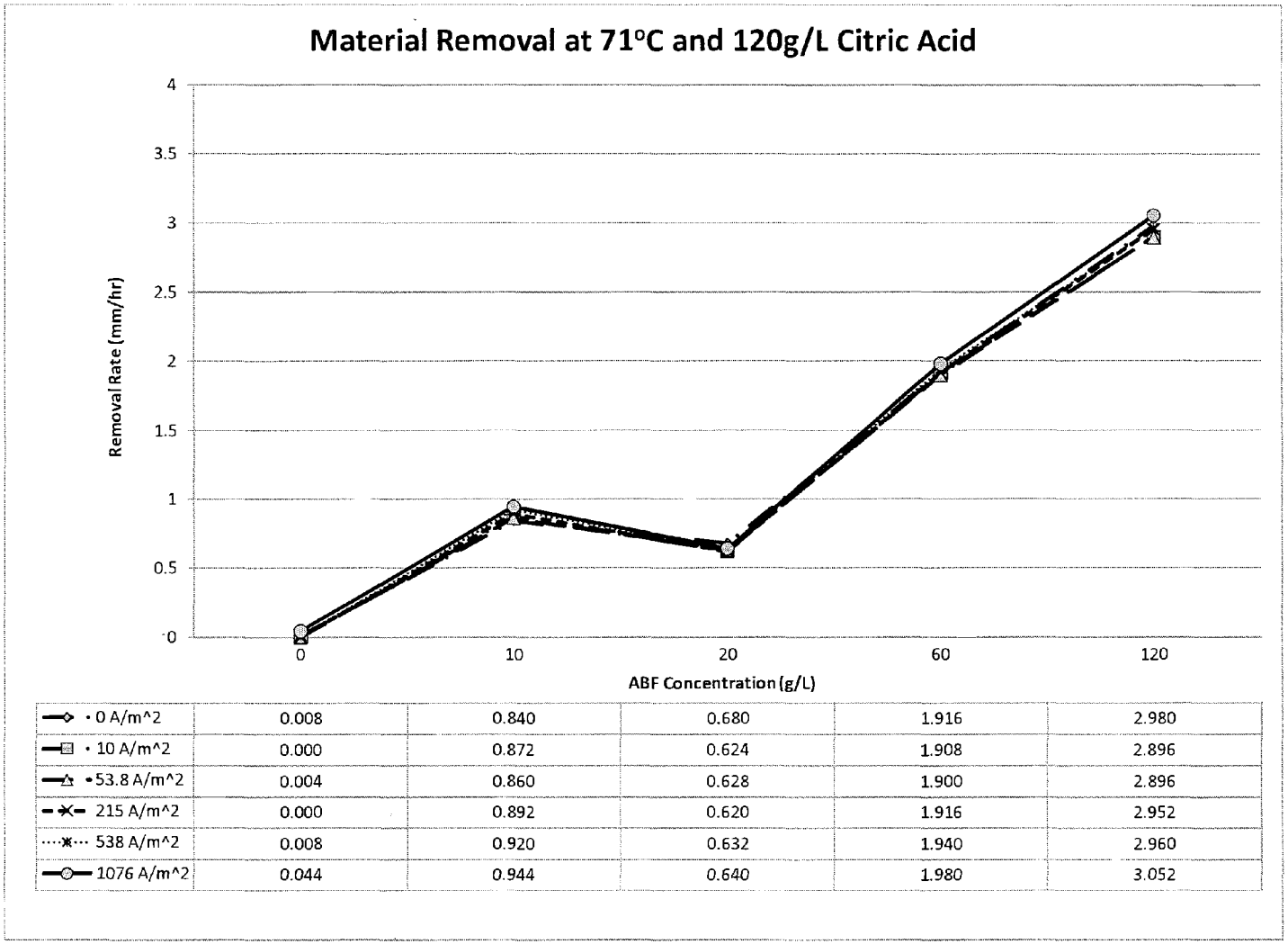
Figure 2C:
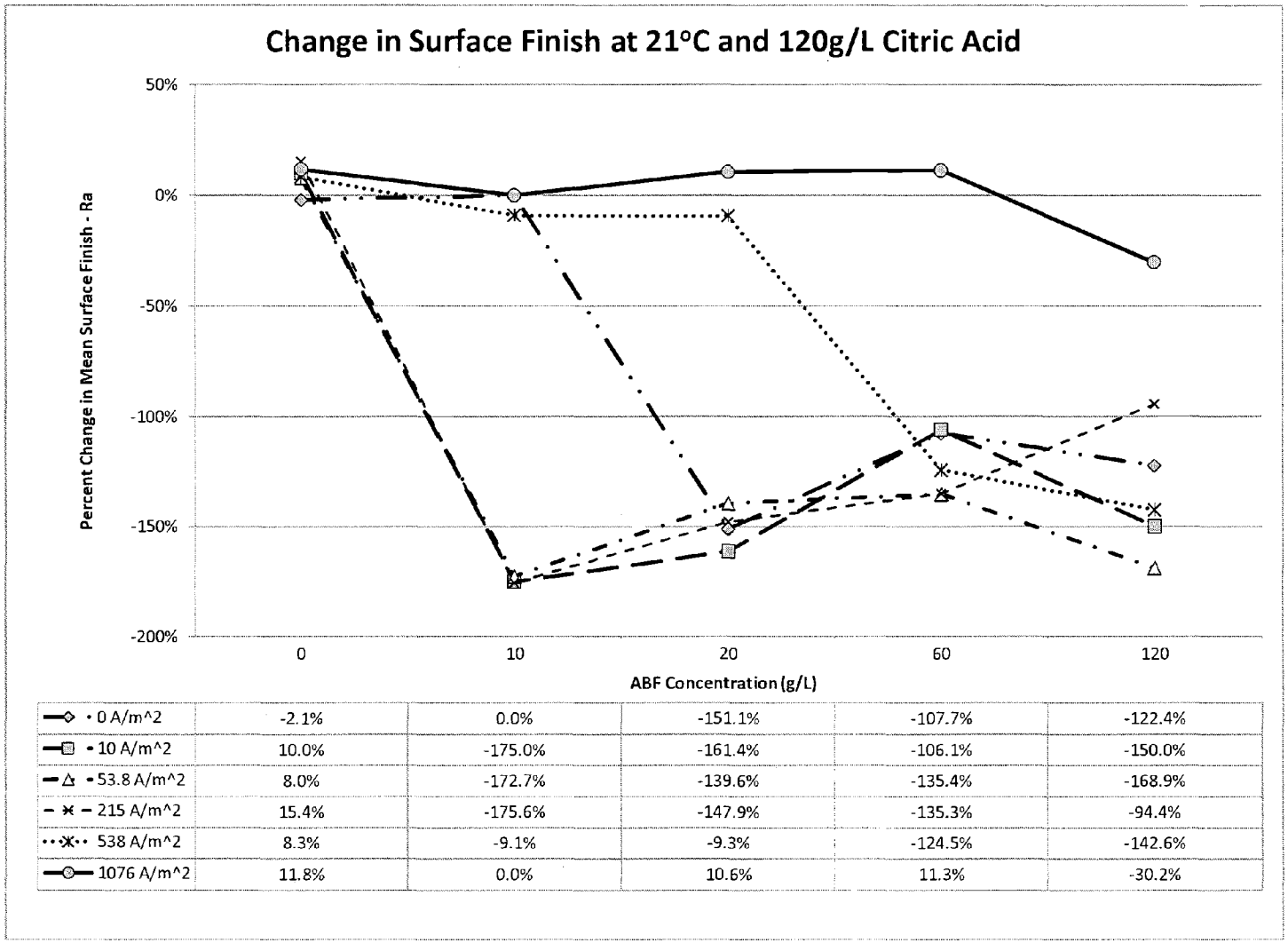
FIGS. 2C-2D are graphs of data showing the change in surface finish as a function of ammonium bifluoride under conditions corresponding to FIG. 2A-2B, respectively.
Figure 2D:
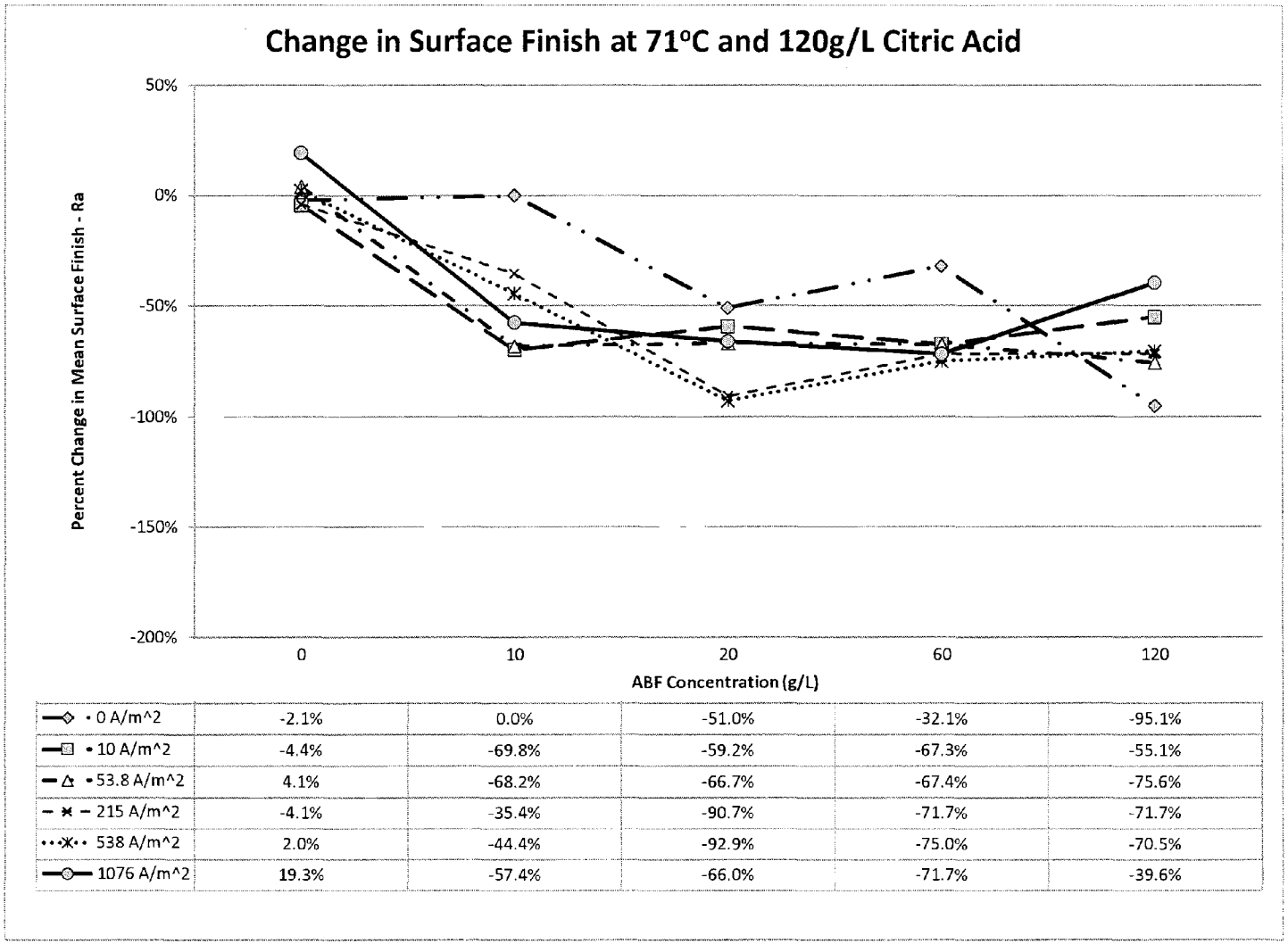

FIGS. 2A-2B and 2C-2D show the rate of material removal and the change in surface finish, respectively, using an aqueous electrolyte solution including a concentration of citric acid of 120 g/L and concentrations from about 0 g/L to about 120 g/L ammonium bifluoride. FIGS. 2A and 2C show data at a representative low temperature of 21° C. and FIGS. 2B and 2C show data at a representative high temperature of 71° C. FIGS. 2A-2B show that material removal is strongly correlated to ammonium bifluoride concentration and temperature, but is minimally impacted by current density. Higher rates of material are generally obtained by increasing one or both of the ammonium bifluoride concentration and the temperature. FIGS. 2C-2D show that material removal comes along with some surface degradation. Surprisingly, however, as the temperature increases and the rate of material removal increases, the amount of surface finish degradation is reduced. At a low temperature of 21° C., as in FIG. 2C, increasing current density mitigates the surface degradation effects, and at the highest current density some surface finish improvement is evidenced. At a higher temperature of 71° C., as in FIG. 2D, the change in surface finish does not vary significantly with changes in current density.

Figure 2E:
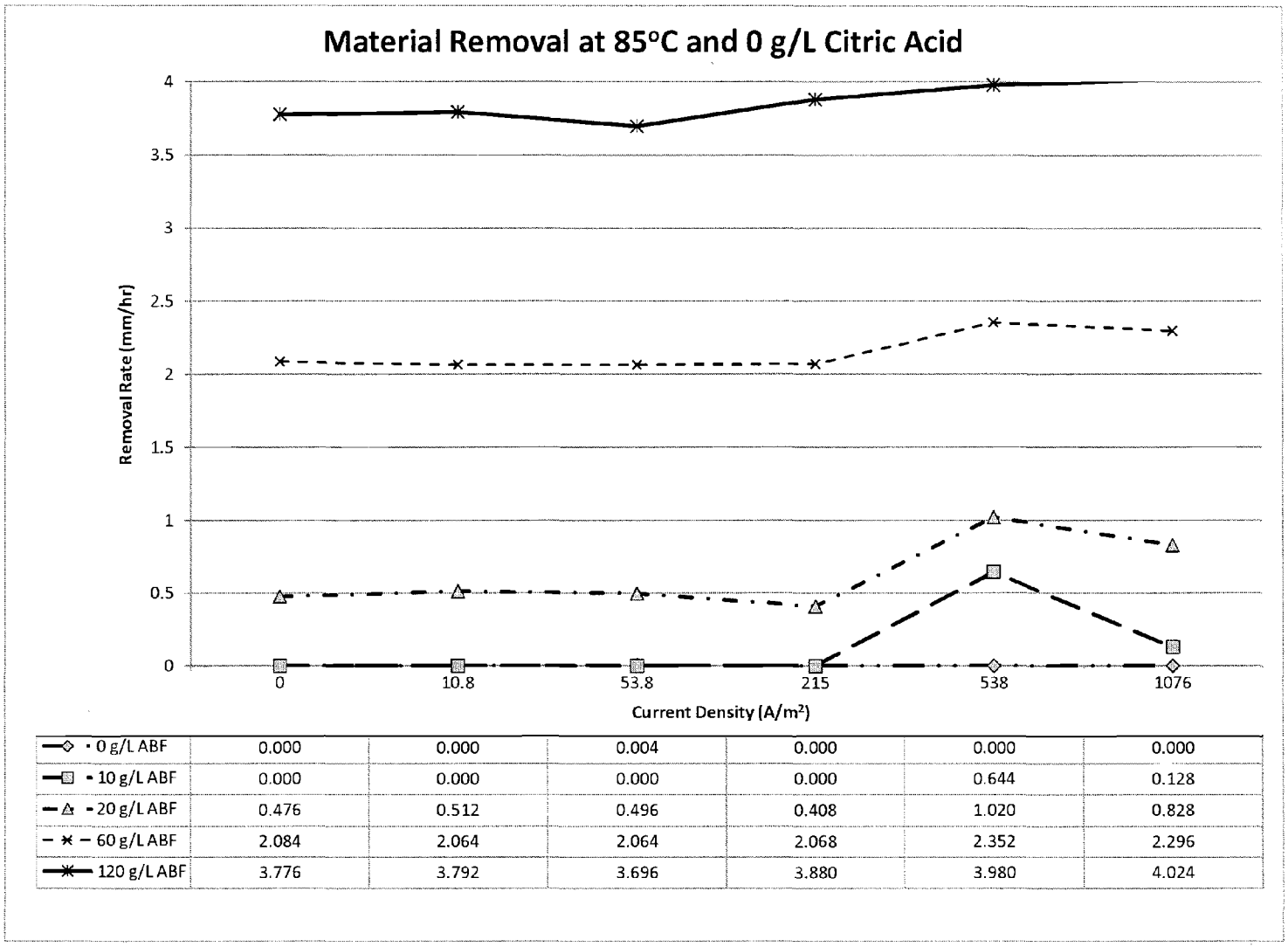
FIGS. 2E-2F are graphs of data showing the rate of material removal and the change in surface finish, respectively, as a function of current density in an aqueous electrolyte solution substantially without citric acid at a temperature of 85° C.
Figure 2F:
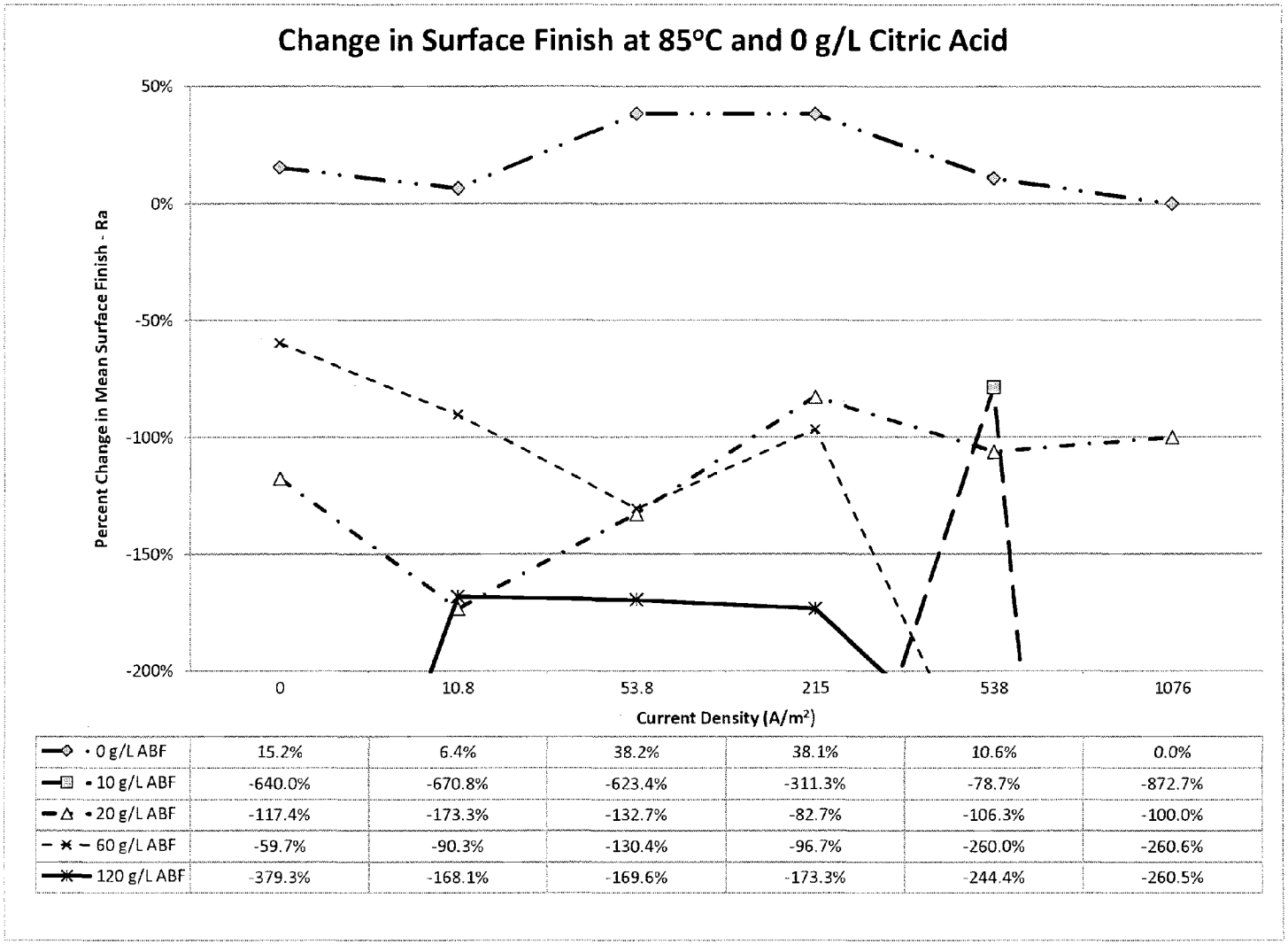
Figure 3A:
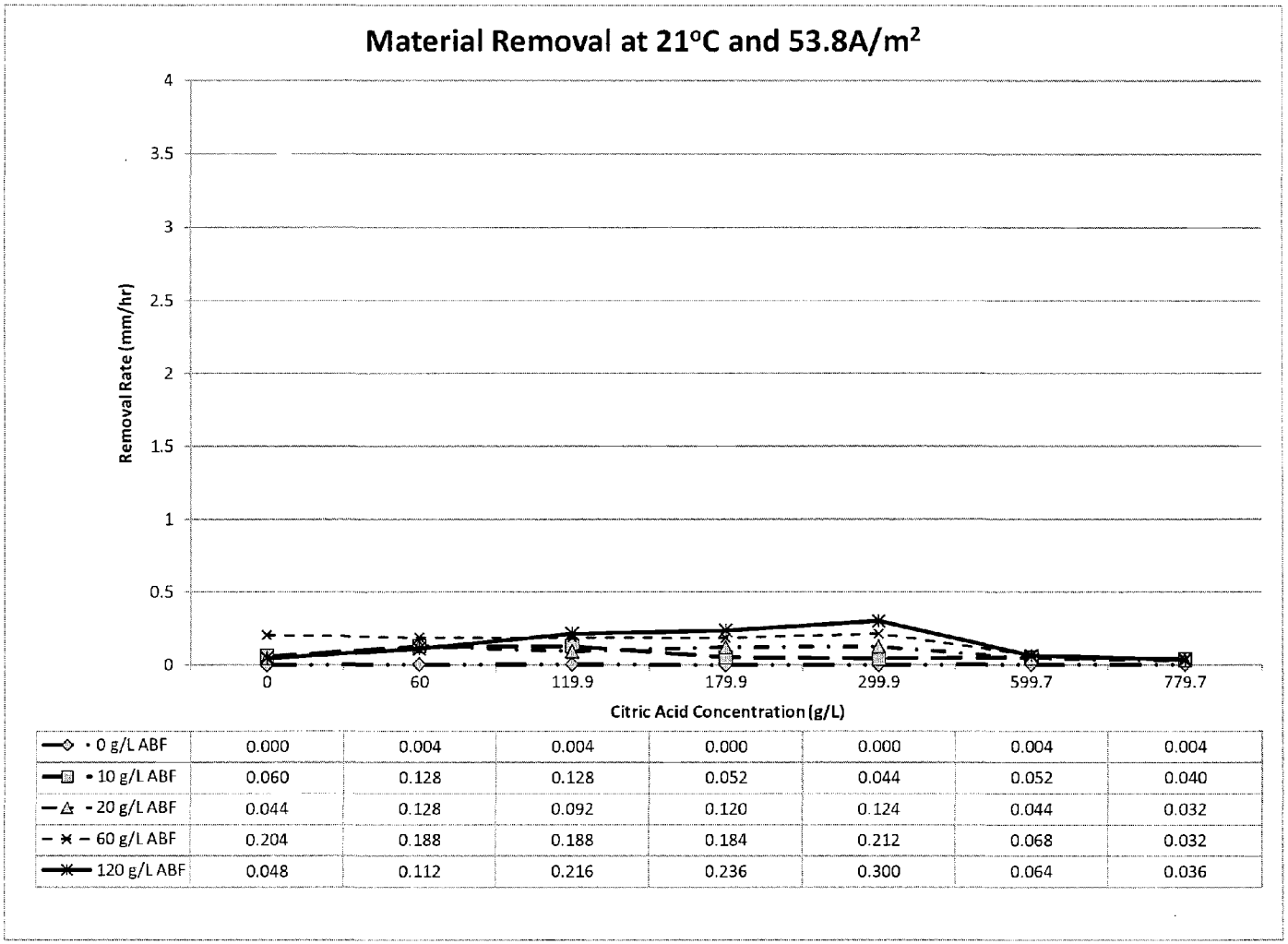
FIGS. 3A-3D are graphs of data showing the rate of material removal as a function of citric acid concentration in an aqueous electrolyte solution for several concentrations of ammonium bifluoride at a current density of 53.8 A/m$^2$ and temperatures of 21° C., 54° C., 71° C., and 85° C., respectively.
Figure 3B:
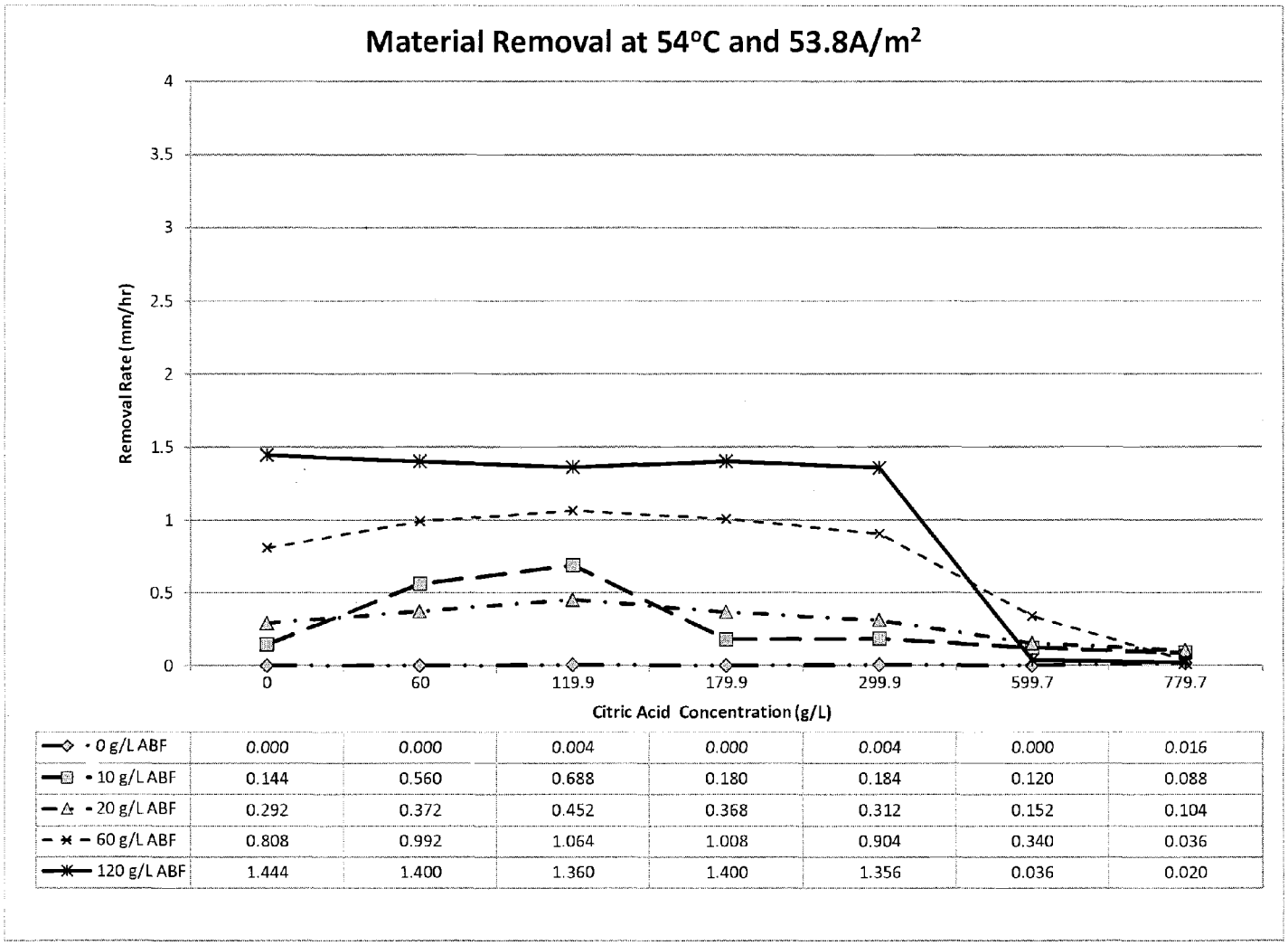
Figure 3C:
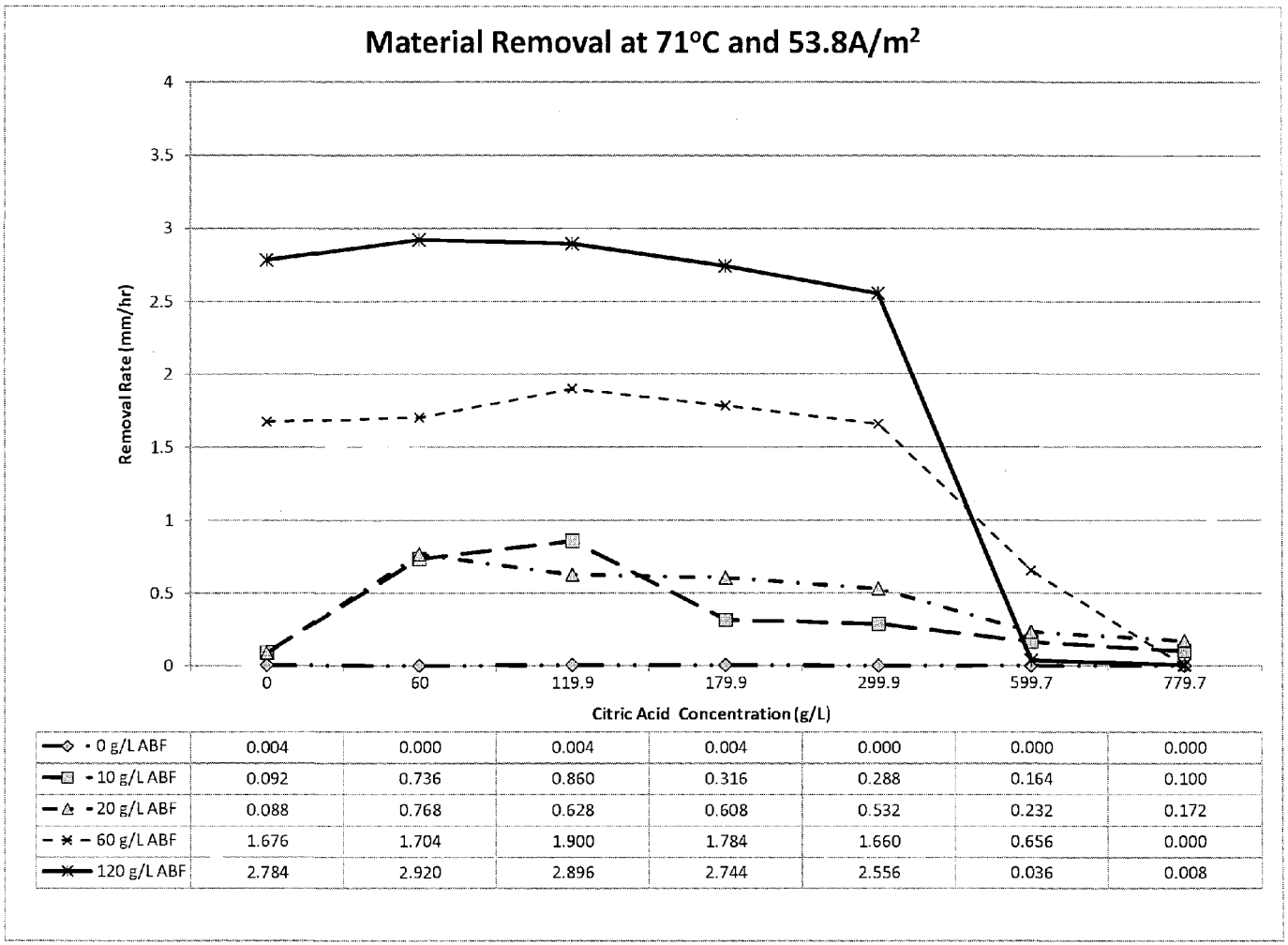
Figure 3D:
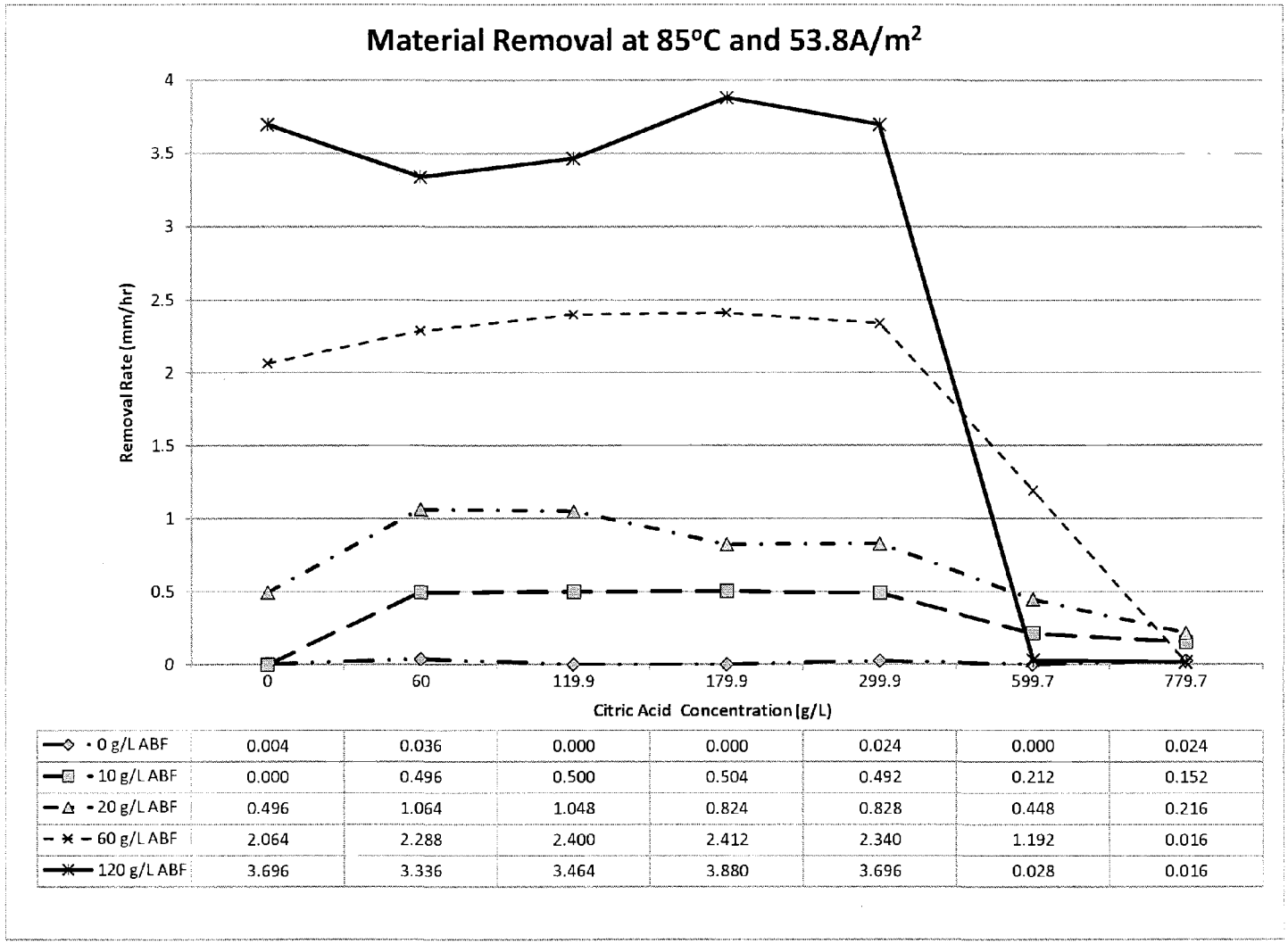

FIGS. 2E-2F show that the rate of material removal and the change in surface finish, respectively, using an aqueous electrolyte solution consisting essentially of ammonium bifluoride in water, with no intentionally added citric acid, as a function of current density when operated at a high temperature of 85° C. High rates of material removal can be achieved with an ABF-only electrolyte, but this material removal comes at the expense of surface finish, which is often moderate to significantly degraded by the electrolyte solution. Nevertheless, at certain operating conditions (not shown in the figures), minimal degradation or modest improvement in surface finish was achieved. For example, improvements in surface finish from ABF-only electrolyte solutions were achieved with a 10 g/L ABF solution at 21° C. and 215-538 $A/m^2$ and at 54-71° C. and 1076 $A/m^2$, with a 20 g/L ABF solution at 21° C. and 215-1076 $A/m^2$, and with a 60 g/L ABF solution at 21° C. and 538-1076 $A/m^2$.

Without being bound by theory, a possible explanation for the ability of increased current density to improve surface finish, while minimally impacting material removal rates, is that one function of the electric current is to grow the natural oxide layer at the surface of the material. This excess oxygen, in combination with the citric acid, is believed to act as a beneficial barrier to attack of the material surface. Accordingly, as current densities increase, it is believed that higher concentrations of oxygen are produced at the anode, which, in turn, may act as a mass transfer barrier. Alternatively, simplistically viewing the surface morphology of the material as a series of "peaks" and "valleys," it is postulated that the citric and oxygen sit down in the valleys, exposing only the peaks of the surface morphology to the fluoride ion. As the citric and oxygen barriers increase in strength (i.e., higher citric acid concentrations and higher current densities), only the highest peaks of the surface are available for chemical attack. Under this theory, low current densities and low citric acid concentrations would be expected to provide the least capable process for surface smoothing, while high current densities and high citric acid concentrations would be expected to provide the most capable process for surface smoothing. Whether or not these theories are accurate, the data appears to bear out results consistent with the above analysis.

Understanding that oxygen (produce by electric current) and citric acid appear to be act as micro-barriers to the removal process helps make clear that ABF concentration and temperature are the variables likely to be most amenable to use for controlling material removal and micropolishing results. Therefore, in the processes described herein, current density appears to act primarily to create oxygen, for the most part is not a significant agent to increase overall material removal. Rather, material removal appears to be either nearly exclusively driven by the fluoride ion, the activity of which is governed to some extent by the thermodynamic impact of temperature. In sum, current density as a control variable appears to be, surprisingly, of relatively minor importance that presence of the fluoride ion overwhelms the impact of current density.

FIGS. 3A-3D depict, at a representative current density of 53.8 $A/m^2$, that the rate of material removal can be varied in direct relationship to temperature, so that for the same mixture of citric acid, ammonium bifluoride, and water, greater material removal occurs at higher temperatures. Similar trends were observed at all current densities from 0 $A/m^2$ to 1076 $A/m^2$.

FIGS. 4A-4D depict, at a representative temperature of 54° C., that the rate of material removal is relatively constant with current density, so that for the same mixture of citric acid and ammonium bifluoride at any given bath temperature, the rate of material removal is relatively insensitive to changes in current density. Similar trends were observed at all temperatures from 21° C. to 85° C., and it is believed that those trends hold below 21° C. (but above the freezing point of the solution) and above 81° C. (but below the boiling point of the solution). As occurs at nearly all temperature and current conditions, regardless the ABF concentration, when the citric acid concentration rises above a certain level, typically between 600 g/L and 780 g/L, the rate of material removal is significantly curtailed. Therefore, to maintain the ability to achieve some level of material removal, when shaping a workpiece is desired, the citric acid concentration should generally be maintained at less than 600 g/L.

Figure 4A:
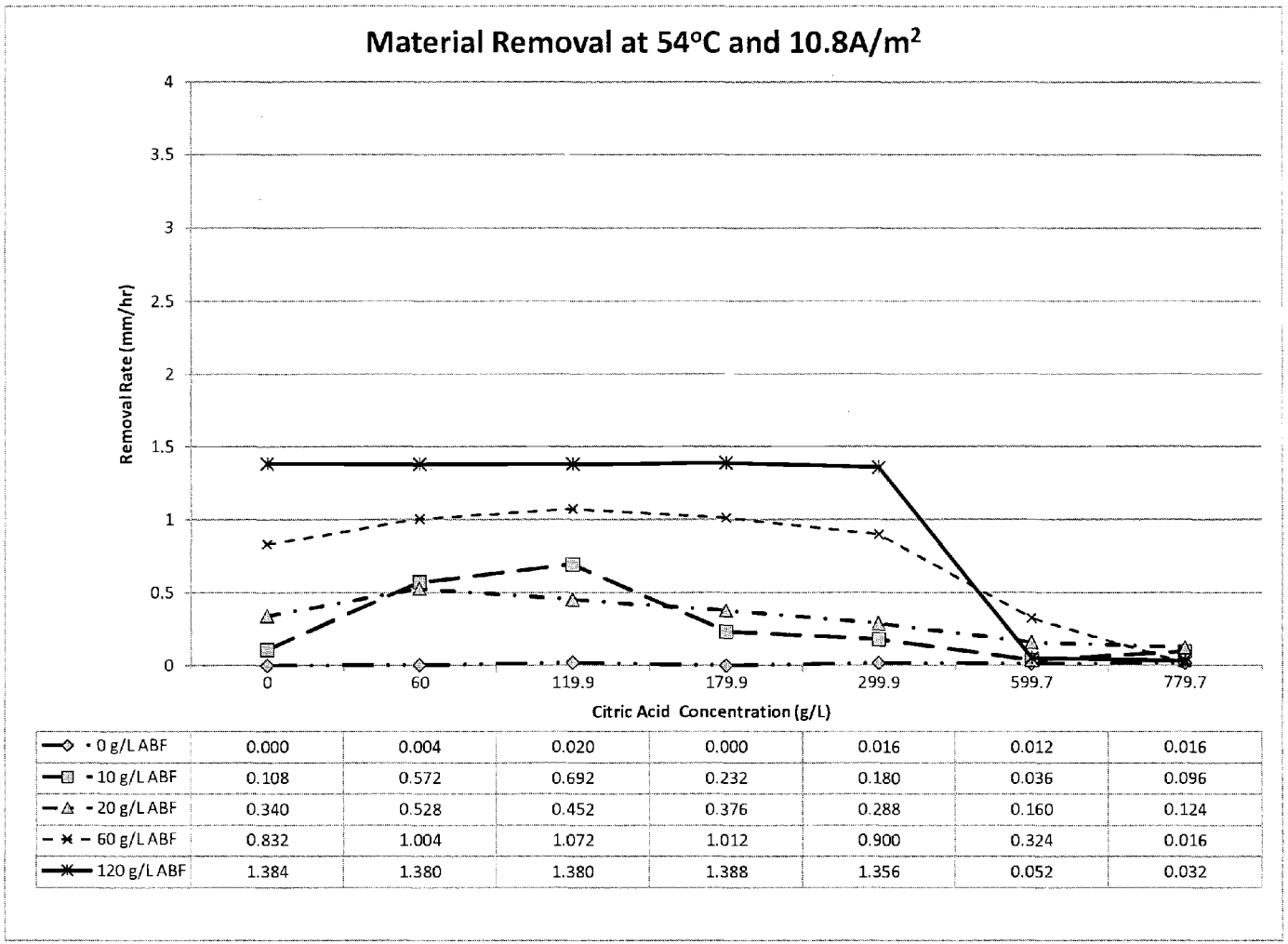
FIGS. 4A-4D are graphs of data showing the rate of material removal as a function of citric acid concentration in an aqueous electrolyte solution for several concentrations of ammonium bifluoride at a temperature of 54° C. and current densities of 10.8 A/m$^2$, 215 A/m$^2$, 538 A/m$^2$, and 1076 A/m$^2$, respectively.
Figure 4B:
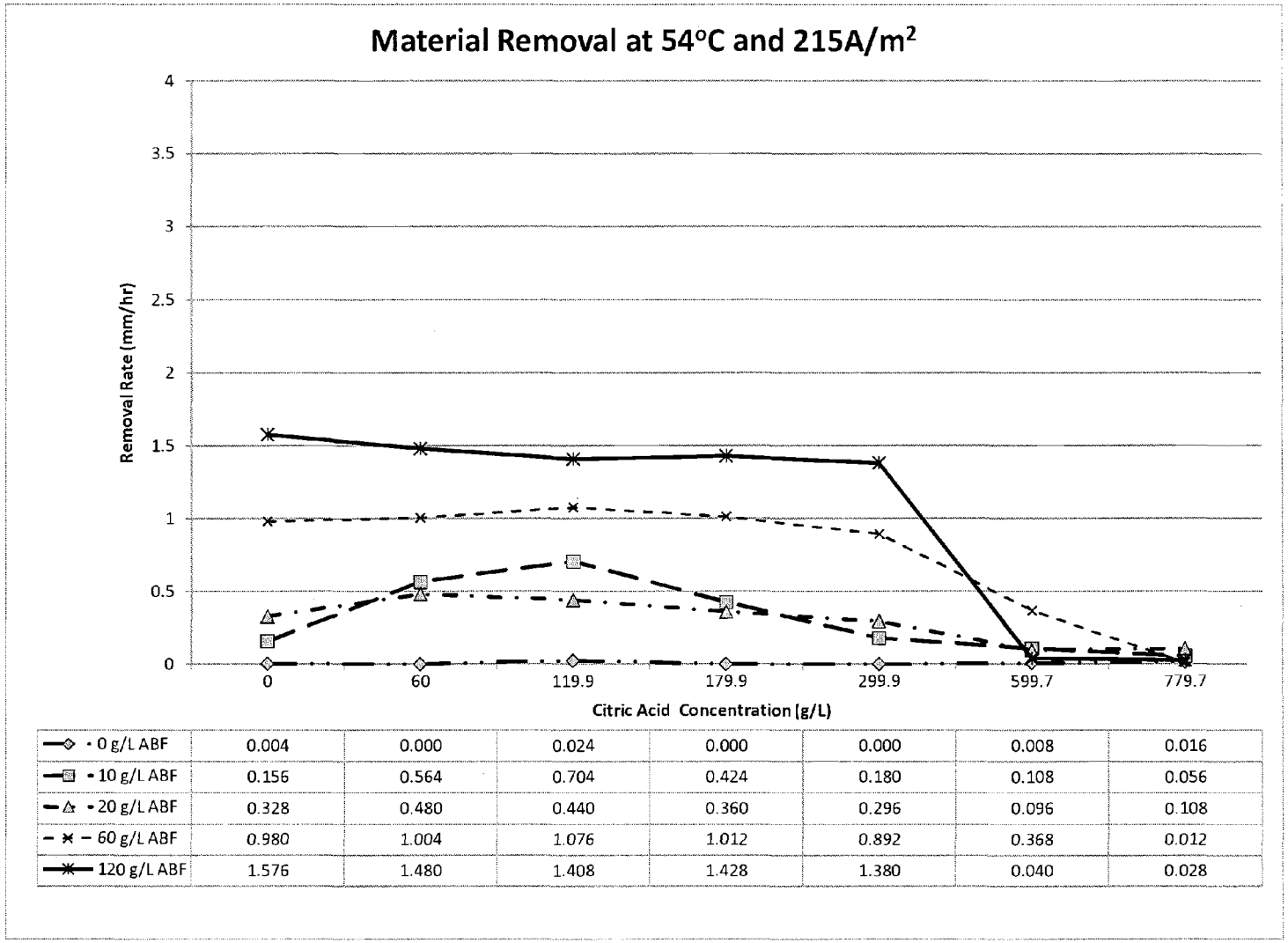
Figure 4C:
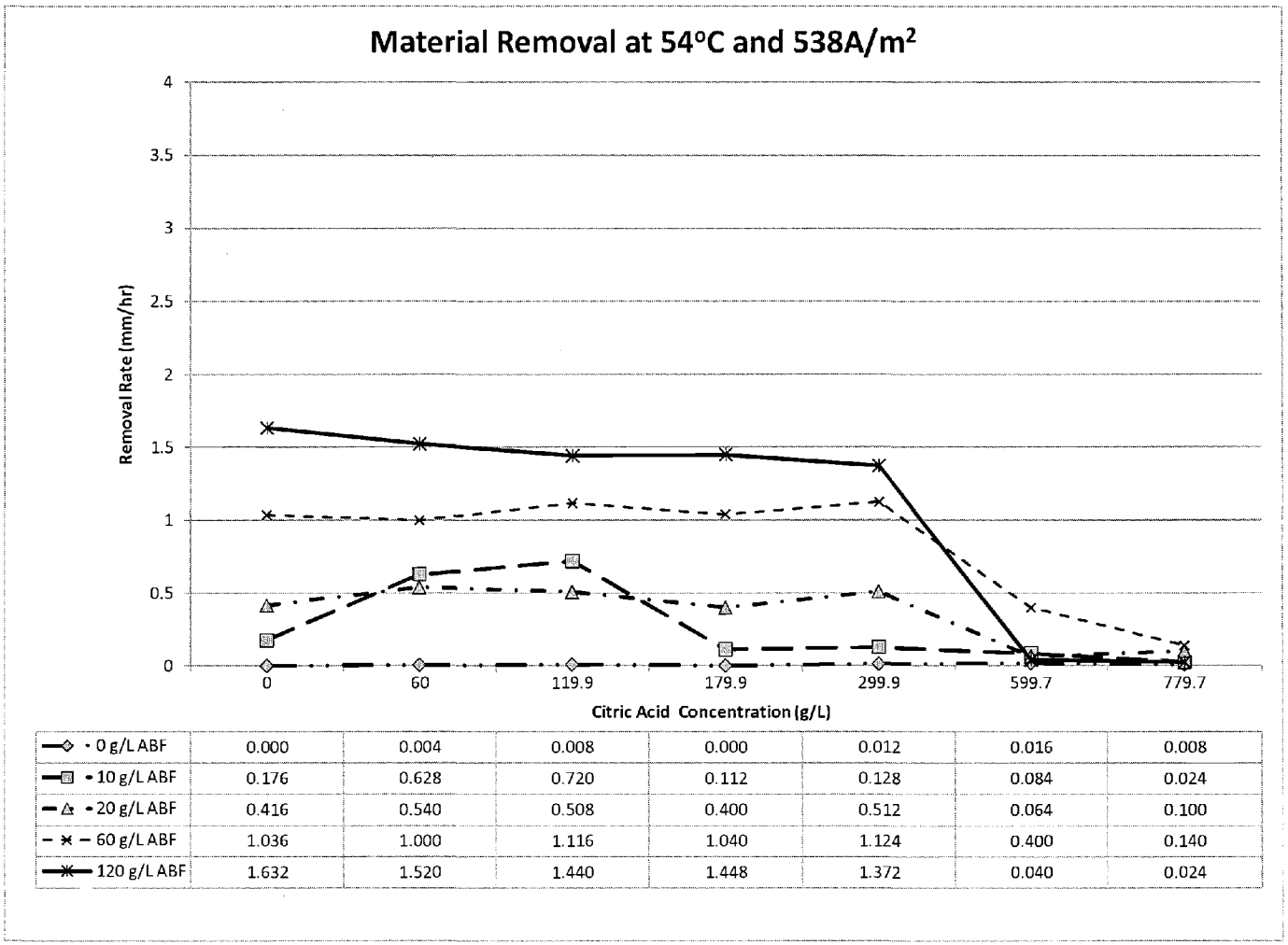
Figure 4D:
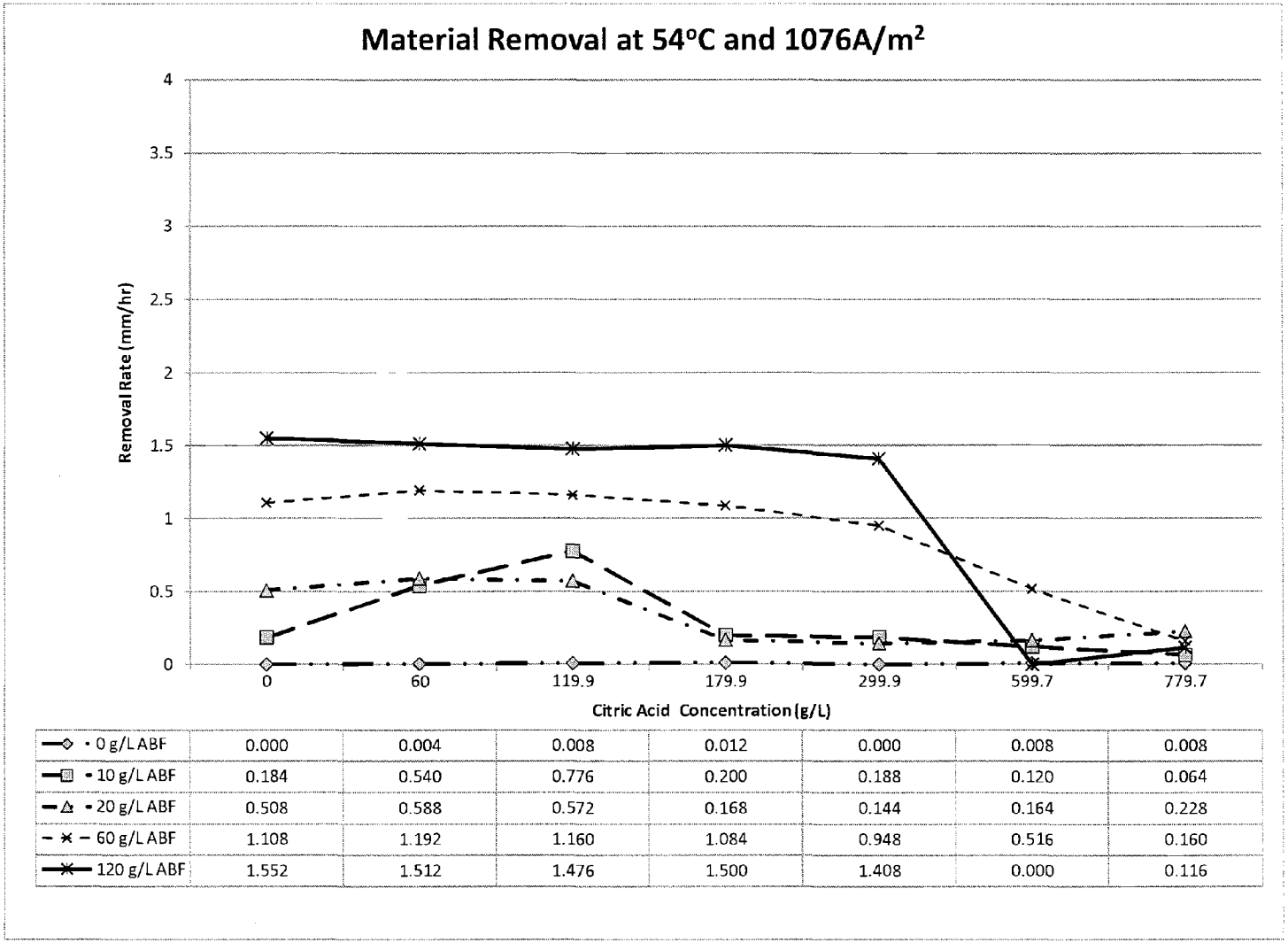
Figure 4E:
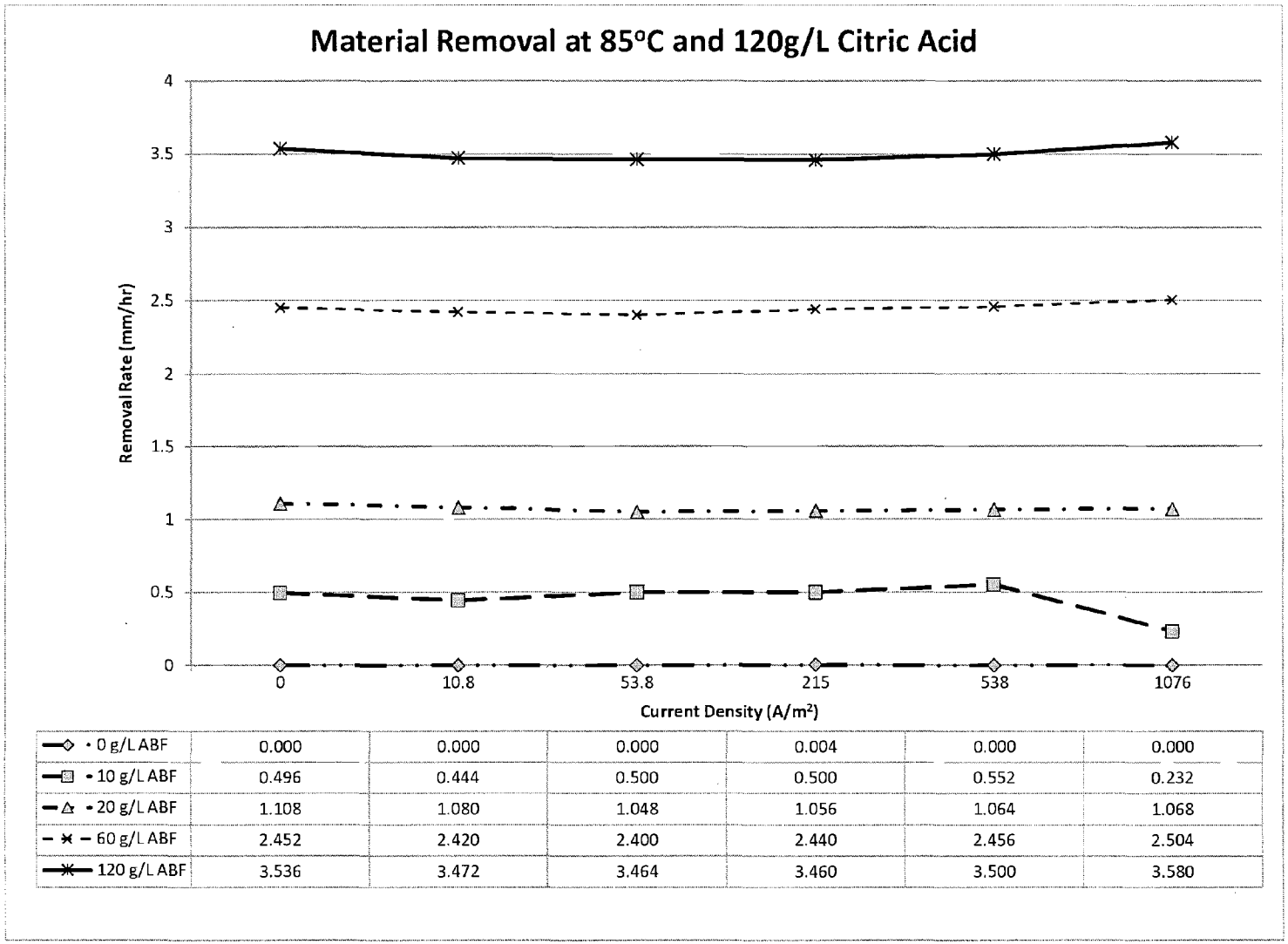
FIGS. 4E-4G are graphs of data showing the rate of material removal as a function of current density at a temperature of 85° C. in an aqueous solution having 120 g/L, 600 g/L, and 780 g/L of citric acid, respectively, for several concentrations of ammonium bifluoride.
Figure 4F:
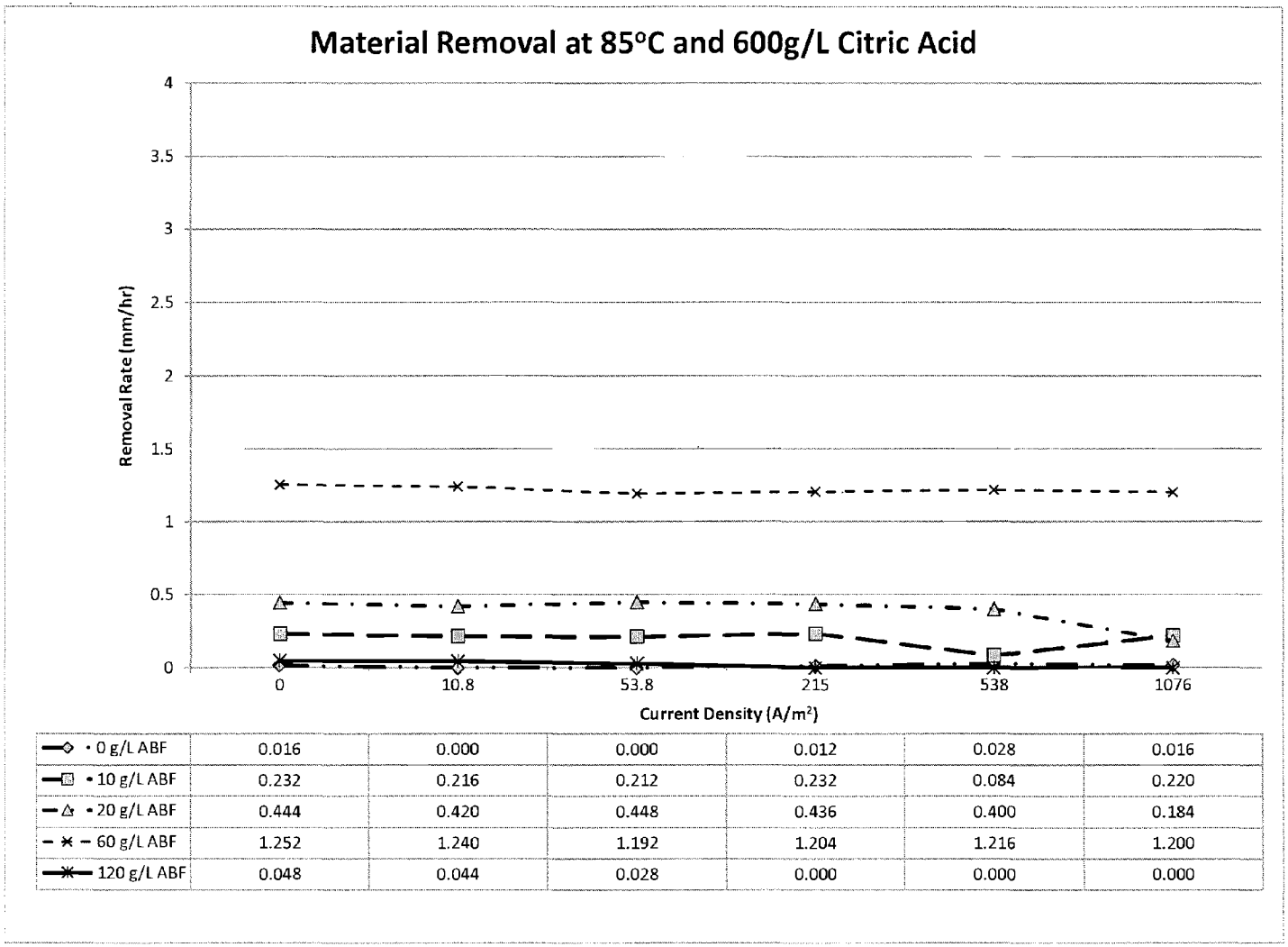
Figure 4G:
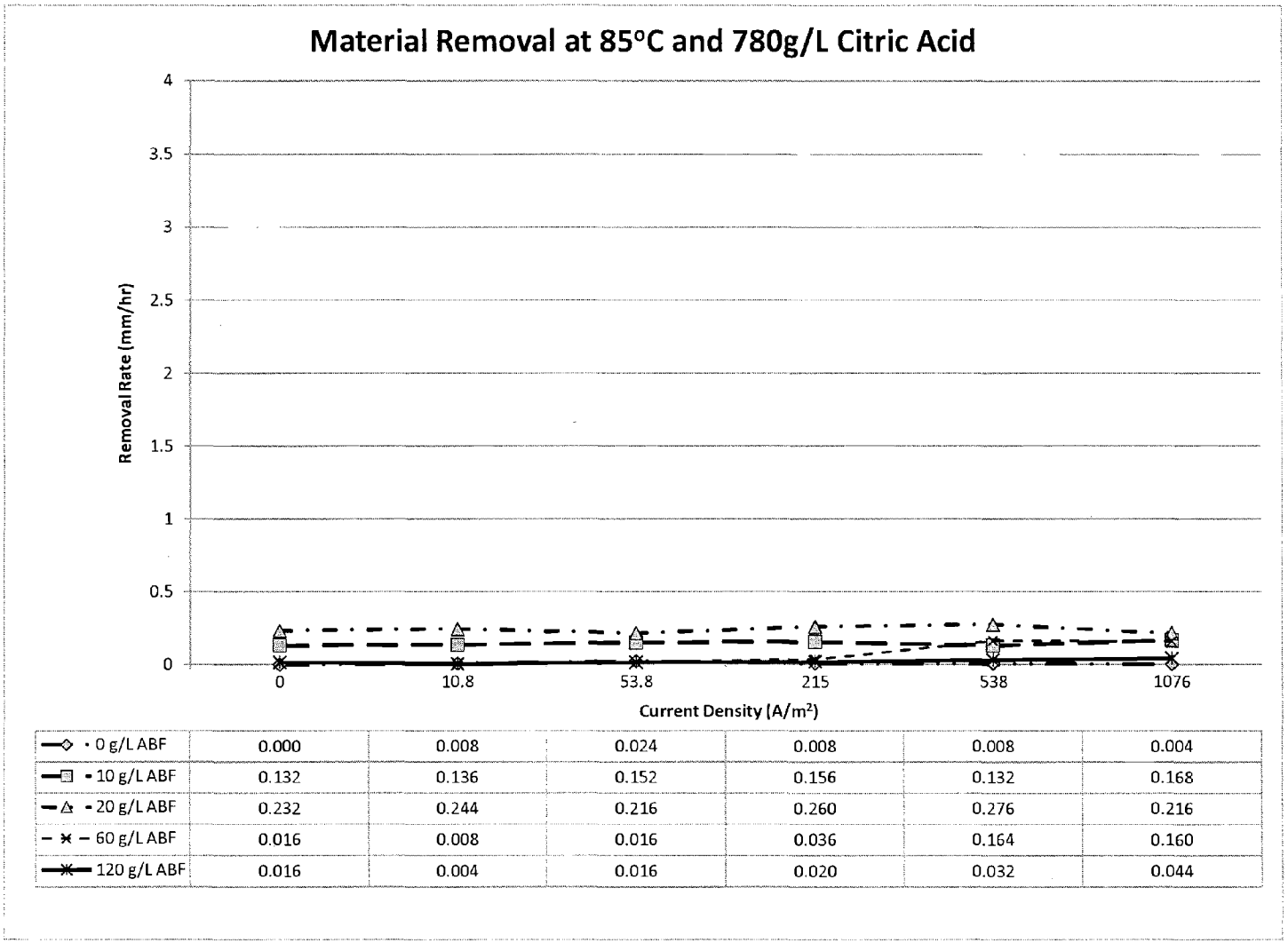
Figure 4H:
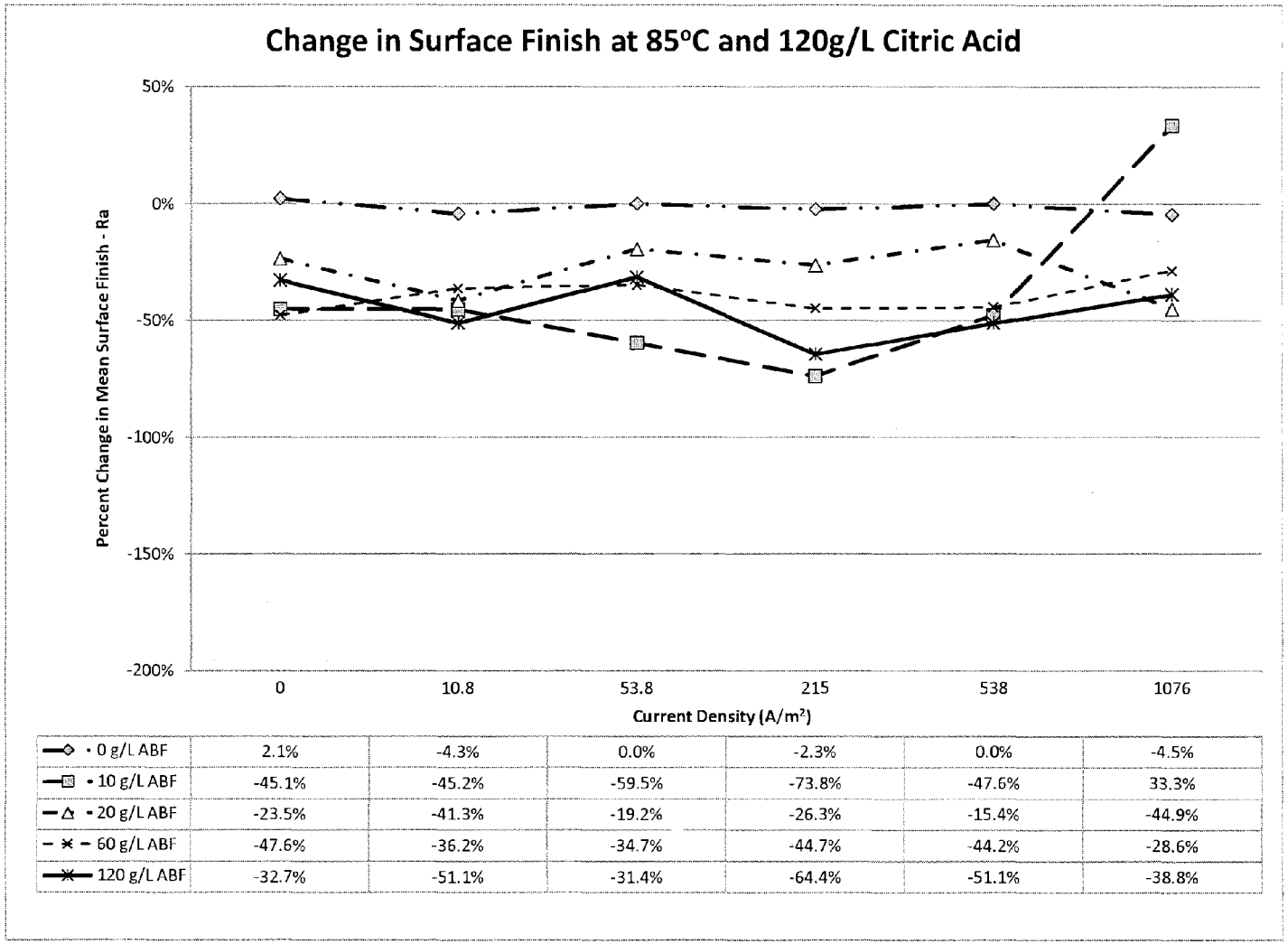
FIGS. 4H-4J are graphs of data showing the change in surface finish as a function of current density under conditions corresponding to FIGS. 4E-4G, respectively.
Figure 4I:
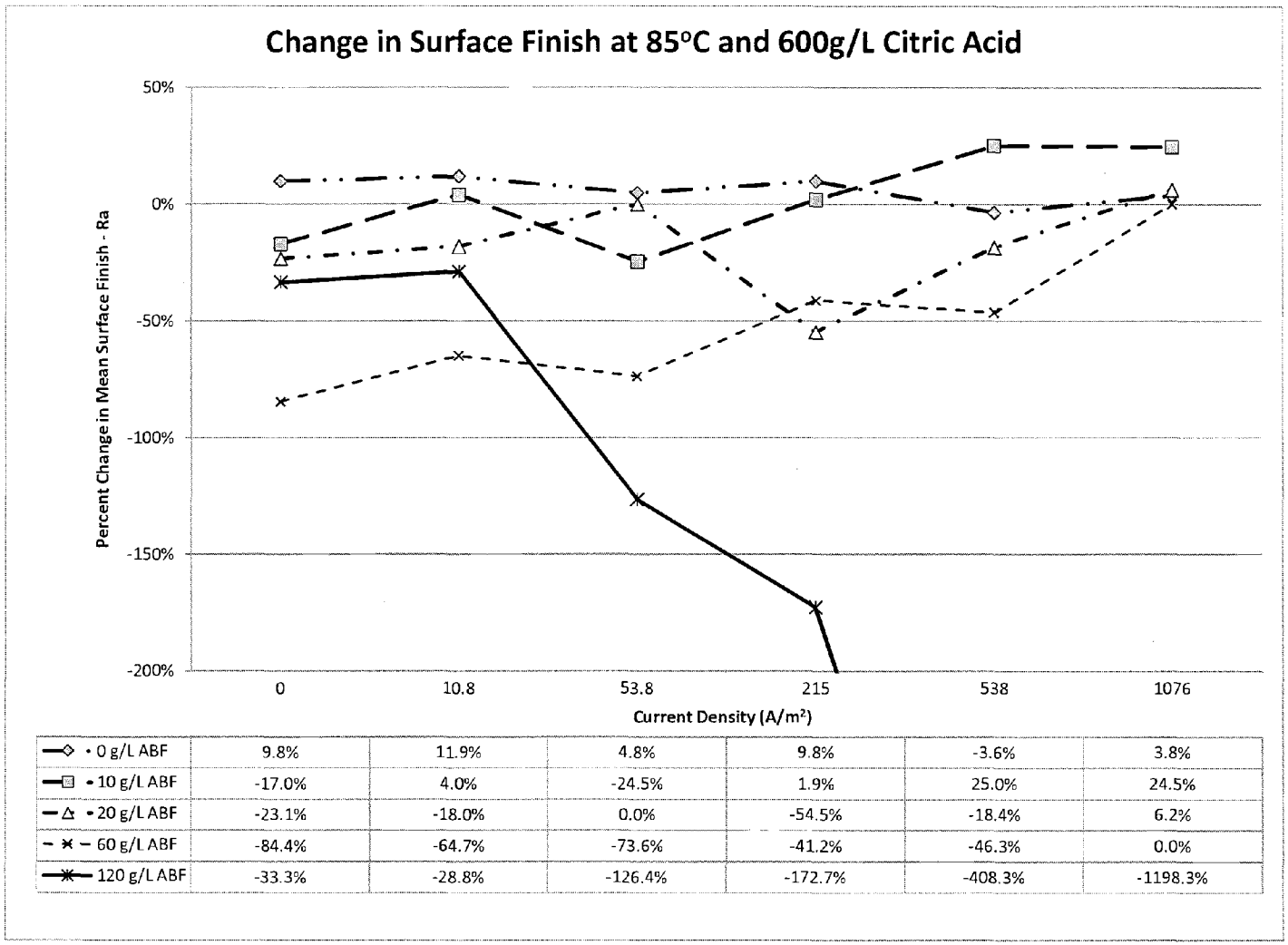
Figure 4J:
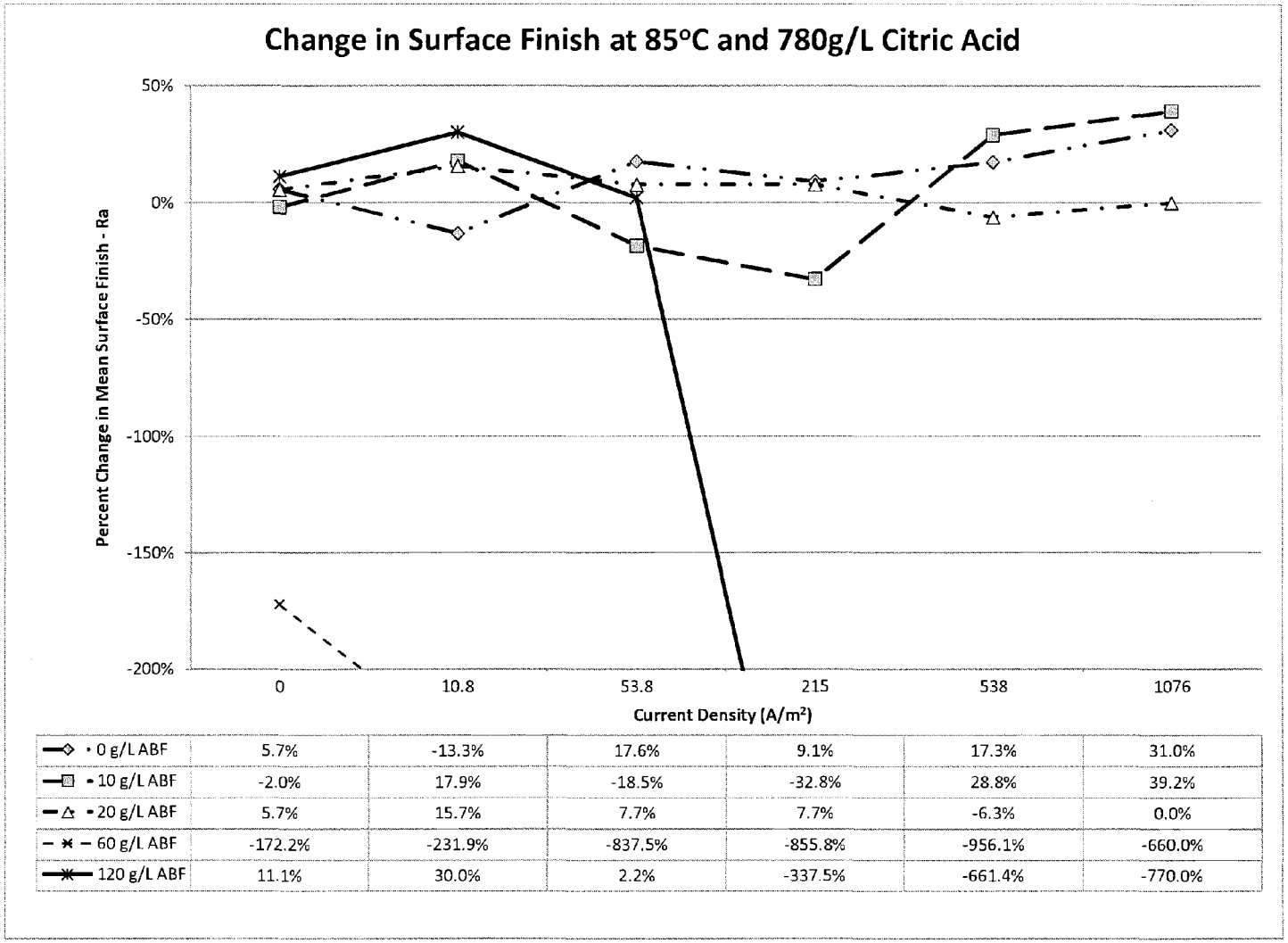

FIGS. 4E-4G depict, at a representative high temperature of 85° C. and three different concentrations of citric acid, the impact of current density on material removal rates, and FIGS. 4H-4J depict the impact of current density on surface finish under the same sets of conditions. FIG. 4E shows, as do FIGS. 4F and 4G but to a lesser extent, that the material removal capabilities of the electrolyte solution are greatest at the highest concentrations of ammonium bifluoride, and are quite significant at high temperature. It should be noted that although FIG. 4E shows data only at 120 g/L citric acid, essentially the same rates of material removal are seen at citric acid concentrations at 60 g/L, 120 g/L, and 300 g/L. But, as shown in FIG. 4F, at 600 g/L citric acid, the concentration of citric acid appears to provide some amount of protection for the surface from large-scale attack, and the material removal rates drop as compared with lower citric acid concentrations. At 780 g/L, as shown in FIG. 4G, the removal rates are reduced even further. Regardless the concentrations of ammonium bifluoride and citric acid, material removal appears to be little influenced by current density.

FIG. 4H shows that at high temperature and modest citric acid concentration, a moderate amount of surface finish degradation is experienced at nearly all ammonium bifluoride concentrations and current densities. However, when viewing FIGS. 4E and 4H together, one process condition stands out. At a citric acid concentration of 120 g/L, a low level of 10 g/L ammonium bifluoride, and a high current density of 1076 $A/m^2$, material removal is suppressed and a significant improvement in surface finish results. This may provide further evidence of the theory discussed above, in that the elevated current density may be creating enough excess oxygen at the material surface to fill the "valleys" in the surface morphology such that the "peaks" are preferentially attacked by the fluoride ion generated by dissociation of the ammonium bifluoride. This effect, combined with the possible micro-barrier effect of citric acid, can be seen even more strongly in FIG. 4I (at 600 g/L citric acid) and FIG. 4J (at 780 g/L citric acid), which show a reduced degradation in surface finish, and in some cases an improvement in surface finish, at higher citric acid concentrations and higher current densities alone, and even more so at a combination of higher citric acid concentrations and higher current densities. For example, there is a significant improvement in surface finish at 10 g/L and 20 g/L ammonium bifluoride in going from 600 g/L to 780 g/L citric acid.

However, there appears to be a limit to this effect, as it can be seen that surface finish dramatically worsens for at highest concentration of 120 g/L ammonium bifluoride and the higher current densities in going from 120 g/L to 600 g/L and further to 780 g/L citric acid. A similar result was obtained at 60 g/L ammonium bifluoride, at least in raising the citric acid concentration from 600 g/L to 780 g/L.

As shown in Tables 3A-3C and 4A-4C below, process conditions for sheet goods finishing, in which minimal material removal is needed and a modest to high surface finish improvement is desired, and for micropolishing, in which virtually no material removal is needed and a very surface finish improvement is desired, can be achieved over a wide range of electrolyte mixtures, temperatures, and current densities. Tables 3A-3C and 4A-4C do not include electrolyte consisting essentially of water and citric acid, and substantially free of ammonium bifluoride, even though that solution can achieve essentially zero material removal and modest to high surface improvement over a wide range of temperature and current density, because those conditions were discussed separately with reference to FIGS. 1A-1C. Similarly, Tables 3A-3C and 4A-4C do not include electrolyte consisting essentially of water and ammonium bifluoride, and substantially free of citric acid, because those conditions were discussed separately with reference to FIGS. 2A-2D. Tables 3A-3C are separated by levels of surface finish refinement, and are then organized in order of increasing ABF concentration. Tables 4A-4C are separated by levels of citric acid concentration and are then organized in order of increasing ABF concentration.

Several trends emerge from the data in Tables 3A-3C. First, low or near-zero material removal and improved surface finishes were obtained across the entire range of citric acid concentrations (60 g/L to 780 g/L), ammonium bifluoride concentrations (10 g/L to 120 g/L), temperatures (21° C. to 85° C.), and current densities (10.8 A/m$^2$ to 1076 A/m$^2$). Therefore, aqueous solutions of citric acid and ABF, in the substantial absence of a strong acid, can produce fine surface finishes with minimal material loss in concentrations as low as 60 g/L citric acid and 10 g/L ABF, and concentrations as high as 780 g/L citric acid and 120 g/L ABF, and at several combinations in between.

TABLE 3A

| Highest Surface Finish Refinement | | | | | |
|---|---|---|---|---|---|
| Citric Acid (g/L) | ABF (g/L) | Temperature (° C.) | Current Density (A/m$^2$) | Material Removed (mm/hr) | Surface Finish Change (%) |
| 780 | 10 | 85 | 1076 | 0.168 | 39.2 |
| 180 | 10 | 85 | 1076 | 0.208 | 36.4 |
| 120 | 10 | 85 | 1076 | 0.232 | 33.3 |
| 300 | 10 | 71 | 1076 | 0.156 | 30.4 |
| 780 | 10 | 71 | 53.8 | 0.100 | 30.4 |
| 780 | 10 | 71 | 10.8 | 0.108 | 30.2 |
| 300 | 10 | 54 | 1076 | 0.640 | 38.9 |
| 780 | 20 | 71 | 538 | 0.100 | 44.8 |
| 600 | 20 | 71 | 1076 | 0.188 | 40.0 |
| 180 | 20 | 54 | 1076 | 0.168 | 31.9 |
| 780 | 20 | 21 | 1076 | 0.044 | 30.9 |
| 780 | 60 | 54 | 1076 | 0.160 | 36.1 |
| 600 | 60 | 21 | 1076 | 0.200 | 46.9 |
| 780 | 60 | 21 | 538 | 0.088 | 42.0 |
| 600 | 60 | 21 | 538 | 0.080 | 37.9 |
| 780 | 60 | 21 | 1076 | 0.204 | 34.6 |
| 780 | 120 | 21 | 538 | 0.116 | 49.1 |
| 600 | 120 | 21 | 1076 | 0.168 | 44.7 |

In general, as shown in Table 3A, the highest levels of surface finish improvement (i.e., greater than 30% reduction in surface roughness) were obtained at higher current densities of 538-1076 A/m$^2$, at moderate to higher citric acid concentrations of 120-780 g/L, and generally at lower ABF concentrations of 10-20 g/L. When the ABF concentration is lower, in the range of 10-20 g/L, higher temperatures of 71-85° C. tend to produce better surface finishes at the higher citric acid concentrations of 600-780 g/L, while more moderate temperature of 54° C. produced fine surface finishes at moderate citric acid concentrations of 120-300 g/L. Nevertheless, significant improvements in surface finish were also obtained at low ABF, moderate citric acid, and high temperature conditions (10 g/L ABF, 120 g/L citric acid, 85° C.) and at low ABF, moderate citric acid, and lower temperature conditions (20 g/L ABF, 180 g/L citric acid, 54° C.). When the ABF concentration is higher, in the range of 60-120 g/L, lower temperatures of 21-54° C. tend to produce better surface finishes at the higher citric acid concentrations of 600-780 g/L and higher current densities. In addition, significant surface finish refinement was achieved at lower current densities of 10.8-53.8 A/m$^2$ at high citric acid concentrations of 780 g/L and high temperatures of 71-85° C. for both low ABF concentration of 10 g/L and high ABF concentration of 120 g/L, as shown in FIG. 4H.

TABLE 3B

| High Surface Finish Refinement | | | | | |
|---|---|---|---|---|---|
| Citric Acid (g/L) | ABF (g/L) | Temperature (° C.) | Current Density (A/m$^2$) | Material Removed (mm/hr) | Surface Finish Change (%) |
| 780 | 10 | 85 | 538 | 0.132 | 28.8 |
| 60 | 10 | 85 | 1076 | 0.276 | 28.0 |
| 300 | 10 | 85 | 1076 | 0.216 | 25.6 |
| 600 | 10 | 85 | 538 | 0.084 | 25.0 |
| 600 | 10 | 85 | 1076 | 0.220 | 24.5 |
| 780 | 10 | 85 | 10.8 | 0.136 | 17.9 |
| 600 | 10 | 71 | 538 | 0.076 | 19.6 |
| 180 | 10 | 71 | 1076 | 0.192 | 18.8 |
| 180 | 10 | 54 | 1076 | 0.200 | 25.0 |
| 780 | 10 | 54 | 538 | 0.024 | 21.2 |
| 780 | 10 | 54 | 53.8 | 0.088 | 15.3 |
| 300 | 20 | 85 | 1076 | 0.212 | 30.0 |
| 780 | 20 | 85 | 10.8 | 0.244 | 15.7 |
| 780 | 20 | 71 | 1076 | 0.196 | 27.1 |
| 780 | 20 | 71 | 0 | 0.176 | 22.1 |
| 180 | 20 | 71 | 1076 | 0.188 | 15.1 |
| 780 | 20 | 54 | 1076 | 0.228 | 28.6 |
| 300 | 20 | 54 | 1076 | 0.144 | 25.0 |
| 600 | 20 | 54 | 1076 | 0.164 | 18.0 |
| 780 | 20 | 54 | 538 | 0.100 | 16.7 |
| 780 | 20 | 54 | 215 | 0.108 | 15.6 |
| 780 | 20 | 21 | 538 | 0.016 | 20.3 |
| 300 | 60 | 21 | 1076 | 0.192 | 21.3 |
| 780 | 120 | 85 | 10.8 | 0.004 | 30.0 |
| 780 | 120 | 71 | 10.8 | 0.000 | 25.0 |
| 780 | 120 | 71 | 53.8 | 0.002 | 23.7 |
| 780 | 120 | 54 | 10.8 | 0.032 | 16.4 |
| 780 | 120 | 21 | 1076 | 0.196 | 16.3 |

In general, as shown in Table 3B, high but not the highest levels of surface finish improvement (i.e., between about 15% and about 30% reduction in surface roughness) were obtained at lower ABF concentrations of 10-20 g/L and moderate to higher temperatures of 54-85° C., and largely but not exclusively at higher current densities of 538-1076 A/m$^2$. Typically, these results were achieved at high citric acid concentrations of 600-780 g/L. For example, while concentrations of 10-20 g/L ABF usually produced fine results at the higher current densities and high citric acid concentrations, fine results were also obtained using lower citric acid concentrations of 60-300 g/L at a low current density of 10.8 A/m$^2$ and a high temperature of 85° C., and at low a current density of 53.8 A/m$^2$ and a modest temperature of 54° C. High improvements in surface finish were achieved at high levels of 120 g/L ABF too, both at high temperature and low current density (71-85° C. and 10.8-53.8 A/m$^2$) and at low temperature and high current density (21° C. and 1076 A/m$^2$), in all cases at high citric acid concentrations of 780 g/L. In this regard, it appears that there is some complementary activity between temperature and current density, in that similar surface finish results can be achieved for a solution having a high concentration of citric acid by using a higher current density with a lower temperature or by using a lower current density with a higher temperature. See also FIGS. 4H-4J, which show that conditions of high temperature combined with high current density tend to yield the best surface finish improvements.

TABLE 3C

Moderate Surface Finish Refinement

| Citric Acid (g/L) | ABF (g/L) | Temperature (° C.) | Current Density (A/m$^2$) | Material Removed (mm/hr) | Surface Finish Change (%) |
|---|---|---|---|---|---|
| 600 | 10 | 85 | 10.8 | 0.216 | 4.0 |
| 600 | 10 | 85 | 215 | 0.232 | 1.9 |
| 780 | 10 | 71 | 0 | 0.100 | 14.3 |
| 780 | 10 | 71 | 215 | 0.048 | 9.8 |
| 600 | 10 | 71 | 0 | 0.164 | 6.0 |
| 780 | 10 | 71 | 538 | 0.064 | 5.4 |
| 780 | 10 | 21 | 53.8 | 0.040 | 14.5 |
| 60 | 10 | 21 | 1076 | 0.148 | 13.5 |
| 780 | 20 | 85 | 215 | 0.260 | 7.7 |
| 780 | 20 | 85 | 53.8 | 0.216 | 7.7 |
| 780 | 20 | 85 | 0 | 0.232 | 5.7 |
| 600 | 20 | 85 | 1076 | 0.184 | 6.2 |
| 300 | 20 | 71 | 1076 | 0.200 | 7.1 |
| 780 | 20 | 71 | 53.8 | 0.172 | 2.0 |
| 600 | 20 | 54 | 538 | 0.064 | 8.2 |
| 600 | 20 | 21 | 538 | 0.032 | 13.2 |
| 120 | 20 | 21 | 1076 | 0.164 | 10.6 |
| 300 | 20 | 21 | 1076 | 0.148 | 10.4 |
| 600 | 20 | 21 | 1076 | 0.032 | 6.7 |
| 60 | 20 | 21 | 1076 | 0.124 | 6.8 |
| 180 | 20 | 21 | 1076 | 0.132 | 4.2 |
| 780 | 20 | 21 | 53.8 | 0.032 | 1.7 |
| 120 | 60 | 21 | 1076 | 0.196 | 11.3 |
| 60 | 60 | 21 | 1076 | 0.224 | 4.2 |
| 780 | 120 | 85 | 0 | 0.016 | 11.1 |
| 780 | 120 | 85 | 53.8 | 0.016 | 2.2 |
| 780 | 120 | 54 | 0 | 0.008 | 13.5 |
| 780 | 120 | 54 | 53.8 | 0.020 | 5.9 |
| 780 | 120 | 21 | 10.8 | 0.004 | 7.8 |
| 300 | 120 | 21 | 1076 | 1.400 | 2.3 |

In general, as shown in Table 3C, modest levels of surface finish improvement (i.e., less than about 15% reduction in surface roughness) were obtained at lower ABF concentrations of 10-20 g/L and higher temperatures of 71-85° C., and largely across the entire range of current densities of 10.8-1076 A/m$^2$. Typically, these results were achieved at high citric acid concentrations of 600-780 g/L. One notable exception to this trend is that modest to high surface finish improvements were also obtained at all ABF concentrations of 10-120 g/L and low to moderate citric acid concentrations of 60-300 g/L at a low temperature of 21° C. and a high current density of 1076 A/m$^2$.

TABLE 4A

Lowest Citric Acid Concentrations

| Citric Acid (g/L) | ABF (g/L) | Temperature (° C.) | Current Density (A/m$^2$) | Material Removed (mm/hr) | Surface Finish Change (%) |
|---|---|---|---|---|---|
| 180 | 10 | 85 | 1076 | 0.208 | 36.4 |
| 120 | 10 | 85 | 1076 | 0.232 | 33.3 |
| 60 | 10 | 85 | 1076 | 0.276 | 28.0 |
| 180 | 10 | 54 | 1076 | 0.200 | 25.0 |
| 180 | 10 | 71 | 1076 | 0.192 | 18.8 |
| 60 | 10 | 21 | 1076 | 0.148 | 13.5 |
| 180 | 20 | 54 | 1076 | 0.168 | 31.9 |
| 180 | 20 | 71 | 1076 | 0.188 | 15.1 |
| 120 | 20 | 21 | 1076 | 0.164 | 10.6 |
| 60 | 20 | 21 | 1076 | 0.124 | 6.8 |
| 180 | 20 | 21 | 1076 | 0.132 | 4.2 |
| 120 | 60 | 21 | 1076 | 0.196 | 11.3 |
| 60 | 60 | 21 | 1076 | 0.224 | 4.2 |

As shown in Table 4A, at low citric acid concentrations of 60-180 g/L, improvement of surface finish uniformly appears to require high current density. Typically, the best surface finish improvements were obtained at low ABF concentrations of 10-20 g/L and at moderate to high temperatures of 54-85° C. Low and moderate surface finish improvement was achieved at ABF concentrations of 10-60 g/L and low temperatures of 21° C.

TABLE 4B

Moderate Citric Acid Concentrations

| Citric Acid (g/L) | ABF (g/L) | Temperature (° C.) | Current Density (A/m$^2$) | Material Removed (mm/hr) | Surface Finish Change (%) |
|---|---|---|---|---|---|
| 300 | 10 | 54 | 1076 | 0.188 | 38.9 |
| 300 | 10 | 71 | 1076 | 0.156 | 30.4 |
| 300 | 10 | 85 | 1076 | 0.216 | 25.6 |
| 600 | 10 | 85 | 538 | 0.084 | 25.0 |
| 600 | 10 | 85 | 1076 | 0.220 | 24.5 |
| 600 | 10 | 71 | 538 | 0.076 | 19.6 |
| 600 | 10 | 71 | 0 | 0.164 | 6.0 |
| 600 | 10 | 85 | 10.8 | 0.216 | 4.0 |
| 600 | 10 | 85 | 215 | 0.232 | 1.9 |
| 600 | 20 | 71 | 1076 | 0.188 | 40.0 |
| 300 | 20 | 85 | 1076 | 0.212 | 30.0 |
| 300 | 20 | 54 | 1076 | 0.144 | 25.6 |
| 600 | 20 | 54 | 1076 | 0.164 | 18.0 |
| 600 | 20 | 21 | 538 | 0.032 | 13.2 |
| 300 | 20 | 21 | 1076 | 0.148 | 10.4 |
| 600 | 20 | 54 | 538 | 0.064 | 8.2 |
| 600 | 20 | 21 | 1076 | 0.032 | 6.7 |
| 300 | 20 | 71 | 1076 | 0.200 | 7.1 |
| 600 | 20 | 85 | 1076 | 0.184 | 6.2 |
| 600 | 60 | 21 | 1076 | 0.200 | 46.9 |
| 600 | 60 | 21 | 538 | 0.080 | 37.9 |
| 300 | 60 | 21 | 1076 | 0.192 | 21.3 |
| 600 | 120 | 21 | 1076 | 0.168 | 44.7 |
| 300 | 120 | 21 | 1076 | 1.400 | 2.3 |

As shown in Table 4B, at moderate citric acid concentrations of 300-600 g/L, significant improvement of surface finish generally requires higher current densities of 538-1076 A/m$^2$, and occurs primarily at low ABF concentrations of 10-20 g/L ABF. At the lowest ABF concentration of 10 g/L, higher temperatures of 54-85° C. achieve the best results, while at an ABF concentration of 20 g/L, good results are achieved in the range from 21-85° C. At higher ABF concentrations of 60-120 g/L, surface finish improvement more typically occurs at a lower temperature of 21° C.

TABLE 4C

| Highest Citric Acid Concentration | | | | | |
|---|---|---|---|---|---|
| Citric Acid (g/L) | ABF (g/L) | Temperature (° C.) | Current Density (A/m$^2$) | Material Removed (mm/hr) | Surface Finish Change (%) |
| 780 | 10 | 85 | 1076 | 0.168 | 39.2 |
| 780 | 10 | 71 | 53.8 | 0.100 | 30.4 |
| 780 | 10 | 71 | 10.8 | 0.108 | 30.2 |
| 780 | 10 | 85 | 538 | 0.132 | 28.8 |
| 780 | 10 | 54 | 538 | 0.024 | 21.2 |
| 780 | 10 | 85 | 10.8 | 0.136 | 17.9 |
| 780 | 10 | 54 | 53.8 | 0.088 | 15.3 |
| 780 | 10 | 21 | 53.8 | 0.040 | 14.5 |
| 780 | 10 | 71 | 0 | 0.200 | 14.3 |
| 780 | 10 | 71 | 215 | 0.048 | 9.8 |
| 780 | 10 | 71 | 538 | 0.064 | 5.4 |
| 780 | 20 | 71 | 538 | 0.100 | 44.8 |
| 780 | 20 | 21 | 1076 | 0.044 | 30.9 |
| 780 | 20 | 54 | 1076 | 0.228 | 28.6 |
| 780 | 20 | 71 | 1076 | 0.196 | 27.1 |
| 780 | 20 | 71 | 0 | 0.176 | 22.1 |
| 780 | 20 | 21 | 538 | 0.016 | 20.3 |
| 780 | 20 | 54 | 538 | 0.100 | 16.7 |
| 780 | 20 | 85 | 10.8 | 0.244 | 15.7 |
| 780 | 20 | 54 | 215 | 0.108 | 15.6 |
| 780 | 20 | 85 | 53.8 | 0.216 | 7.7 |
| 780 | 20 | 85 | 215 | 0.260 | 7.7 |
| 780 | 20 | 85 | 0 | 0.232 | 5.7 |
| 780 | 20 | 71 | 53.8 | 0.172 | 2.0 |
| 780 | 20 | 21 | 53.8 | 0.032 | 1.7 |
| 780 | 60 | 21 | 538 | 0.088 | 42.0 |
| 780 | 60 | 54 | 1076 | 0.160 | 36.1 |
| 780 | 60 | 21 | 1076 | 0.204 | 34.6 |
| 780 | 120 | 21 | 538 | 0.116 | 49.1 |
| 780 | 120 | 85 | 10.8 | 0.004 | 30.0 |
| 780 | 120 | 71 | 10.8 | 0.000 | 25.0 |
| 780 | 120 | 71 | 53.8 | 0.008 | 23.7 |
| 780 | 120 | 54 | 10.8 | 0.032 | 16.4 |
| 780 | 120 | 21 | 1076 | 0.196 | 16.3 |
| 780 | 120 | 54 | 0 | 0.008 | 13.5 |
| 780 | 120 | 85 | 0 | 0.016 | 11.1 |
| 780 | 120 | 21 | 10.8 | 0.004 | 7.8 |
| 780 | 120 | 54 | 53.8 | 0.020 | 5.9 |
| 780 | 120 | 85 | 53.8 | 0.016 | 2.2 |

Comparing Table 4C with Tables 4A and 4B, it can be seen that the most process conditions for obtaining surface improvement, with virtually no or minimal material loss, occur at high citric acid concentrations of 780 g/L. As shown in Table 4C, at high citric acid concentrations of 780 g/L, significant improvement of surface finish can be obtained at nearly all current densities of 10.8-1076 A/m$^2$ and from low to high temperatures of 21-85° C., and at both low ABF concentrations of 10-20 g/L ABF and high ABF concentrations of 120 g/L ABF.

Figure 5A:
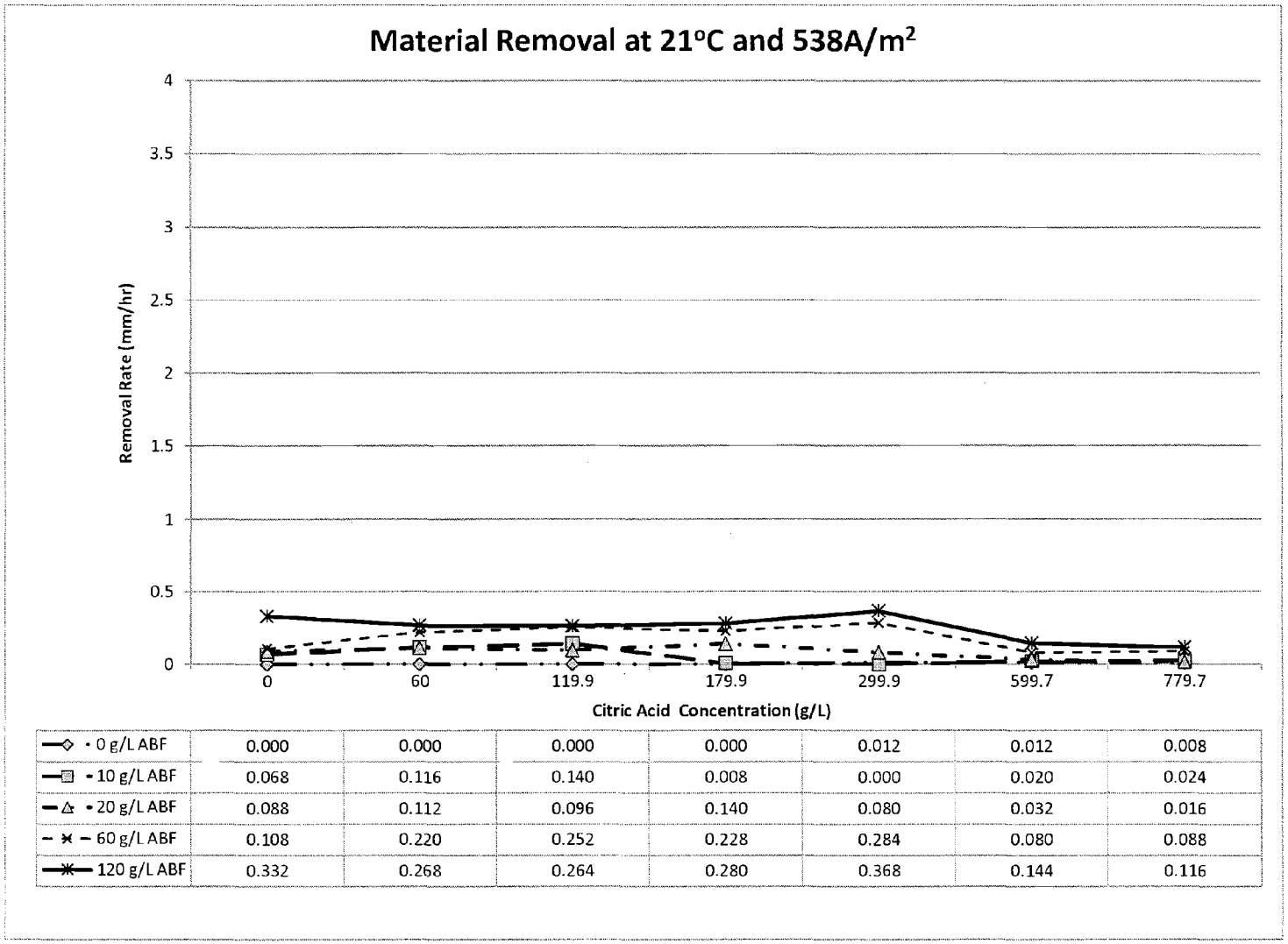
FIGS. 5A-5B are graphs of data showing the amount of material removed and the change in surface finish, respectively, at various combinations of citric acid and ammonium bifluoride concentrations at a low temperature (21° C.) and high current density (538 $A/m^2$).
Figure 5B:
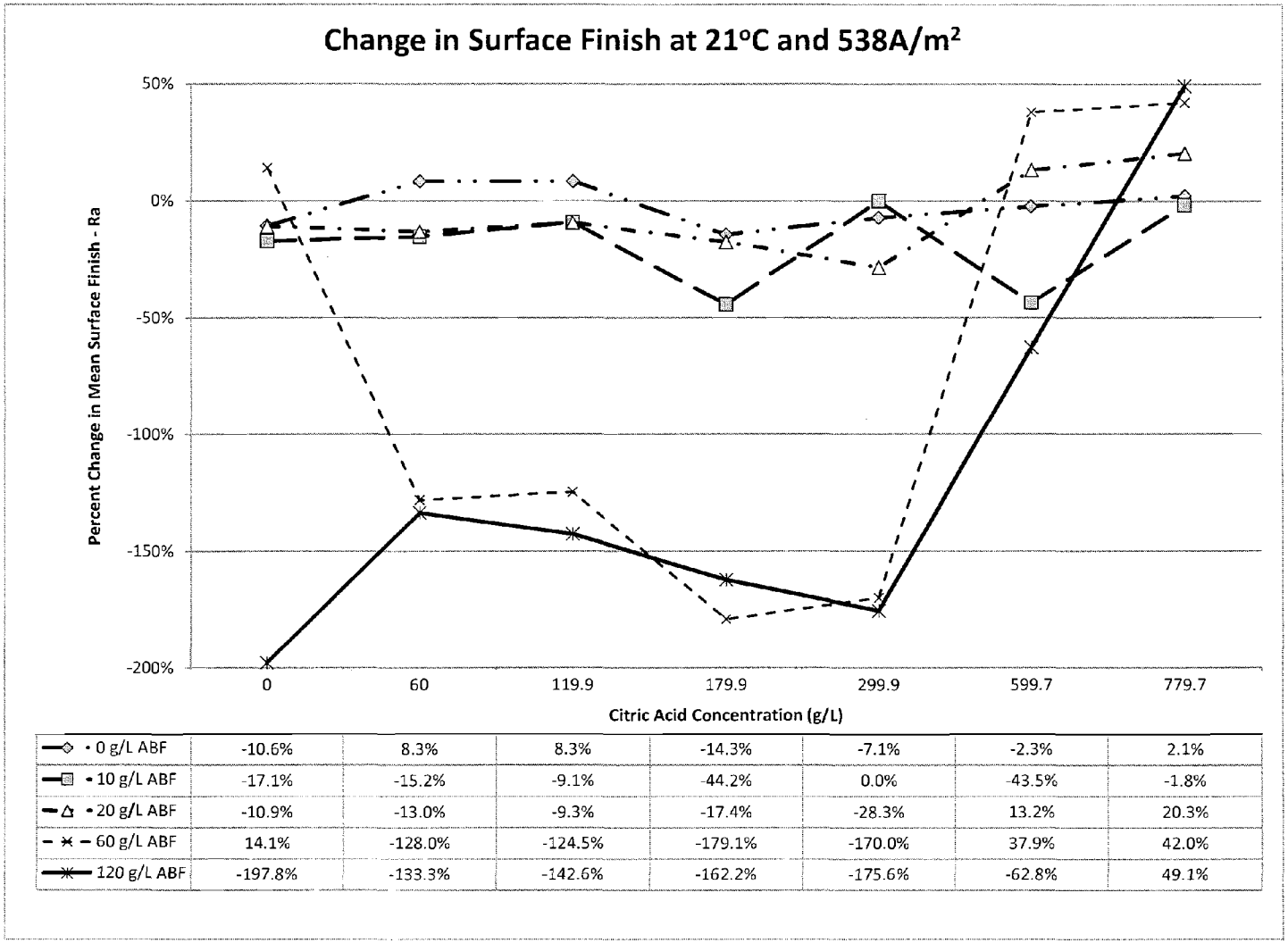

FIGS. 5A and 5B show rates of material removal and changes in surface finish at a representative low temperature of 21° C. and a representative high current density of 538 A/m$^2$. It can be seen in FIG. 5B that surface finish degradation is modest at all citric acid concentrations below 600 g/L for ABF concentrations below 60 g/L, and that the surface finish actually improves for all ABF concentrations from 10-120 g/L at high citric acid concentrations above 600 g/L, and specifically at 780 g/L. In addition, FIG. 5A shows that the rate of material removal at these process conditions is relatively low. Therefore, operating at this range of composition, temperature, and current density would be desirable to achieve modest controlled material removal with minimal surface degradation or perhaps modest surface finish improvement, but would not be particularly effective for large scale material removal.

Figure 6A:
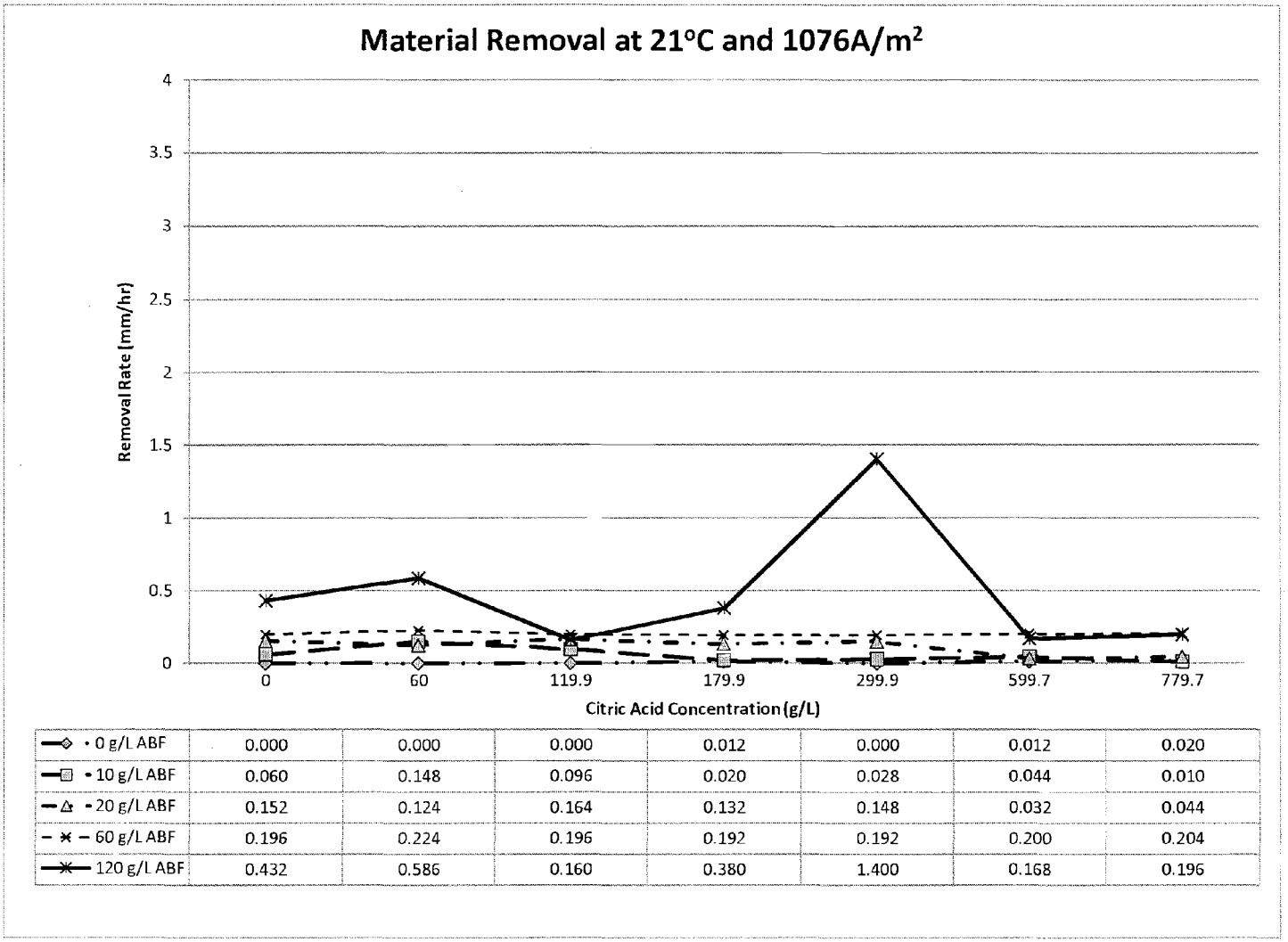
FIGS. 6A-6B are graphs of data showing the amount of material removed and the change in surface finish, respectively, at various combinations of citric acid and ammonium bifluoride concentrations at a low temperature (21° C.) and high current density (1076 $A/m^2$).
Figure 6B:
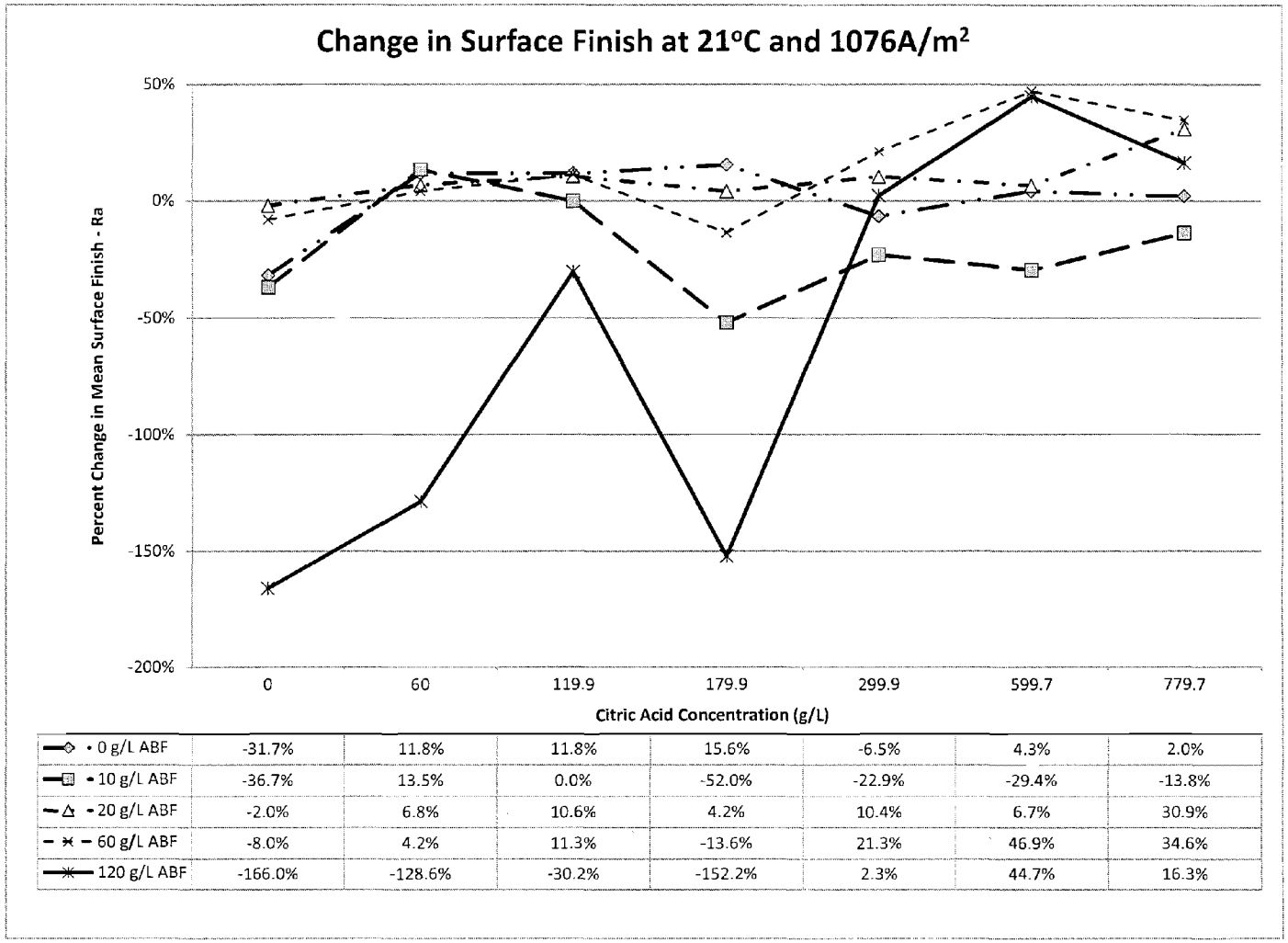

Similarly, FIGS. 6A and 6B show rates of material removal and changes in surface finish at a representative low temperature of 21° C. and a high current density of 1076 A/m$^2$. It can be seen in FIG. 6B that the small to modest surface finish improvement is achieved at all citric acid concentrations below 600 g/L for ABF concentrations greater than 10 g/L and less than 120 g/L, and that the surface finish improves most significantly at citric acid concentrations of 600 g/L and above. In addition, FIG. 6A shows that the rate of material removal at these process conditions is relatively low, except for compositions near 300 g/L citric acid and 120 g/L ABF, where the material removal rate is higher without causing any significant surface degradation. Therefore, operating at these ranges of composition, temperature, and current density would be desirable to achieve modest controlled material removal with minimal surface degradation or perhaps modest surface finish improvement, but would not be particularly effective for large scale material removal.

Figure 7A:
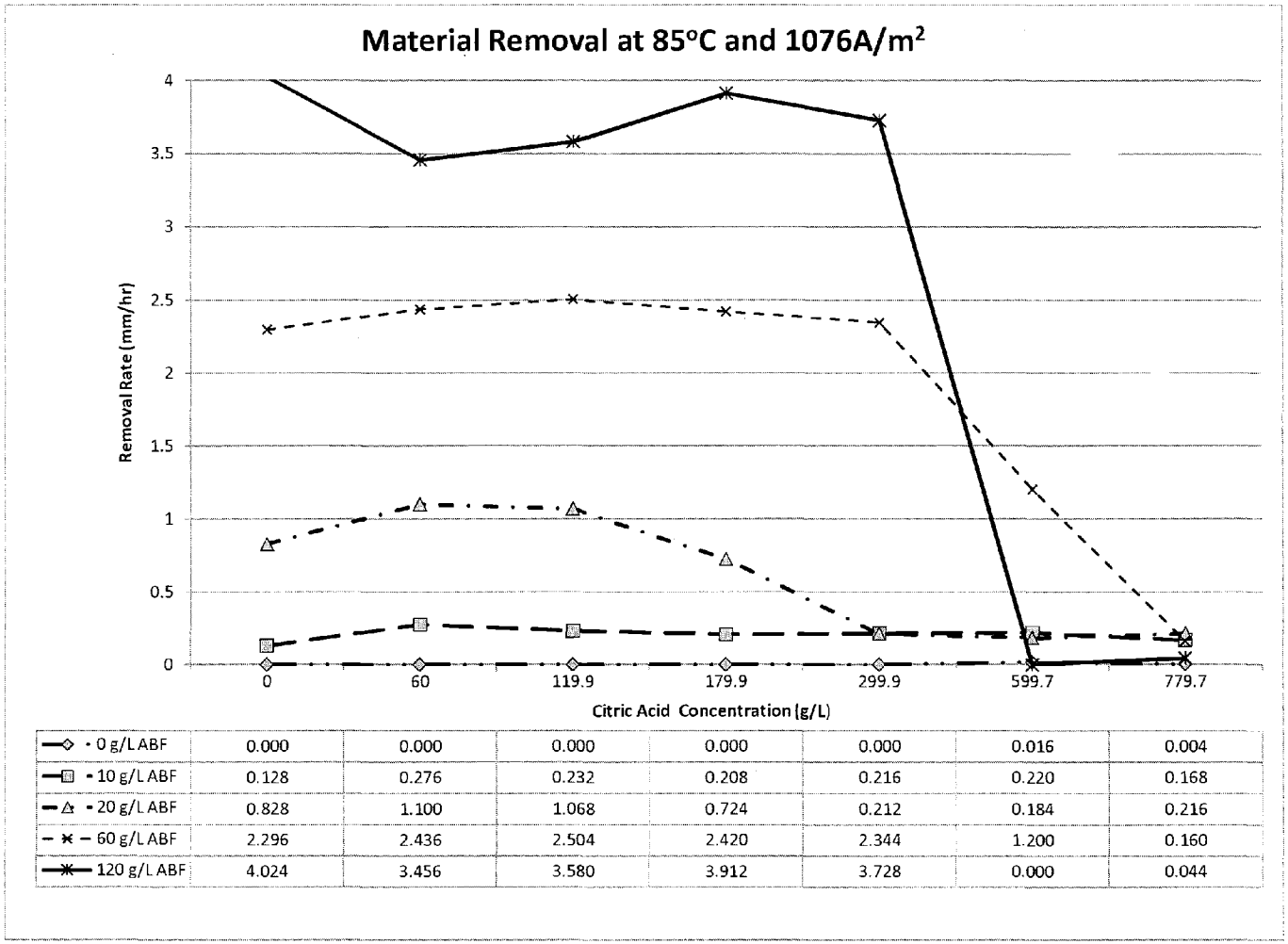
FIGS. 7A-7B are graphs of data showing the amount of material removed and the change in surface finish, respectively, at various combinations of citric acid and ammonium bifluoride concentrations at a high temperature (85° C.) and high current density (1076 $A/m^2$).
Figure 7B:
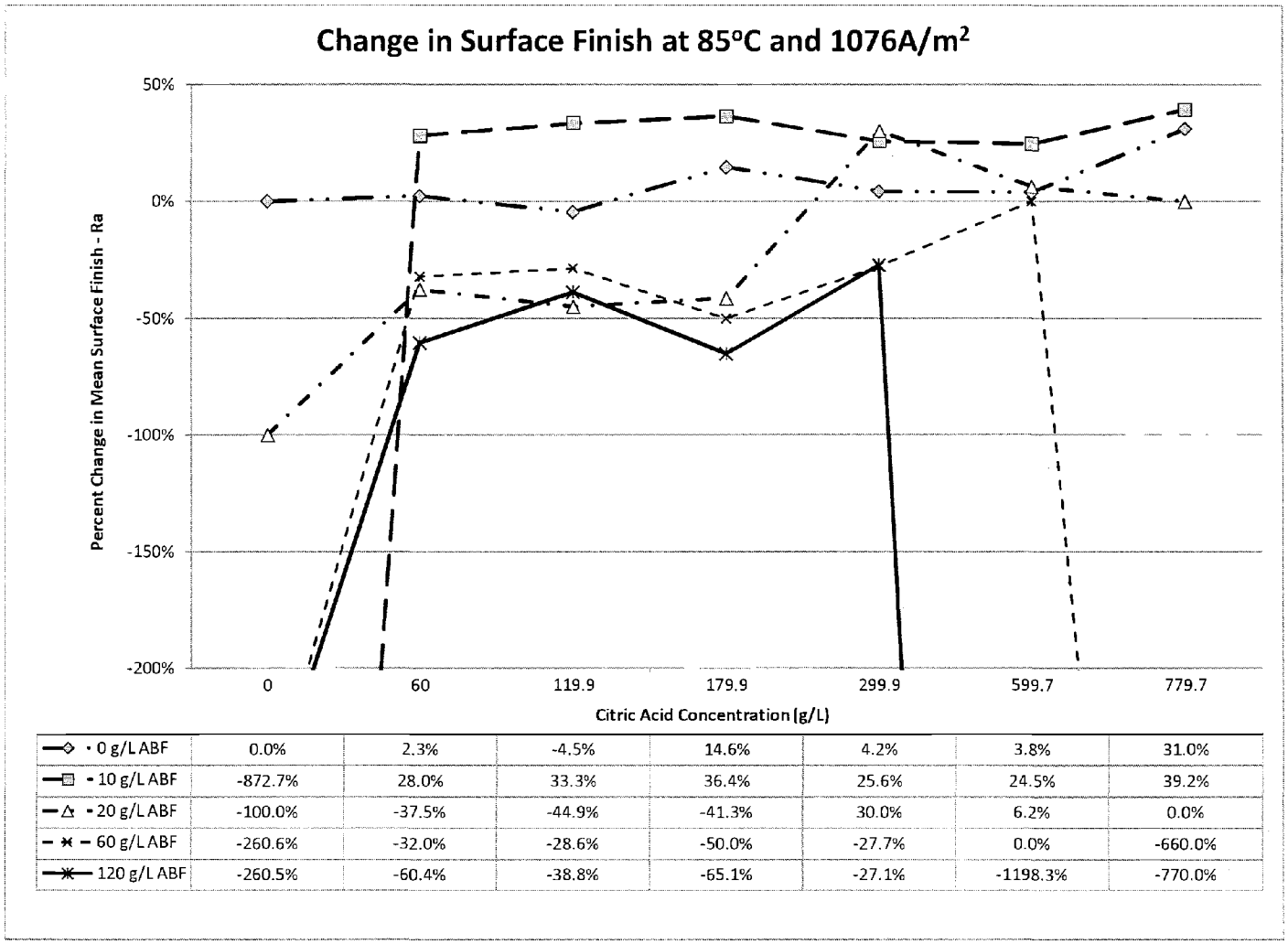

FIGS. 7A and 7B show that under certain conditions controlled material removal and surface finish improvement can be achieved simultaneously. In particular, at an ABF concentration of about 10 g/L, FIG. 7A shows a consistent modest material removal rates across all citric acid concentrations when a workpiece is exposed to the electrolyte solution at a high temperature of 85° C. and at a high current density of 1076 A/m$^2$. At the same conditions, FIG. 7B shows a substantial improvement in surface finish at all citric acid concentrations equal to or greater than 60 g/L. Even at higher ABF concentrations, from 20 g/L to 120 g/L ABF, material removal can be obtained in direct relation to ABF concentration without a substantial degradation of surface finish. However, at the highest citric acid concentrations of 600 g/L citric acid or more, material removal rates are significantly curtailed.

Several ranges of operating conditions have been identified at which controlled material removal can be achieved while degrading the surface finish only modestly, usually increasing the roughness by less than about 50%. FIGS. 8A-8B, 9A-9B, and 10A-10B illustrate exemplary operating conditions in this category.

Figure 9B:
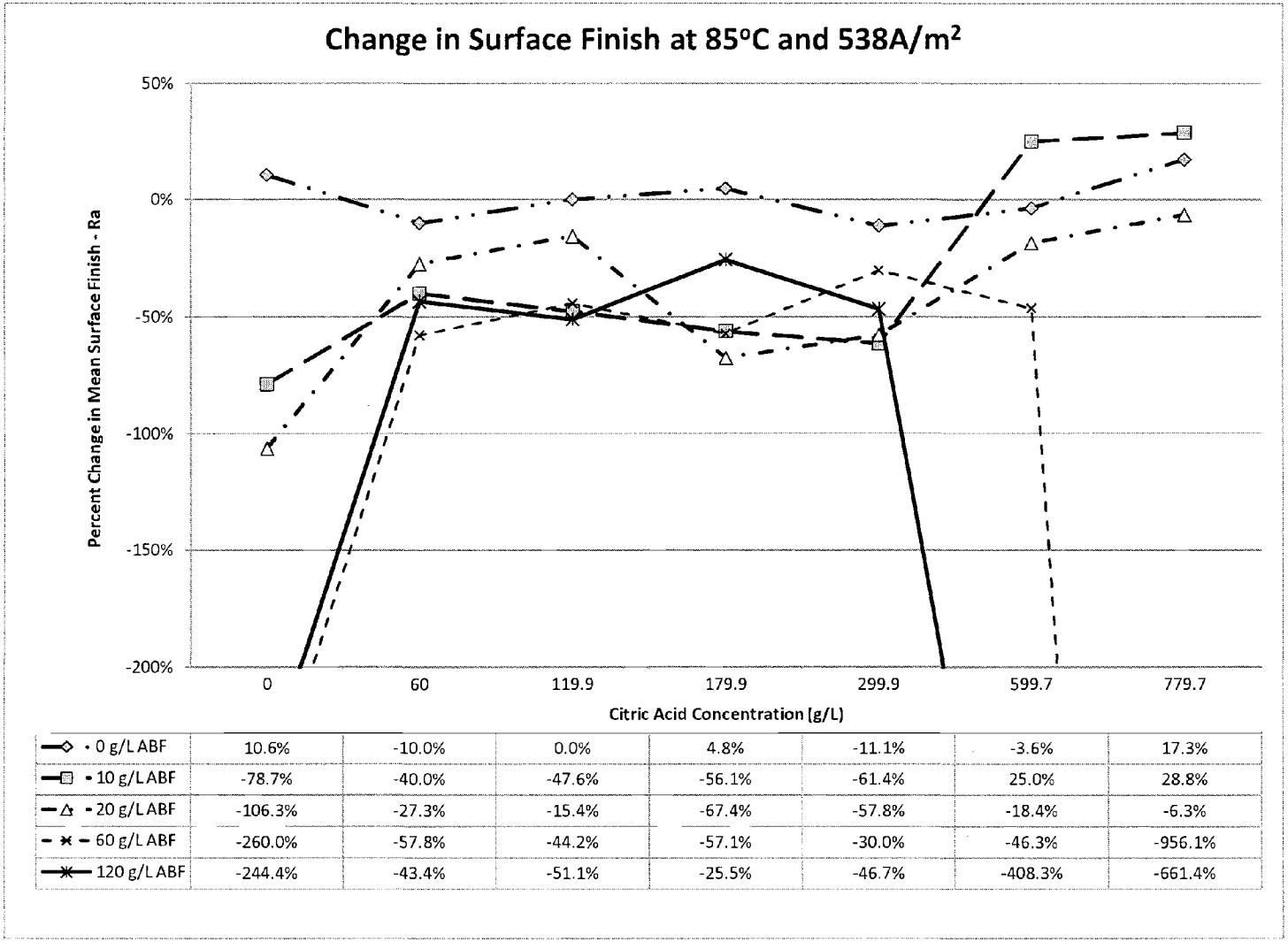
Figure 10A:
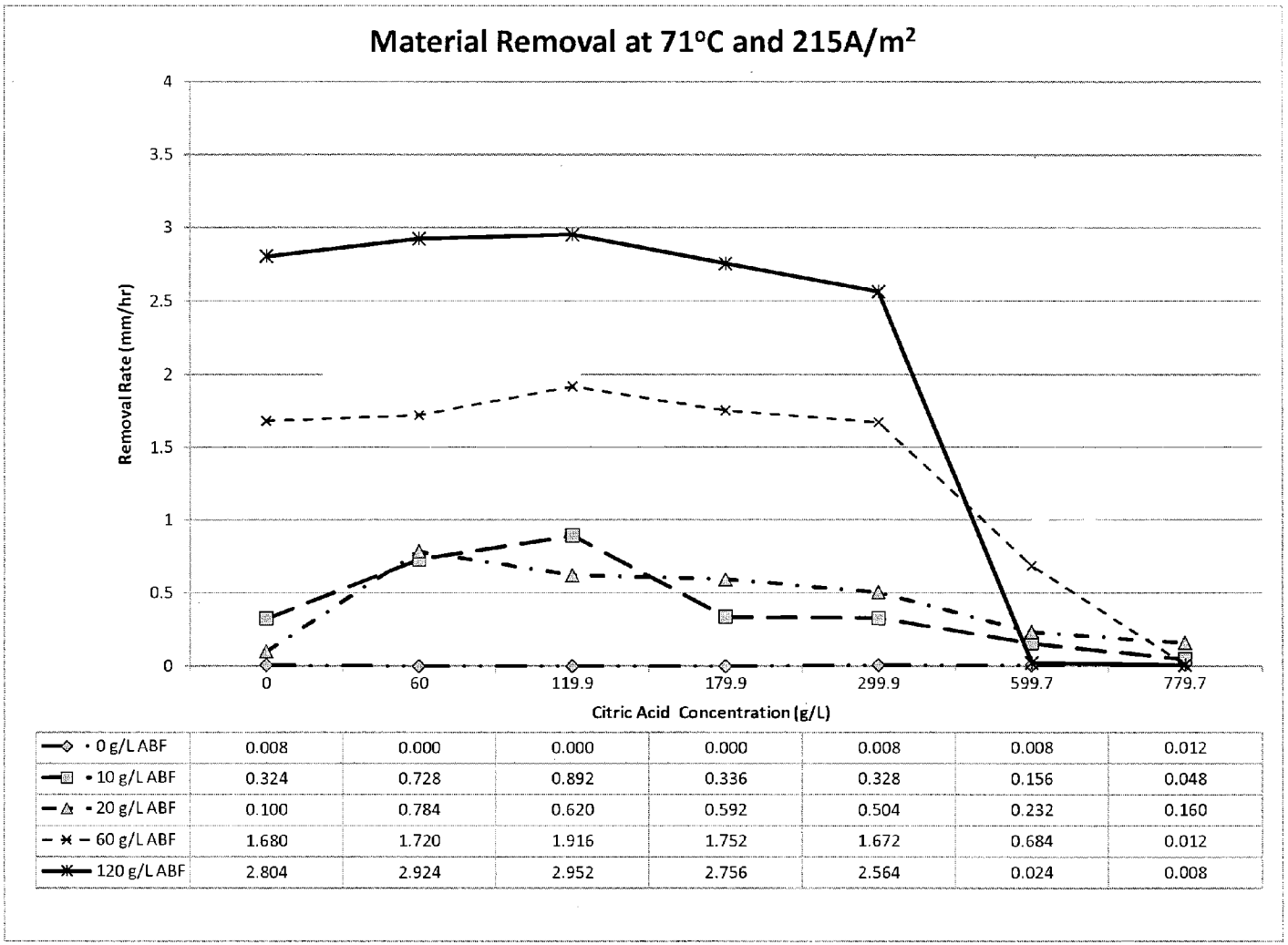
FIGS. 10A-10B are graphs of data showing the amount of material removed and the change in surface finish, respectively, at various combinations of citric acid and ammonium bifluoride concentrations at a representative moderately high temperature (71° C.) and moderate current density (215 $A/m^2$).
Figure 10B:
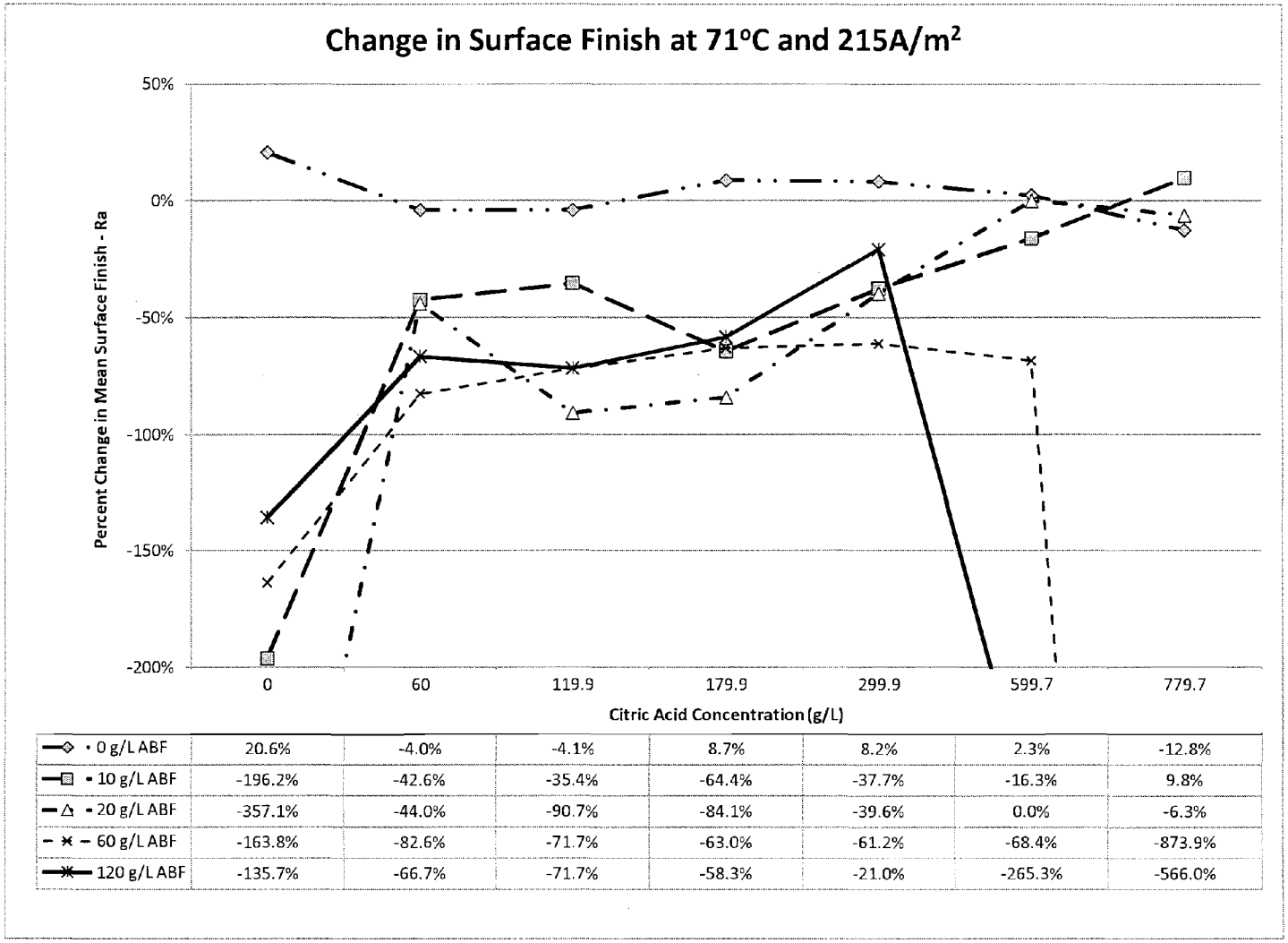

FIG. 8A shows that at a high temperature (85° C.) and low current density (10.8 A/m$^2$) condition, a fairly constant rate of material removal can be achieved at all ABF concentrations for citric acid concentrations in the range of about 60 g/L to about 300 g/L, with greater material removal rates being obtained in direct relation to ABF concentration. FIG. 8B shows that for these citric acid and ABF concentration ranges, surface finish degradation is consistently modest almost without regard to the specific citric acid and ABF concentrations. Citric acid concentrations of 600 g/L and higher greatly reduce or even stop the material removal capability of the electrolyte solution and also, except at an ABF concentration of 60 g/L, moderate surface finish degradation and even may tend to slightly improve the surface finish. FIGS. 9A and 9B show very similar results at a high temperature (85° C.) and high current density (538 A/m$^2$) condition, and FIGS. 10A and 10B show that similar results can be approached even at a somewhat lower temperature of 71° C. and at a modest current density of 215 A/m$^2$.

Based on the testing data disclosed herein, it is apparent that by controlling the temperature and current density, the same aqueous electrolyte solution bath could be used in a multi-step process that includes first removing a modest and controlled amount of material at a relatively low current density and then healing the surface by raising the current density to a high level while maintaining or slightly lowering the temperature. For example, using a solution having 300 g/L citric acid and 120 g/L ABF, modest material removal rates can be obtained at a temperature of 85° C. and a current density of 53.8 A/m$^2$ (see FIG. 3D) while degrading the surface finish by less than 30%, and then surface improvement can be obtained at the same temperature and a current density of 1076 A/m$^2$ (see FIGS. 7A and 7B) while removing less material.

Many more combinations of conditions for multi-step processing can be found by varying the citric acid concentration in addition to temperature and current density, due to the strong material removal mitigation effect that results when citric acid concentration rises to or above 600 g/L. For example, referring to FIGS. 8A and 8B, using an electrolyte solution having 120 g/L ABF at a temperature of 85° C. and a current density of 10.8 A/m$^2$, aggressive material removal with modest surface degradation can be achieved at a citric acid concentration of 300 g/L in a first processing step, and then simply by increasing the citric acid concentration to 780 g/L in a second processing step, material removal can be virtually stopped while the surface finish is significantly improved. Similar results can be obtained using the high temperature, higher current density conditions of FIGS. 9A and 9B or the moderately high temperature, moderate current density conditions of FIGS. 10A and 10B.

Very low concentrations of ammonium bifluoride have been found to be effective at both material removal and micropolishing. As shown in FIG. 1A, material removal rates are greatest at elevated temperatures, so it is expected that lower concentrations of ammonium bifluoride would be more effective at higher temperatures, such as at 85° C. or greater. In one exemplary electrolyte solution having both citric acid and ammonium bifluoride concentrations of 2 g/L, material removal and surface finish changes were observed. At 285 A/m$^2$, material removal rates of 0.008 mm/hr were recorded, with a corresponding surface finish change (degradation) of −156%. At 0 A/m$^2$, material removal rates of 0.0035 mm/hr were recorded with a corresponding surface finish change of −187%.

Similarly, when processing in an aqueous solution of 2 g/L ABF and no citric acid with an applied current of 271 A/m$^2$, material removal rates of 0.004 mm/hr were recorded, with a corresponding surface finish change (degradation) of −162%. At 0 A/m$^2$, material removal rates of 0.0028 mm/hr were recorded with a corresponding surface finish change of −168%.

While it would be preferable to use the least amount of ABF necessary to be effective, concentrations significantly in excess of 120 g/L, including concentrations of ammonium bifluoride at levels as high as 240 g/L to 360 g/L, and even concentrations in excess of saturation in water, can be used. The effectiveness of electrolyte solutions at high concentrations of ABF was tested by adding ABF incrementally to a solution of 179.9 g/L citric acid, with temperature fixed at 67° C. and current densities ranging from 10.8 A/m$^2$ to 255,000 A/m$^2$. Because this solution has relatively low electrical resistance, it was expected that higher concentrations of ABF could provide higher conductivity in the solution, especially at higher levels of current density. Temperature was also elevated above room temperature to reduce the resistance of the electrolyte. Samples of both CP titanium and nickel base alloy 718 were exposed to the electrolyte and as ABF was added, bulk material removal and micropolishing continued. ABF was added up to and beyond its saturation point in the electrolyte. The saturation point of ABF (which varies with temperature and pressure) under these parameters was between about 240 g/L and about 360 g/L. The data in Table 5 indicates that the electrolyte solution was effective for both bulk metal removal and micropolishing at ABF concentrations up to and exceeding saturation concentrations in water.

Testing was conducted to determine the effectiveness of electrolyte solutions for micropolishing and bulk metal removal at relatively high current densities, including those approaching 255,000 A/m$^2$. It is understood from the literature that electrolytes with low resistance values can tolerate high current densities. Certain combinations of citric acid concentration and ABF concentration exhibit particularly low resistance. For example, an electrolyte solution including about 180 g/L of citric acid in the temperature range of about 71° C. to 85° C. was studied at high current densities. Samples of commercially pure (CP) titanium and nickel base alloy 718 were exposed to this electrolyte solution with progressively increasing current density ranging from 10.8 A/m$^2$ to 255,000 A/m$^2$. The data in Table 5 indicates that bulk material removal and micropolishing were achieved at all tested current densities in the range, including at 255,000 A/m$^2$. In comparison to processing titanium and titanium alloys, higher current densities, particularly at about 5000 A/m$^2$ may be useful for processing nickel base alloys.

While CP titanium is effectively processed using relatively low voltages of less than our equal to about 40 volts, higher voltages can also be used. In one exemplary test, CP titanium was processed in a bath of an aqueous electrolyte solution including of about 180 g/L citric acid and about 120 g/L ABF at 85.6° C. applying a potential of 64.7 VDC and a current density of 53,160 A/m$^2$. Under these conditions, a 5 mm/hr bulk metal removal rate was achieved along with a 37.8% improvement of surface profilometer roughness, resulting in a surface with a uniform visually bright, reflective appearance. The same chemistry electrolyte remained affective on CP titanium samples for bulk metal removal after increasing the voltage to 150 VDC and reducing current density to 5,067 A/m$^2$, but under these conditions the metal removal rate slowed to 0.3 mm/hr and the finish was slightly degraded to a satin appearance.

For some metals and alloys, higher voltages may be equally or even more effective at achieving one or both of bulk material removal and surface finish improvement. In particular, certain metals, included but not limited to nickel base alloys (such as Waspaloy and nickel alloy 718), 18 k gold, pure chrome, and Nitinol alloys, appear to benefit from higher voltage processing, either with more rapid bulk metal removal and/or better surface finish improvement. In one exemplary experiment at comparatively high voltage on nickel alloy 718, specimens processed in an aqueous electrolyte including about 180 g/L citric acid and about 120 g/L ABF at 86.7° C. using a potential of 150 VDC and a current density of 4,934 A/m$^2$ resulted in a bulk metal removal rate of only 0.09 mm/hr, but a uniform surface finish improvement of 33.8% based on surface profilometer measurements.

TABLE 5

| Mat'l | Citric (g/L) | ABF (g/L) | Begin Temp (° C.) | Potential End (V) | Current Density (A/m$^2$) | Removal Rate (mm/hr) | Δ Surface Finish % (−worse +better) | Comments |
|---|---|---|---|---|---|---|---|---|
| Ti CP2 | 179.9 | 20 | 89.4 | 64.7 | 11,227 | 1.20 | 62.9% | Uniform, Bright Finish |
| Ti CP2 | 179.9 | 20 | 85.0 | 64.7 | 8,027 | 1.15 | 29.4% | Uniform, Bright Finish |
| Ti CP2 | 179.9 | 20 | 83.9 | 64.7 | 7,901 | 5.68 | 21.2% | Uniform, Bright Finish |
| Ti CP2 | 179.9 | 60 | 82.8 | 64.7 | 36,135 | 4.24 | 26.6% | Uniform, Bright Finish |
| Ti CP2 | 179.9 | 60 | 81.7 | 64.7 | 34,576 | 4.34 | 47.6% | Uniform, Bright Finish |
| Ti CP2 | 179.9 | 60 | 79.4 | 24.5 | 40,219 | 6.12 | 47.2% | Uniform, Bright Finish |
| Ti CP2 | 179.9 | 120 | 85.0 | 64.7 | 15,175 | 4.16 | −169.8% | End Deepest in Solution Bright, Balance is 'Frosted' |
| Ti CP2 | 179.9 | 120 | 85.0 | 64.7 | 15,379 | 3.44 | −183.9% | End Deepest in Solution Bright, Balance is 'Frosted' |
| Ti CP2 | 179.9 | 120 | 85.6 | 64.7 | 53,160 | 5.00 | 37.8% | Uniform, Bright Finish |
| Ti CP2 | 179.9 | 120 | 90.0 | 150 | 5,067 | 0.30 | −22.6% | Satin Appearance, Some Oxidation |
| Ti CP2 | 179.9 | 240 | 71.1 | 14.3 | 160,330 | 21.42 | −33.3% | Uniform, Bright Finish |
| Ti CP2 | 179.9 | 240 | 70.0 | 14.4 | 255,733 | 22.08 | −103.0% | Uniform, Bright Finish |
| Ti CP2 | 179.9 | 360 | 57.8 | 11.4 | 146,728 | 27.72 | −179.5% | Uniform, Bright Finish - ABF beyond Saturation Point |
| Ti CP2 | 179.9 | 360 | 66.7 | 9.6 | 164,876 | 24.36 | −191.2% | Uniform, Bright Finish - ABF beyond Saturation Point |
| Ti CP2 | 179.9 | 360 | 28.3 | 0.4 | 10.8 | 0.08 | 29.6% | Uniform Satin Appearance - ABF beyond Saturation Point |
| Ti CP2 | 179.9 | 360 | 25.0 | 0.3 | 53.8 | 0.10 | 7.3% | Uniform Satin Appearance - ABF beyond Saturation Point |
| Ti CP2 | 179.9 | 360 | 22.2 | 0.2 | 215 | 0.11 | 9.3% | Uniform Satin Appearance - ABF beyond Saturation Point |
| Ti CP2 | 179.9 | 360 | 20.6 | 0.1 | 538 | 0.13 | −346.9% | Pitted, Inconsistent Finish - ABF beyond Saturation Point |
| Ti CP2 | 179.9 | 360 | 20.6 | 0.6 | 1,076 | 0.16 | −988.6% | Very Pitted, Inconsistent Finish - ABF beyond Saturation Point |
| Nickel 718 | 179.9 | 20 | 81.7 | 64.7 | 68,585 | 4.01 | −12.5% | Uniform, Bright Finish |
| Nickel 718 | 179.9 | 20 | 81.1 | 39.9 | 79,301 | 4.85 | 55.0% | Uniform, Bright Finish |
| Nickel 718 | 179.9 | 20 | 80.6 | 36.3 | 39,828 | 4.75 | 48.3% | Uniform, Bright Finish |
| Nickel 718 | 179.9 | 60 | 80.0 | 64.7 | 42,274 | 3.42 | 11.1% | Uniform, Bright Finish |
| Nickel 718 | 179.9 | 60 | 80.0 | 64.7 | 35,066 | 3.69 | −11.1% | Uniform, Bright Finish |
| Nickel 718 | 179.9 | 60 | 81.7 | 14.8 | 39,484 | 4.86 | −20.0% | Uniform, Bright Finish |
| Nickel 718 | 179.9 | 120 | 85.0 | 64 | 33,945 | 3.84 | 8.3% | Uniform, Bright Finish |
| Nickel 718 | 179.9 | 120 | 83.3 | 65 | 34,818 | 3.96 | 13.0% | Uniform, Bright Finish |

TABLE 5-continued

| Mat'l | Citric (g/L) | ABF (g/L) | Begin Temp (° C.) | Potential End (V) | Current Density ($A/m^2$) | Removal Rate (mm/hr) | Δ Surface Finish % (−worse +better) | Comments |
|---|---|---|---|---|---|---|---|---|
| Nickel 718 | 179.9 | 120 | 82.2 | 9.7 | 39,984 | 6.08 | −57.1% | Uniform, Bright Finish |
| Nickel 718 | 179.9 | 120 | 86.7 | 150 | 4,934 | 0.09 | 33.8% | Uniform Satin Appearance |
| Nickel 718 | 179.9 | 360 | 67.2 | 11.5 | 140,005 | 12.90 | −16.0% | Uniform, Bright Finish - ABF beyond Saturation Point |

To evaluate the effect of accumulated dissolved metal in the electrolyte solution, a batch of 21 Ti-6Al-4V rectangular bars having dimensions of 6.6 cm by 13.2 cm by approximately 3.3 meters was processed sequentially in a bath of approximately 1135 liters. The processing was to demonstrate highly controlled metal removal on typical mill product forms. Over the 21 pieces of rectangular bar, a total volume of 70.9 kg of material was removed from the bars and was suspended in the electrolyte solution. The first bar initiated processing with 0 g/L of dissolved metal in the solution, and the final bar was processed with dissolved metal content in excess of 60 g/L. From the start of processing to the end of processing there were no detected detrimental effects on the metal's surface conditions or metal removal rates, and no significant changes were required in any of the operating parameters as a result of the increasing dissolved metal content in the electrolyte solution. This is in contrast to results from $HF/HNO_3$ acid pickling of titanium, in which the solution becomes substantially less effective even at concentrations of titanium in solution of 12 g/L. Similarly, electrochemical machining is hampered by high levels of dissolved metal in the electrolyte solution, since metal particles may obstruct the gap between the cathode and the anodic workpiece, and if the solid matter is electrically conductive, may even cause a short circuit.

Crack Modulation and Oxide Layer Removal.

An aqueous electrolyte solution as disclosed herein can be used to modulate or round out the bottom of surface cracks, thereby eliminating the sharp pointed crack tips that form at varying depths across the surface of metals, and most detrimentally in the family of reactive metals including but not limited to titanium and titanium alloys, nickel base alloys, zirconium and the like, when those metals are cooled from elevated temperatures in an oxygen-containing atmosphere. For example, such surface cracks can occur upon cooling from processes including but not limited to hot processing (e.g., forging, rolling, superplastic forming, and the like), welding, and heat treating. Moreover, the aqueous electrolyte solution can modulate these cracks with relatively little yield loss. A rounded or modulated crack tip is suitable for subsequent hot metal processing because such a crack is able to "heal" on subsequent hot working, whereas a typical metal-cooling crack, if not fully removed, "runs" and the metal breaks apart or fractures on subsequent processing.

FIG. 11 illustrates the conventional process for removing cracks, which involves mechanically removing, typically by grinding or machining away an entire uniform layer of material, to expose the bottom of the deepest surface crack. As is shown schematically, this results in a substantial loss of material. In contrast, FIG. 12 illustrates a crack modulation process using an electrolyte solution combined with the application of an electric current to widen the crack and round out the tip of the crack at its bottom, so that the crack will not propagate when the workpiece is subjected to further hot processing operations or put into service.

Accordingly, preferred process conditions for crack tip modulation or removal are those that produce very fast removal rates, while minimizing or eliminating hydrogen pickup. As discussed further below, these conditions are generally obtained when the concentration of carboxylic acid (e.g., citric acid) is low, the concentration of fluoride ion (e.g., in the form of ammonium bifluoride) is high, and temperature is high. Although effective large-scale removal can be conducted at all power densities, good results have been achieved when power density is low and the power is cycled to have as much OFF duty as the process will tolerate, in order to minimizing hydrogen content imparted to the material.

By working within these process parameters, the crack modulation capabilities of the aqueous electrolyte solution provide significant overall metal yield improvement over current process methods in which the metal surface is uniformly or locally mechanically removed (ground or machined) until the deepest crack bottom is ground flush with the surrounding metal. In addition, processing and consumables costs are significantly lower using the electrolyte solution and process disclosed herein as compared with the current mechanical removal methods.

Another significant process benefit obtainable with the aqueous electrolyte solution is the removal of a reactive metal's oxide layer, or in the case of titanium and titanium alloys, the alpha case. Similar to oxide layers of other reactive metals, alpha case is an oxygen-enriched phase that occurs when titanium and its alloys are exposed to heated air or oxygen. Alpha case is brittle, and tends to create a series of surface microcracks which will reduce the performance, including strength, fatigue properties, and corrosion resistance of a metal part. Titanium and titanium alloys are among the reactive metals, meaning that they react with oxygen and form a brittle tenacious oxide layer ($TiO_2$ for Ti, $ZrO_2$ for Zr, etc.) whenever heated in air or an oxidizing atmosphere at or above a temperature at which the natural oxide layer forms, which depend on the specific alloy and oxidizing atmosphere. As noted above, an oxide layer or alpha case oxide layer can be created by any heating of the metal to necessary temperatures for mill forging or mill rolling, as a result of welding, or by heating for finished part forging or hot part forming. The alpha case is brittle and full of micro-cracks which penetrate into the bulk metal, potentially causing premature tensile or fatigue failures, and making the surface more susceptible to chemical attack.

Therefore, the alpha case layer must be removed before any subsequent hot or cold working, or final component service. Aqueous electrolyte solutions, and processes using those solutions as described herein can remove alpha case to reveal the non-affected base metal. Alpha case removal is a challenging problem in titanium and titanium alloy processing because the alpha case is extremely resistant to attack, and the conventional wisdom is that some mechanical intervention is required prior to electrochemical processing.

This difficulty was highlighted in early testing, in which the titanium alpha case was first grit-blasted and/or lightly ground as a pretreatment to electrochemical treatment. Once abraded, the remaining oxide layer is most readily removed by a DC power cycle ON, followed by a simple scrub brush abrasion, followed by an OFF cycle of the DC power supply, a cyclical process which is then repeated several times. Note that an alternative to the scrub brush abrasion would be a high pressure, high volume pump system. Once the alpha case layer is removed, material removal rates from electrochemical etching increase. However, such a multi-step process cycle is very costly to operate, and generates low revenue.

To overcome these difficulties, a workpiece with an oxide or alpha case layer is treated in a bath of aqueous electrolyte solution having low carboxylic acid (e.g., citric acid) concentrations, high fluoride ion (e.g., ammonium bifluoride) concentrations, high temperatures, and preferably low power densities. Low citric acid concentrations, high ammonium bifluoride concentrations, and high temperatures maximize material removal rates, and because removal rates are relatively insensitive to current density when power is applied cyclically, a lower power density is used to cause less hydrogen to impregnate the material surface.

In sum, an aqueous electrolyte solution and process using such a solution, as disclosed herein, enables removal of oxide layers and titanium alpha case from a reactive metal surface in a controlled repeatable fashion. This is in contrast to the current HF—$HNO_3$ acid pickle in which a strongly exothermic reaction, which in the case of titanium uses the evolved titanium as a catalyst in the reaction, thereby causing continual changes in acid concentration and reaction rates, making repeatability difficult and accurate surface metal removal nearly impossible. Moreover, the disclosed aqueous electrolyte solution and method does not charge detrimental hydrogen into the bulk metal. Indeed, the disclosed process may be operated in a manor so as to remove hydrogen from the bulk metal. In contrast, the current process, by its very nature, introduces detrimental hydrogen into the bulk metal, necessitating additional costly degassing steps to remove the hydrogen.

The aqueous electrolyte solution is environmentally friendly and produces no hazardous wastes, whereas the current process employs environmentally challenging and hazardous hydrofluoric acid (HF) and nitric acid ($HNO_3$) acids which are extremely difficult to handle, and which can be used only under stringent permitting programs. As a result, processes using the aqueous electrolyte solution can be operated without significant air handling equipment and require no operator hazardous chemical protective gear, as is required to use the current HF—$HNO_3$ process.

For crack modulation and alpha case removal, although surface finish is not particularly important and improving the surface finish is unnecessary due to the further working steps that will follow, it is still desirable not to degrade the material surface severely or to cause pitting or other deep defects in the material.

In FIGS. 3D, 4E-4J, 7A, 8A, 9A, and 10A it can be seen that the greatest material removal rates are obtained by maximizing the ABF concentration and temperature (i.e., at an ABF concentration of 120 g/L and a temperature of 85° C. as shown in the graphs), while maintaining the citric acid concentration at or below 300 g/L. Further, as highlighted in several of the figures including FIGS. 4E-4G, because citric acid tends to mitigate the attack of fluoride ions on the material surface, it can be seen that the material removal rate tends to spike upward as the citric acid concentration approaches 0 g/L. However, at near zero citric acid conditions, FIGS. 4H, 7B, 8B, 9B, and 10B indicate that surface pitting and severe surface finish degradation may result.

Therefore, when using the aqueous electrolyte solution for crack modulation, where severe surface degradation is preferably avoided, at least a small amount of citric acid, for example 1 g/L or 10 g/L, should be used to mitigate the most severe effects of the fluoride ion attack. However, when using the aqueous electrolyte solution for alpha case removal, where severe surface degradation would not be particularly detrimental, the fluoride ion attack can be allowed to be as aggressive as possible without causing serious pitting, and therefore the citric acid concentration can be reduced to near zero.

In both crack modulation and alpha case removal circumstances, it is desirable to avoid introducing hydrogen into the material, so as to prevent embrittlement. Because, as seen particularly in FIGS. 1A-1C, 2A-2B, and 4E-4G, material removal rates are relatively insensitive to current density, and because higher current densities tend to cause hydrogen to be driven into the material, it is preferable to operate at the lowest effective current densities.

Although described in connection with exemplary embodiments thereof, it will be appreciated by those skilled in the art that additions, deletions, modifications, and substitutions not specifically described may be made without departing from the spirit and scope of the invention as defined in the appended claims, and that the invention is not limited to the particular embodiments disclosed.

The invention claimed is:

1. A method of treating the surface of a nonferrous metal workpiece, comprising exposing the surface to a bath of an aqueous electrolyte solution including a concentration of citric acid from about 1 g/L to about 982 g/L and a concentration of ammonium bitluoride from about 1 gL to about 360 g/L, and having no more than about 3.35 g/L of a strong acid;

controlling the temperature of the bath between about 2° C. and about 98° C.;

connecting the workpiece to the anode of a DC power supply and immersing a cathode of the DC power supply in the bath; and applying a current across the bath.

2. The method of claim 1, wherein the temperature of the bath is controlled from about 21° C. to about 85° C.

3. The method of claim 1, wherein the current applied across the bath is less than or equal to about 255,000 amperes per square meter.

4. The method of claim 3, wherein the current applied across the bath is less than or equal to about 5,000 amperes per square meter.

5. The method of claim 1, wherein the concentration of citric acid is less than about 780 g/L.

6. The method of claim 1, wherein the concentration of ammonium bifluoride is less than or equal to about 120 g/L.

7. A method of modulating cracks in the surface of a non-ferrous metal workpiece, comprising:

exposing the surface to a bath of an aqueous electrolyte solution including a concentration of citric acid from about 1 g/L to about 982 g/L and a concentration of ammonium bifluoride from about 1 g/L to about 360 g/L, and having no more than about 3.35 g/L, of a strong acid;

connecting the workpiece to the anode of a DC power supply and immersing a cathode of the DC power supply in the bath;

applying a current across the bath of less than about 255,000 amperes per square meter;

maintaining the current for a time sufficient to round the bottoms of the cracks; and discontinuing the current and removing the workpiece from the bath before the surface of the workpiece is removed to the level of the bottom of the cracks.

8. A method of metal oxide removal from the substrate surface of a non-ferrous metal workpiece, comprising;

exposing the surface to a bath of an aqueous electrolyte solution including a concentration of citric acid from about 1 g/L to about 180 g/L and a concentration of ammonium bifluoride from about 1 g/L, to about 120 g/L, and having no more than about 135 g/L of a strong acid;

controlling the temperature of the bath to be less than or equal to about 85° C.;

connecting the workpiece to the anode of a DC power supply and immersing a cathode of the DC power supply in the bath; and applying a current across the bath of less than about 255,000 amperes per square meter.

9. A method of alpha case removal from the substrate surface of a titanium or titanium alloy workpiece, comprising:

exposing the surface to a bath of an aqueous electrolyte solution including a concentration of citric acid from about 1 g/L to about 180 g/L and a concentration of ammonium bifluoride from about 1 g/L to about 120 g/L and having no more than about 3.35 g/L of a strong acid;

controlling the temperature of the bath to be less than or equal to about 85° C.;

connecting the workpiece to the anode of a DC power supply and immersing a cathode of the DC power supply in the bath; and applying a current across the bath of less than about 5,000 amperes per square meter.

* * * * *